US006456820B1

(12) United States Patent
Sato et al.

(10) Patent No.: US 6,456,820 B1
(45) Date of Patent: Sep. 24, 2002

(54) CLEANING BLADE

(75) Inventors: Kazuhiko Sato; Ken Ohmura, both of Hachioji (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/888,747

(22) Filed: Jun. 25, 2001

(30) Foreign Application Priority Data

Jun. 27, 2000 (JP) ..... 2000-192609
Jul. 18, 2000 (JP) ..... 2000-217502

(51) Int. Cl.[7] ..... G03G 21/00

(52) U.S. Cl. ..... 399/350

(58) Field of Search ..... 399/350, 343, 399/351, 273, 283, 174; 15/256.5

(56) References Cited

U.S. PATENT DOCUMENTS 5,721,082 A * 2/1998 Oshiba et al. ..... 430/125
6,282,400 B1 * 8/2001 Aoki et al. ..... 399/350
6,282,401 B1 * 8/2001 Proulx et al.. ..... 399/350

FOREIGN PATENT DOCUMENTS

JP 06-308866 A * 11/1994 ..... G03G/21/00
JP 09-106231 A * 4/1997 ..... G03G/21/10

* cited by examiner

*Primary Examiner*—Robert Beatty
(74) *Attorney, Agent, or Firm*—Cantor Colburn LLP

(57) ABSTRACT

A cleaning unit having a cleaning blade which removes residual toner from an organic photoreceptor is disclosed. The cleaning unit is constituted so as to satisfy the relation of the variation of dynamic torque values of from 10 Hz to 10 kHz, generated between said organic photoreceptor and said cleaning blade in the specification.

7 Claims, 15 Drawing Sheets

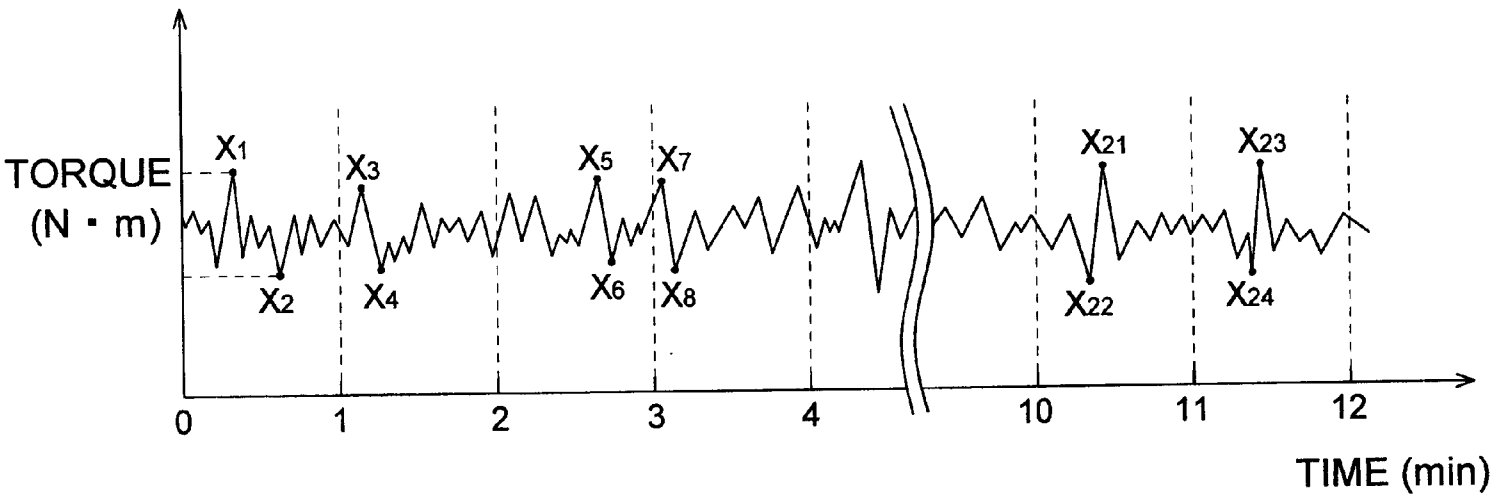
FIG. 3 ( a )

FIG. 3 ( b )
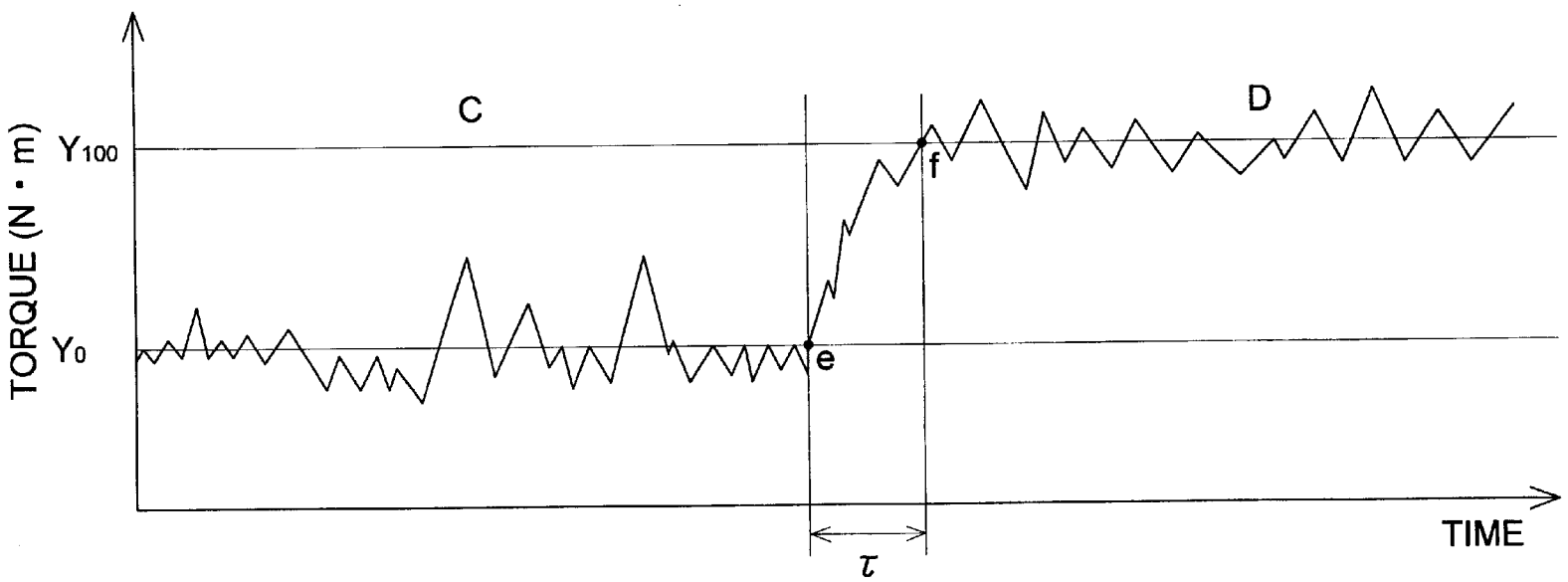

CLEANING BLADE

FIELD OF THE INVENTION

The present invention relates to a cleaning unit employed in electrophotographic copiers, printers, and the like, an image forming method and an image forming apparatus employing said cleaning unit.

BACKGROUND OF THE INVENTION

In recent years, organic photoreceptors (hereinafter referred simply to as photoreceptors), comprising organic photoconductive materials, have been the most widely employed image bearing bodies in electrophotographic image forming apparatuses. Compared to other photoreceptors, organic photoreceptors exhibit advantages in such a manner that it is easy to develop materials which correspond to various types of exposure light sources ranging from visible light to infrared rays; it is possible to select materials which result in minimum environmental pollution; their production cost is lower, and the like. However, said organic photoreceptors do exhibit one disadvantage in that the mechanical strength is insufficient, and during production of numerous copies and prints, the photoreceptor surface tends to be degraded or abraded.

Further, said organic photoconductor exhibits large contact energy with the toner, which visualizes the electrostatic latent images formed on the photoreceptor. As a result, it is difficult to remove the resulting residual toner, which remains on the photoreceptor after transferring said toner image onto a transfer material in the transfer process. Thus various problems regarding the cleaning on the photoreceptor surface tend to occur.

On the other hand, due to the progress of digital technology in recent years, an image forming method utilizing a digital system has played an increasing role in the image forming method utilizing the electrophotographic system. The image forming method utilizing said digital system is basically carried out in such a manner that an image, comprised of small dots called pixels, of 400 dpi, and the like, can be visualized. Demanded thus is a high image quality technique which faithfully reproduces images comprised of such small dots.

In order to realize such desired high image quality technique, one of the most important techniques is that which relates to toner production. Heretofore, for forming electrophotographic images, mainly employed have been so-called pulverized toners which are prepared in such a manner that toner powder, which is obtained by blending and kneading binder resins with pigments and then pulverizing the resultant mixture, is subjected to classification during a classifying process. However, the toner obtained through such production processes is limited in uniform particle size distribution of toner particles. As a result, the particle size distribution, as well as the shape of toner particles, has not been sufficiently uniform. Thus in electrophotographic images obtained by employing such pulverized toner, it is difficult to achieve the desired high image quality.

In recent years, as a means to achieve uniform size distribution as well as uniform shape of said toner particles, proposed have been electrophotographic developer materials or image forming methods utilizing polymerized toner. Said polymerized toner is produced by uniformly dispersing monomers as the raw material in a water based system and then polymerizing the resultant dispersion. As a result, it is possible to obtain a toner having a uniform size distribution as well as uniform shape.

Herein, when said polymerized toner is applied to an image forming apparatus utilizing an organic photoconductor, new technical problems have surfaced. Namely, as described above, the toner particle shape of said polymerized toner is formed during the monomer polymerization process. As a result, formed is a nearly spherical shape. As is already well known, toner of a spherical shape, which remains on said organic photoreceptor, tends to be insufficiently removed. Specifically, the surface of the organic photoreceptor tends to be worn. When toner particles adhere to the roughened surface, caused by said wear, fine toner particles are not completely removed by cleaning, in such a range that the resultant images are not visually affected. Such toner particles, which have not been removed, stain charging members (such as charging wires and charging rollers). As a result, halftone images, and the like, result in image unevenness.

In order to improve the insufficient cleaning which results in the image forming method, utilizing polymerized toner as described above, heretofore, various proposals have been made. of these, applied has been one proposal in which the shape of the polymerized toner is varied from a circular shape to an elliptic one, and another in which the surface shape of the polymerization toner surface is varied into an irregular one. However, these proposals have not sufficiently overcome the stated problems.

SUMMARY OF THE INVENTION

An objective of the present invention is to provide a cleaning unit which overcomes the aforementioned problems, and upon using an organic photoreceptor and a polymerized toner, maintains the desired cleaning performance for an extended period of time, results in no image problems and is capable of forming excellent electrophotographic images, and an image forming method, as well as an image forming apparatus using said cleaning unit.

In order to overcome the aforementioned problems, the inventors of the present invention conducted persistent investigations. As a result, it became possible to secure excellent cleaning properties as well as to maintain stable vibration of the cleaning blade by adjusting torque variation generated between the photoreceptor and the cleaning blade into an optimal range. Thus, it became possible to overcome said problems. Namely, it was discovered that the objective of the present invention was achieved by utilizing any of constitutions described below.

A cleaning unit having a cleaning blade which removes residual toner from an organic photoreceptor after development of an electrostatic latent image formed on said organic photoreceptor, employing a developer comprising a toner and subsequently transferring a toner image, visualized through said development, onto a transfer material from said organic photoreceptor, a cleaning unit wherein said cleaning unit is constituted so as to satisfy the aforementioned relational expression, Formula 2, when the variation of dynamic torque values of from 10 Hz to 10 kHz, generated between said organic photoreceptor and said cleaning blade, is expressed by the aforementioned Formula 1.

$$T=\Sigma\{(X_{2n-1})^2+(X_{2n})^2\},\ n=1 \text{ to } 12 \qquad \text{Formula 1}$$

$$M=\{\Sigma(X_{2n-1}+X_{2n}))^2/24,\ n=1 \text{ to } 12$$

$$N=\{(\Sigma X_{2n-1})^2+(\Sigma X_{2n})^2\}/12 - M,\ n=1 \text{ to } 12$$

$$E=(T - M - N)/22$$

wherein $X_{2n-1}$: Maximum value of dynamic torque from (n-1) to n minute in N-m, wherein n is 1 to 12.

$X_{2n}$: Minimum value of dynamic torque from (n-1) to n minute in N-m.

$$S \geqq 13 \quad \text{Formula 2}$$

wherein $$S=10\log\{(M - E)/24E\}$$

A cleaning unit having a cleaning blade which removes residual toner from an organic photoreceptor after development of an electrostatic latent image formed on said organic photoreceptor, employing a developer comprising a toner and subsequently transferring a toner image, visualized through said development, onto a transfer material from said organic photoreceptor, a cleaning unit wherein said cleaning unit is constituted so as to satisfy the aforementioned relational expression, Formula 3, when the variation of dynamic torque values of from 10 Hz to 10 kHz, generated between said organic photoreceptor and said cleaning blade, is expressed by the aforementioned Formula 1.

$$0.00<K<0.9 \quad \text{Formula 3}$$

wherein $$K=\sqrt{\{(M - E)/24\}}$$

A cleaning unit having a cleaning blade which removes residual toner from an organic photoreceptor after developing an electrostatic latent image formed on said organic photoreceptor, employing a developer comprising a toner and subsequently transferring a toner image, visualized through said development, onto a transfer material from said organic photoreceptor, a cleaning unit wherein said cleaning unit is constituted so as to satisfy the aforementioned relational expression, Formula 4, when the variation of dynamic torque values of from 10 Hz to 10 kHz, generated between said organic photoreceptor and said cleaning blade, is expressed by the aforementioned Formula 1.

$$0<G\leqq 0.1 \quad \text{Formula 4}$$

wherein $$G=\sqrt{E}$$

A cleaning unit having a cleaning blade which removes residual toner from an organic photoreceptor after development of an electrostatic latent image formed on said organic photoreceptor, employing a developer comprising a toner and subsequently transferring a toner image, visualized through said development, onto a transfer material from said organic photoreceptor, a cleaning unit wherein said cleaning unit is constituted so as to satisfy the aforementioned relational expression, Formula 5, when the variation of dynamic torque values of from 10 Hz to 10 kHz, generated between said organic photoreceptor and said cleaning blade, is expressed by the aforementioned Formula 1.

$$0<H<0.2 \quad \text{Formula 5}$$

wherein $$H=\Sigma(X_{2n-1})/12-\Sigma(X_{2n})/12,\ n=1 \text{ to } 12$$

A cleaning unit having a cleaning blade which removes residual toner from an organic photoreceptor after development of an electrostatic latent image formed on said organic photoreceptor, employing a developer comprising a toner and subsequently transferring a toner image, visualized through said development, onto a transfer material from said organic photoreceptor, a cleaning unit wherein said cleaning unit is constituted so as to satisfy the aforementioned relational expression, Formula 6, when the variation of dynamic torque values of from 10 Hz to 10 kHz, generated between said organic photoreceptor and said cleaning blade, is expressed by the aforementioned Formula 1.

$$0.1<J\leqq 0.8 \quad \text{Formula 6}$$

wherein $$J=\Sigma\{ (X_{2n-1})+(X_{2n}) \}/24,\ n=1 \text{ to } 12$$

A cleaning unit having a cleaning blade which removes residual toner from an organic photoreceptor after development of an electrostatic latent image formed on said organic photoreceptor, employing a developer comprising a toner and subsequently transferring a toner image, visualized through said development, onto a transfer material from said organic photoreceptor, a cleaning unit wherein said cleaning unit is constituted so as to satisfy the aforementioned relational expression, Formulas 2 through 6, when the variation of dynamic torque values of from 10 Hz to 10 kHz, generated between said organic photoreceptor and said cleaning blade, is expressed by the aforementioned Formula 1.

The above cleaning units can employ toner which has a variation coefficient of the shape coefficient of said toner particles of no more than 16 percent as well as has a number variation coefficient of the number size distribution of said toner particles of no more than 27 percent.

The above cleaning units can employ toner which comprises at least 65 percent by number of toner particles having a shape coefficient in the range of from 1.2 to 1.6.

The above cleaning units can employ toner which comprises at least 50 percent by number of toner particles having no corners.

BRIEF DESCRIPTION OF THE DRAWINGS

FIGS. 3(*a*) and 3(*b*) each is a graph for measuring the dynamic torque generated by the friction of a cleaning blade with an organic photoreceptor.

DETAILED DESCRIPTION OF THE INVENTION

The present invention will now be further detailed.

The inventors of the present invention discovered that by utilizing said constitution of the present invention, it was possible to effectively remove residual toner from the photoreceptor without excessively increasing the friction force generated between the organic photoreceptor and the cleaning blade while minimizing blade curl, and to consistently obtain excellent images for an extended period of time. The present invention will now be detailed hereunder.

Figure 1:
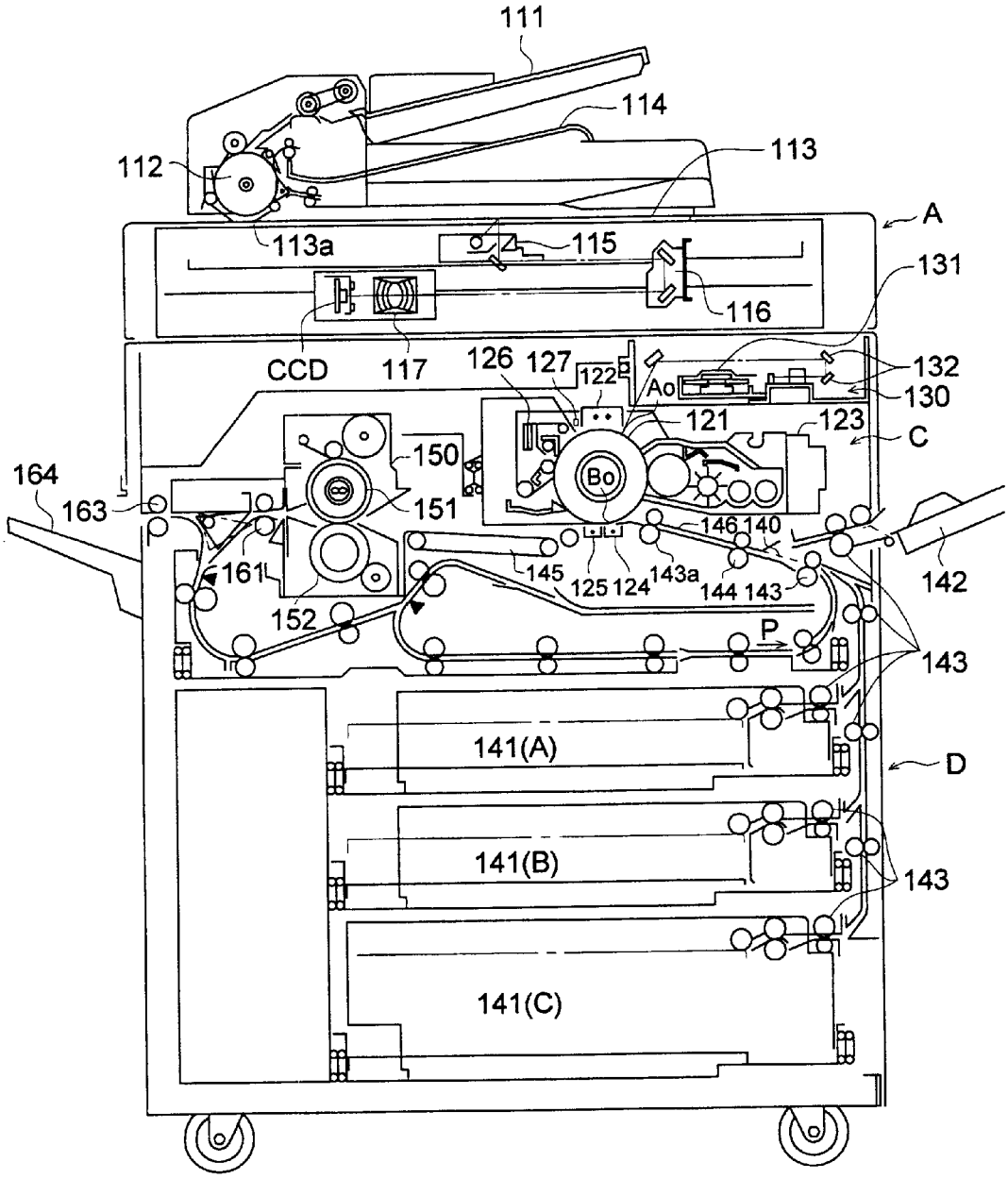
FIG. 1 is a schematic view showing the entire constitution of the image forming apparatus of the present invention.

FIG. 1 is a schematic view showing the entire constitution of the image forming apparatus of the present invention.

The image forming apparatus shown in FIG. 1 is one employing a digital system, and is comprised of image reading section A, image processing section B (not shown), image forming section C, and transfer paper conveying section D, as the transfer paper conveying means.

In the upper section of image reading section A, provided is an automatic original document conveying means which automatically conveys the original documents. Original documents, which are placed on document platen 111, are separately conveyed sheet by sheet by original document conveying roller 112, and image reading is carried out at reading position 113*a*. The original document, which has been read, is ejected onto document ejecting tray 114, utilizing document conveying roller 112.

On the other hand, the image of the original document, which is placed on platen glass 113, is read by reading operation at a speed of v of first mirror unit 115 comprised of an illuminating lamp and a first mirror which constitutes an optical scanning system, as well as by movement at a speed of v/2 in the same direction of second mirror unit 116 comprised of a second mirror and a third mirror which are positioned in a V shape.

The read image is focused through projection lens 117 onto the receptor surface of imaging sensor CCD of a line sensor. The linear optical image, which has been focused onto imaging sensor CCD, is successively subjected to photoelectric conversion to obtain electric signals (brightness signals), and thereafter, is subjected to A/D conversion. The resultant signals are then subjected to various processes such as density conversion, a filtering process, and the like, in image processing section B, and then the resultant image data are temporarily stored in a memory.

In image forming section C, arranged as image forming units are drum-shaped image bearing photoreceptor (hereinafter referred to also as a photoreceptor drum) 121, and around said photoreceptor drum, charging unit 122 as the charging means, development unit 123 as the development means, transfer unit 124 as the transfer means, separating unit 125 as the separating means, cleaning unit 126 and PCL (pre-charge lamp) 127 in said order for each cycle. Photoreceptor 121 is prepared by applying photoconductive compounds onto a drum base body. For example, organic photoreceptors (OPC) are preferably employed. Said drum rotates clockwise as shown in FIG. 1.

After the rotating photoreceptor is uniformly charged employing charging unit 122, image exposure is carried out based on image signals retrieved from the memory of image processing section B, employing exposure optical system 130. In said exposure optical system 130, which is utilized as the writing means, a laser diode (not shown) is employed as the light emitting source, and primary scanning is carried out in such a manner that light passes through rotating polygonal mirror 131, an fθ lens (having no reference numeral), and a cylindrical lens (also having no reference numeral), and the light path is deflected by reflection mirror 132. As a result, image exposure is carried out at position $A_0$ with respect to photoreceptor 121, and a latent image is formed by the rotation (secondary scanning) of photoreceptor 121. In one example of the present embodiment, exposure is carried out for a text section and the latent image is formed.

The latent image on photoreceptor 121 is subjected to reversal development employing development unit 123, and a visualized toner image is formed on the surface of said photoreceptor 121. In transfer sheet conveying section D, under the image forming unit provided are sheet supply units 142(A), 141(B), and 141(C) as paper sheet storing means, in which different-sized paper sheets P are stored, and provided on the exterior, is manual paper sheet supply unit 142 by which paper sheets are manually supplied. Paper sheet P, which is selected from any of these paper sheet supply units is conveyed along conveying path 140 employing paired guide rollers 143, and the conveyance of the paper sheet P is temporarily suspended by paired register rollers 144 which correct for any inclination as well as any deviation of paper sheet P, and thereafter the conveyance resumes again. Paper sheet P is guided by conveyance path 140, paired pre-transfer rollers 143*a*, and guide plate 146 so that the toner image on photoreceptor 121 is transferred onto paper sheet P at transfer position $B_0$ employing transfer unit 124. Subsequently, charge elimination is carried out employing separation unit 125; paper sheet P is separated from the surface of the photoreceptor 121 and is conveyed to fixing unit 150, employing conveying unit 145.

Fixing unit 150 comprises fixing roller 151 as well as pressure roller 152. By passing paper sheet P between fixing roller 151 and pressure roller 152, heat as well as pressure is applied to melt-fix the toner. Paper sheet P, which has been subjected to fixing of its toner image, is ejected onto paper sheet storage tray 164.

Figure 2:
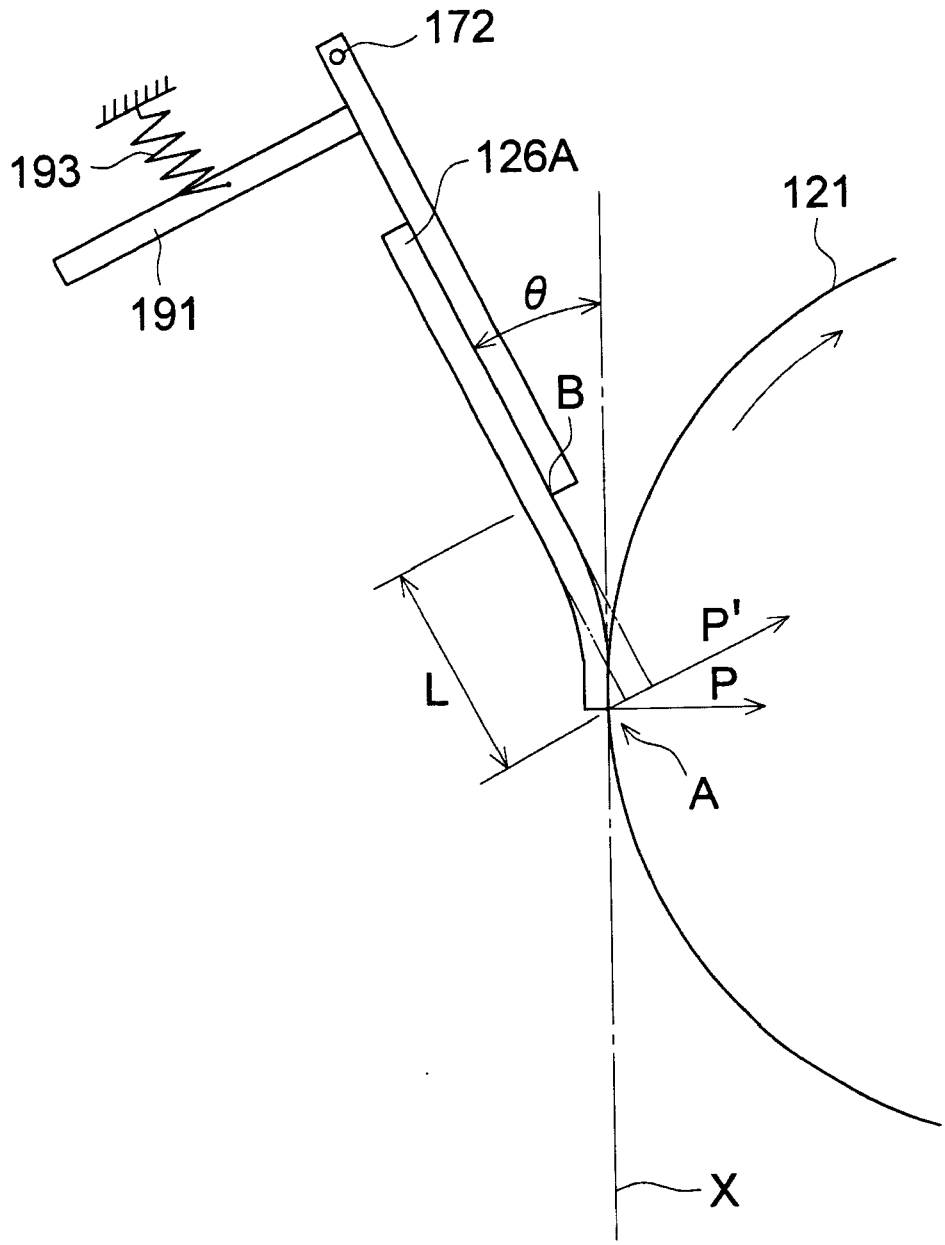
FIG. 2 is a view showing the constitution of a cleaning device employing the cleaning blade of the present invention.

FIG. 2 is view showing the constitution of a cleaning unit employing the cleaning blade of the present invention.

In the present invention, contact load P and contact angle θ of said cleaning blade against the photoreceptor are preferably from 0.05 to 40 N/m and from 5 to 35 degrees, respectively.

Further, as shown in FIG. 2, free length L of said cleaning blade represents the length from end B of support member 191 to the end of the cleaning blade prior to deformation. Said free length L is preferably from 6 to 15 mm. The thickness of said elastic cleaning blade is preferably from 0.5 to 10 mm.

Said contact load P is a vector value in the normal direction of pressure contact force P', when blade 126A comes into contact with photoreceptor drum 121.

Further, said contact angle θ represents the angle of tangent X at contact point A of the photoreceptor to the blade prior to deformation (in FIG. 2, shown by the dotted line). Numeral 172 is a screw which secures the support member, and 193 is a loaded spring.

The present invention is characterized in that the relationship regarding the variation of dynamic torque values of a frequency of 10 Hz to 10 kHz generated between the organic photoreceptor and the cleaning blade is adjusted so that said relational expression Formula 2 is satisfied under conditions of said Formula 1. Based on said invention, it was discovered that no blade curl resulted and cleaning properties were improved.

In Formula 1, $X_1, X_2, X_3, \ldots, X_{24}$ are values of dynamic torque generated by friction of the cleaning blade with the organic photoreceptor, which are measured with respect to a time axis. It is assumed that the variation of said dynamic torque value occurs due to the vibration of the friction of said cleaning blade. As a result, the dynamic torque values of the present invention are measured in the frequency range of from 10 Hz to 10 kHz. FIG. 3(*a*) is a graph of measured dynamic torque generated by friction of said cleaning blade with said organic photoreceptor.

In FIG. 3(*a*), each X value is a measured dynamic torque value every minute for 12 minutes from the beginning of the measurement. For example, $X_1$ and $X_2$ represent respectively a maximum value and a minimum value within 1 minute from the beginning of the measurement. Namely, $X_1, X_3, X_5, \ldots, X_{23}$ each represent the maximum value of dynamic torque generated within 1 minute on the time axis, while $X_2, X_4, X_6, \ldots, X_{24}$ each represent the minimum value of dynamic torque generated within 1 minute of the time axis.

The meaning of said Formulas 2 through 6 will now be described hereunder.

In Formula 2, "S" is represented by the formula described below.

$$S=10\log\{(M - E)/24E\}$$

"S" represents a conceptual value obtained by dividing the average value of dynamic torque by the variation value (fluctuation) of said dynamic torque. When "S" exceeds 13, it indicates that said cleaning blade and said photoreceptor maintain a stabilized friction force, and toner is sufficiently removed. On the other hand, when "S" is less than 13, toner tends not to be sufficiently removed.

In Formula 3, "K" is represented by the formula described below.

$$K=\sqrt{\{(M - E)/24\}}$$

"K" represents a conceptual value showing the average value of dynamic torque. When $0.001<K<0.9$ is held, a sufficient friction force is generated between the photoreceptor and the cleaning blade so that cleaning problems such as insufficient removal of toner, and the like do not occur. Further scratches on the photoreceptor does not occurs. Preferably $0.05<K<0.5$ is satisfied. When "K" exceeds 0.9, the blade tends to result in curling and toner particles having a diameter of no more than 0.001 tend not to be sufficiently removed.

In Formula 4, "G" is represented by the formula described below.

$$G=\sqrt{E}$$

"G" is a conceptual value showing the variation of dynamic torque. When $0<G\leqq 0.1$, preferably $0<G\leqq 0.05$, is held, a stable friction force is applied between the photoreceptor and the cleaning blade. As a result, it is possible to achieve excellent cleaning in which neither blade curling nor insufficient toner removal occurs. And toner scattering is reduced. When "G" exceeds 0.1, the vibration of the blade becomes unstable and tends to result in blade curling.

In Formula 5, "H" is represented by the formula described below.

$$H=\Sigma(X_{2n-1})/12-\Sigma(X_{2n})/12,\ n=1 \text{ to } 12$$

"H" represents the difference between the average of the maximum torque and the average of the minimum torque. By setting cleaning conditions so as to hold $0<H\leqq 0.2$, it is possible to decrease the difference between the maximum friction force and the minimum friction force generated between the photoreceptor and the cleaning blade. Thus it is possible to achieve excellent cleaning properties which results in neither blade curling nor insufficient toner removal. When "H" exceeds 0.2, the blade is frequently subjected to abnormally high friction force and thus blade curling tends to result.

In Formula 6, "J" is represent by the formula described below.

$$J=\Sigma\{(X_{2n-1})+(X_{2n})\}/24,\ n=1 \text{ to } 12$$

"J" represents an average dynamic torque obtained utilizing the maximum value and the minimum value of dynamic torque. By holding $0.1<J\leqq 0.8$, a friction force between the cleaning blade and the photoreceptor is sufficiently generated so that cleaning problems such as insufficient toner removal, and the like, do not occur. When "J" is no more than 0.001, toner is insufficient removed, while when "J" is at least 0.8, blade curling tends to occur.

In the present invention, the relationship regarding the variation of torque values generated between the organic photoreceptor and the cleaning blade is preferably regulated and fixing of outer additive is reduced so as to satisfy said Formulas 21 and 22.

In Formulas 21 and 22, $Y_0$ and $Y_{100}$ are a dynamic torque average in the case of no formation of toner images on the photoreceptor and a dynamic torque average in the case of formation toner images on the same under a blackening ratio of 100 percent, respectively.

The dynamic torque in the case of no formation of toner images on the photoreceptor, as described herein, refers to a dynamic torque when solid white images are formed on the entire surface of the photoreceptor. When digital reversal development is carried out, said dynamic torque refers to a dynamic torque of the image region which is not subjected to image exposure, while in normal development employed in analogue copiers and the like, said dynamic torque refers to a torque when white images are formed.

Dynamic torque average $Y_0$, in the case of no formation of toner images, is expressed as a simple average of all dynamic torque values which are determined at an interval of 10 milliseconds over 10 seconds while forming a solid white image.

The dynamic torque in the case of the formation of toner images on the photoreceptor, having a blackening ratio of 100 percent, as described herein, refers to a dynamic torque when the entire surface of the photoreceptor is subjected to a blackening ratio of 100 percent, namely, when solid black images are copied so as to result in a toner adhesion amount of from 0.55 to 0.75 mg/cm$^2$.

Dynamic torque averages $Y_{100}$ in the case of the formation of toner images on the photoreceptor, having a blackening ratio of loo percent, is expressed as a simple average of all dynamic torque values which are determined at an interval of 10 milliseconds over 10 seconds while forming a solid black image.

Said dynamic torque was determined employing the torque measurement device described below.

The cleaning unit of the present invention is characterized in that said unit is constituted so that the shortest time $\tau$, required to change said dynamic torque $Y_0$ to Y100 is from 0.010 to 0.500 second.

The shortest time $\tau$,required to change said dynamic torque $Y_0$ to $Y_{100}$ , as described herein, refers to the shortest time during which said dynamic torque $Y_0$ which emerges in the boundary area, changing from a white background image to a black background image, reaches a level of $Y_{100}$, while solid black images are continuously copied employing a white background image. In order to stabilize image forming conditions of said white background image as well as said solid black image, said shortest time is determined under conditions when each image is formed for at least one minute.

FIG. 3(*b*) is a graph of measured dynamic torque generated by the friction of a cleaning blade against an organic photoreceptor.

In FIG. 3(*b*), C region shows the dynamic torque waveform of a white background image area, and D region shows the dynamic torque waveform of a solid black image area. In FIG. 3(*b*), the shortest time $\tau$ required to change $Y_0$ to $Y_{100}$ refers to from "e" to "f", namely, it shows the shortest time to move from a level of $Y_0$ to a level of $Y_{100}$.

Method for Measuring the Dynamic Torque of the Present Invention

Figure 16:
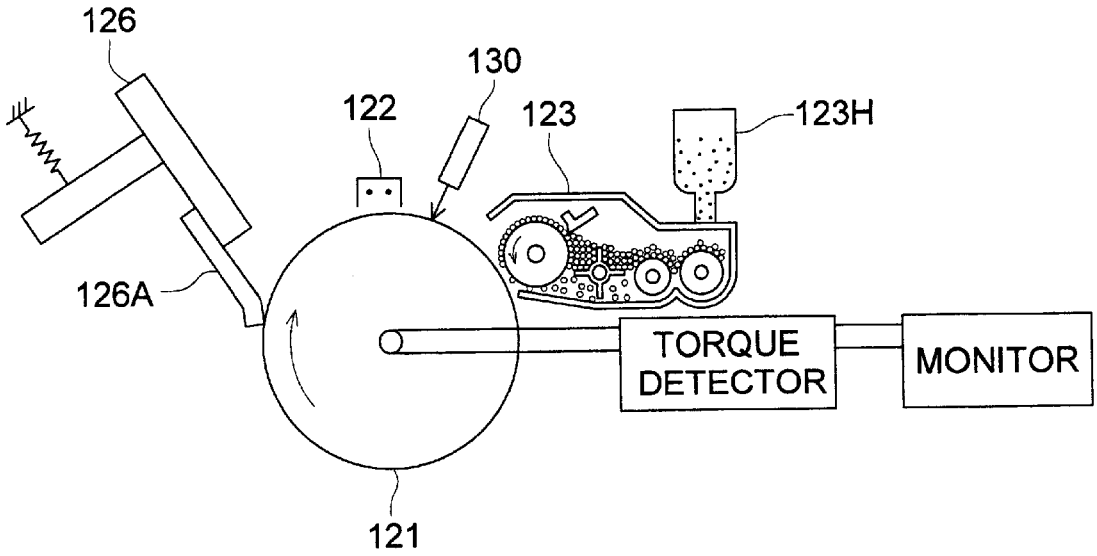
FIG. 16 is a schematic view showing a torque measurement device.

The dynamic torque of the present invention was determined in such a manner that a torque measurement device (MD204R of Ono Sokki Co., Ltd.) was disposed between the motor, which drove a photoreceptor drum, and the driving shaft of said photoreceptor. FIG. 16 is a schematic view showing said torque measurement device. Said torque measurement device is comprised of a driving shaft of a photoreceptor drum, a driving motor thereof, charging unit 122, optical exposure system 130, development unit 123, toner supply unit 123H, and cleaning unit 126. At each set condition, dynamic torque was determined while a cleaning blade was arranged to the cleaning unit of said torque measurement device. The dynamic torque of said cleaning blade was measured employing said torque measurement device. Subsequently, signals of said measurement device were transmitted to an operation display unit (TS360 of Ono Sokki Co., Ltd.), and subjected to data treatment, employing a personal computer, whereby said $Y_0$ and $Y_{100}$, as well as $\tau$, were calculated. Said dynamic torque is determined, for example, at a circumferential speed of 280 mm/second employing a $\phi$80 mm photoreceptor drum. Each dynamic torque was measured at an interval of 10 milliseconds. Further, when said torque measurement device was first employed, a setting powder comprised of a fluorine resin powder was scattered onto the photoreceptor and the cleaning blade, and said photoreceptor drum rotated for one minute.

The cleaning unit of the present invention is constituted so as to satisfy Formulas 21 and 22 wherein $Y_0$ represents the average of dynamic torque in the case of no formation of toner images on the organic photoreceptor, and $Y_{100}$ represents the average of dynamic torque in the case of the formation of toner images having a blackening ratio of 100 percent.

$$0.2 \geqq Y_{100} - Y_0 \geqq 0.01 \quad \text{Formula 21}$$

$$2.95 \geqq Y_{100} Y_0 \geqq 1.15 \quad \text{Formula 22}$$

(unit of $Y_{100}$ and $Y_0$: N-m)

When the relationship between $Y_{100}$ and $Y_0$ is out of said range, insufficient toner removal tends to occur and streaking image problems as well as image unevenness on gray scale images also tends to occur.

Said range of $Y_{100}$ and $Y_0$ is preferably $0.18 \geqq Y_{100} - Y_0 \geqq 0.02$ and $2.85 \geqq Y_{100}/Y_0 \geqq 1.2$, respectively, and is most preferably $0.12 \geqq Y_{100} - Y_0 \geqq 0.05$ and $2.3 \geqq Y_{100}/Y_0 \geqq 1.3$.

The shortest time $\tau$ required for changing the dynamic torque of the present invention from $Y_0$ to $Y_{100}$ is from 0.010 to 0.500 second. When $\tau$ is less than 0.010, bound is generated in the blade. As a result, insufficient toner removal tends to momentarily result and line-like image problems parallel to the blade tend to occur. On the other hand, when $\tau$ is no less than 0.500 second, the scraping force of the blade against the photoreceptor is unable to follow the change of image density, and insufficient toner removal tends to occur. Thus said insufficient toner removal tends to result in filming on the photoreceptor. Further, $\tau$ is preferably in the range of from 0.015 to 0.400 second, and is most preferably in the range of from 0.05 to 0.300 second.

Cleaning blades employed in the present invention are preferably elastic rubber blades. By simultaneously controlling rubber hardness and impact resilience, it is possible to control the torque variation of the present invention while minimizing said variation, and to more effectively retard blade curling. When JIS A Hardness of the blade at 25+5° C. becomes no more than 65, blade curling tends to occur, while when said hardness becomes at least 80, cleaning performance degrades. Further, when the impact resilience exceeds 80, blade curling tends to occur, while when said impact resilience is no more than 20, cleaning performance degrades. The impact resilience is more preferably from 20 to 80. Young modulus is preferably in the range of from 294 to 588 N/cm$^2$.

(JIS A Hardness as well as the impact resilience is determined based on JIS K6301 Physical Test Method of Vulcanized Rubber. Figures of the impact resilience are shown as a percent.)

Known as materials of elastic rubber blades employed as said cleaning blade are urethane rubber, silicone rubber, fluorine rubber, chloroprene rubber, butadiene rubber, and the like. Of these, urethane rubber is particularly preferred due to its excellent wear resistance compared to other rubber materials. For example, preferred are urethane rubber described in Japanese Patent Publication Open to Public Inspection No. 59-30574, which is obtained by allowing polycaprolactone ester to react with polyisocyanate followed by hardening, and the like.

Figure 4:
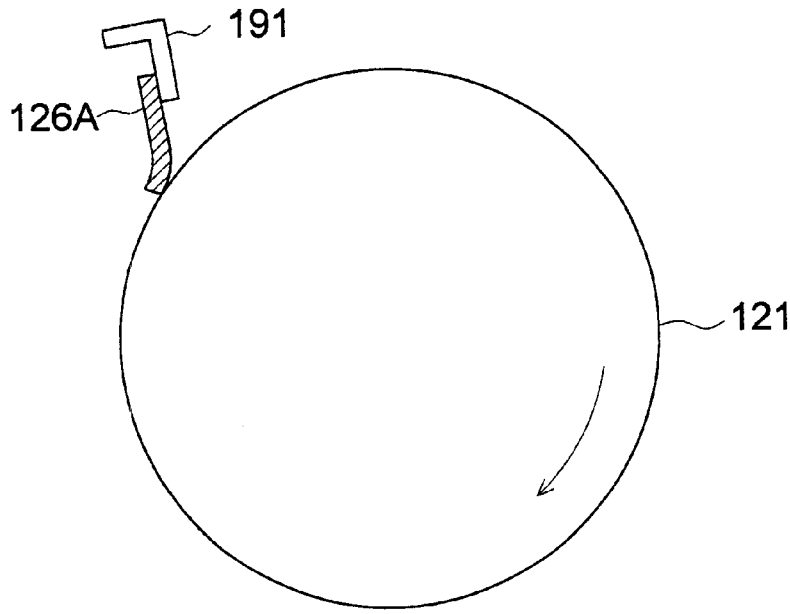
FIG. 4 is a view of a method for securing a cleaning blade to its support member.
Figure 4:
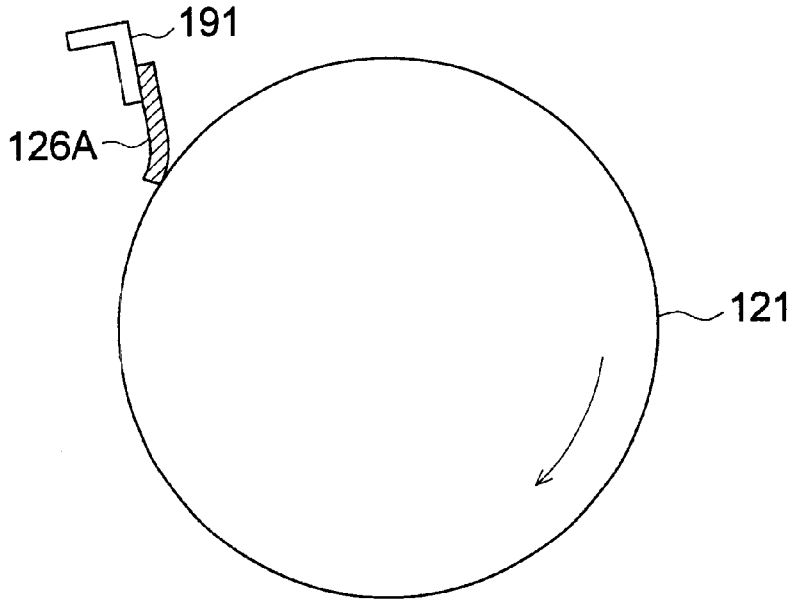

In the present invention, a method for fixing said elastic rubber blade onto a support member is preferably in such a manner that it is substantially reinforces the support member on the photoreceptor contacting surface side. By utilizing such a method, it is possible to stabilize the torque variation. FIG. 4 is a view showing a method for fixing an elastic rubber blade onto a support member. In FIG. 4, contacting method (a) is more preferable than (b).

Proper pressure contacting conditions of said elastic rubber blade onto the photoreceptor surface are determined depending on a delicate balance between various characteristics, and the range is fairly narrow. Said conditions also vary depending on characteristics such as the thickness of said elastic rubber blade and the like. As a result, accuracy is essential when said conditions are set. However, when elastic rubber blades are produced, the thickness unavoidably results in some fluctuation. As a result, it is difficult to consistently set said conditions properly. Further, even though said conditions are properly set at the beginning, during use, said conditions may wander out of the proper range due to the fact that said range is quite narrow. Specifically, when combined with an organic photosensitive layer employing high molecular weight binder resins, image problems such as filming, black spots, and the like, tend to occur while wandering out of the proper range.

Accordingly, it is necessary to utilize methods in which the fluctuation and the like of characteristics of said elastic rubber blades are cancelled out. Thus it is assumed that even though elastic rubber blades result in fluctuation of thickens, said setting method, which results in no effects to the pressure contact onto the photoreceptor surface, is effective.

In the present invention, the free edge of said elastic rubber blade is preferably brought into pressure contact with the photoreceptor in the opposite direction of rotation of said photoreceptor.

Further, if desired, it is preferable that fluorine based lubricants are sprayed onto the end portion of the first blade member which comes in contact with the photoreceptor, or further applied onto the whole said end portion along the width of the blade, which is prepared by dispersing fluorine based polymer and fluorine based resin powder into a fluorine based solvent.

Cleaning Process Conditions

For example, a cleaning member is constituted as follows:

1) said cleaning member is comprised of two cleaning blades 2) the cleaning blade is adhered onto plastic materials 3) the cleaning blade is adhered onto a metallic member 4) buffer agents are placed between the cleaning member and the specified member Said cleaning member may be constituted in such a manner that a plurality of cleaning blades, capable of being employed in the present invention, is adhered to each other, or may be comprised of only one blade. When two blades are combined as described in 2), it is preferable that the ratio of each free length is regulated so as to satisfy Formula 31, wherein "a" is the free length of one cleaning blade and "b" is that of the other cleaning blade. The free length, as described herein, refers to the length of the part of the cleaning blade which is not secured by a holding member, and specifically refers to the length the cleaning blade from the end of said holding member to the tip of said cleaning blade, prior to deformation.

$$0.1<b/a\leqq 0.9 \qquad \text{Formula 31}$$

By regulating b/a as shown in Formula 31, it is possible to achieve stabilized cleaning properties without hindering the deformation of the tip portion of the cleaning blade while damping the cleaning blade utilizing an elastic member, and also minimizing blade curling as well as insufficient toner removal. Further, b/a is preferably regulated in the range of from 0.3 to 0.8, and is more preferably regulated in the range of from 0.5 to 0.6.

Still further, it is preferable that the ratio of the thickness of the cleaning blade be regulated so as to satisfy Formula 31, wherein t1 is the thickness of one cleaning blade which comes into contact with the photoreceptor, and t2 is the thickness of the other cleaning blade which comes into contact with said photoreceptor.

$$1/30<t2/t1<2 \qquad \text{Formula 32}$$

By regulating t2/tl so as to satisfy Formula 32, it is possible to realize stabilized cleaning properties in which the cleaning blade is securely kept in position by the holding member, in addition, the vibration of the cleaning blade is absorbed by the elastic member, and blade curling as well as insufficient toner removal is minimized. Further, t2/t1 is preferably from ⅛ to 5/4, and is more preferably from ¼ to ¾.

Contact load P of said cleaning blade against the photoreceptor is preferably from 5 to 40 N/m.

It is preferable that in terms of JIS A Hardness, hardness K1 of the cleaning blade which comes into contact with the photoreceptor, as well as hardness K1 of the elastic member be regulated so as to satisfy Formula 33.

$$5/7<K2/K1<10/7 \qquad \text{Formula 33}$$

Namely, by regulating K2/K1 so as to satisfy Formula 33, it is possible to realize stabilized cleaning properties in which the cleaning blade is securely kept in position by the holding member, in addition, the vibration of the cleaning blade is absorbed by the elastic member, and blade curling as well as insufficient toner removal is minimized. Further, K2/K1 is preferably from 11/14 to 8/7, and is more preferably from 13/44 to 15/14.

It is preferable that impact resilience H1 of the cleaning blade which comes into contact with the photoreceptor, and impact resilience H2 of the elastic member be regulated so as to satisfy Formula 34. The impact resilience, as described herein, is an index showing a restitution coefficient which shows the magnitude of rebounding of a colliding or falling body. Specifically, the impact resilience is determined based on Vulcanized Rubber Physical Test Method JIS K6301. The impact resilience is expressed as a percentage. Further said JIS A Hardness is determined based on said Vulcanized Rubber Physical Test JIS K6301.

$$\frac{3}{7} < H2/H1 \leqq 8/7 \quad \text{Formula 34}$$

By regulating H2/H1 so as to satisfy Formula 34, it is possible to realize stabilized cleaning properties in which the cleaning blade is securely kept in position by the holding member, in addition, the vibration of the cleaning blade is absorbed by the elastic member, and blade curling as well as insufficient toner removal is minimized. Further, H2/H1 is preferably from 3/7 to 8/7, and is more preferably from 5/7 to 1.

The hardness of the cleaning blade is preferably in the range of from 55 to 90 in terms of JIS A Hardness at 25+5° C. The Young modulus thereof is preferably in the range of from 294 to 588 N/cm$^2$.

In 2), said cleaning member comprises a cleaning blade and a plastic member, and said cleaning blade comes into close contact with said plastic member on the surface opposite to the surface which comes into contact with the organic photoreceptor. A difference in height is provided between the end of said cleaning blade and the end of said plastic member. Further, said difference in height may be constituted in such a manner that said difference in height is positioned so that said plastic member is located farther from said organic photoreceptor. The constitution preferably satisfies any one of the formulas described below.

$$0.1 < b/a \leqq 0.9 \quad \text{Formula 31}$$

wherein "a" is the free length of the cleaning blade, and "b" is the free length of the plastic member.

$$1/50 < t2/t1 \leqq 1 \quad \text{Formula 32}$$

wherein t1 is the thickness of the cleaning blade, and t2 is the thickness of the plastic member.

$$16 \leqq D2/D1 \leqq 28{,}000 \quad \text{Formula 33}$$

wherein D1 is the elastic modulus of the cleaning blade, and D2 is the elastic modulus of the plastic member.

$$1.4 \leqq H \leqq 35 (H\text{: kgf/mm}^2) \quad \text{Formula 34}$$

wherein H is the tensile strength of the plastic member.

$$0 < M \leqq 41 (M\text{: kgf/mm}^2) \quad \text{Formula 35}$$

wherein M is the bending strength of the plastic member.

Further, in 3), said cleaning member comprises a cleaning blade and a thin metallic plate member, and said cleaning blade is adhered to said thin metallic plate member on the surface opposite to the surface which comes into contact with the organic photoreceptor. Further, it may be constituted in such a manner that each of the free length sections of said cleaning blade and said thin metallic plate member independently possess a free end. The difference in height is provided between the end of said cleaning blade and the end of said thin metallic plate member. Further, said difference in height may be preferably constituted in such a manner that said difference in height is positioned so that said thin metallic plate member is located farther from said organic photoreceptor.

In 4), some part of said cleaning blade and said cleaning blade holding member are joined with each other, in parallel. Further, it may be constituted in such a manner that a damping material is adhered onto either said cleaning blade or said cleaning blade holding member. Preferably employed as viscoelastic materials employed as said damping materials are the following. When a periodic damping characteristic, which is determined to be in the range of from $10^2$ to $10^7$ Hz of the oscillation frequency (temperature (in the range of from 0 to 100° C.) as the parameter) is expressed utilizing a complex number, G2/G1 is termed as η, wherein G1 represents a dynamic shear modulus expressed by the real number portion, and G2 represents a loss coefficient expressed by the imaginary number portion. Viscoelastic materials preferably have a maximum value of η($\eta_{max}$: maximum loss coefficient) in the range of from 0.3 to 2.0, and have more preferably the same in the range of from 0.5 to 1.5. Said viscoelastic materials, having a $\eta_{max}$ in said range, exhibit a large vibration proofing effect. Further, when $\eta_{max}$ is attained, G1 is preferably from $6.9\times10^2$ to $6.9\times10^4$ kpa. Said periodic damping characteristic is measured employing a High Frequency Viscoelasticity Spectrometer VES-HC (manufactured by Iwamoto Seisakusho). It is possible to obtain $\eta_{max}$ from a graph showing the frequency dependence of η.

These damping materials include commercially available products, dampers such as VEM Series manufactured by Sumitomo 3M Limited, LR Series manufactured by Bridgestone Corp., and the like. Other than these, it is possible to prepare damping materials which are subjected to variation of characteristics such as said G1 and $\eta_{max}$, upon combining damping materials.

Further, S1/S2 is preferably in the range of from 0.05 to 12, wherein S1 is the area which is adhered by a damping material, and S2 is the area of the cleaning blade.

The organic photoreceptors of the present invention will now be described.

In the present invention, the electrophotographic organic photoreceptors (hereinafter referred simply to as organic photoreceptors), as described herein, mean electrophotographic photoreceptors which are comprised of organic compounds having at least either a charge generating function or a charge transport function, which are essential to constitute electrophotographic photoreceptors, and include all electrophotographic organic photoreceptors known in the art such as photoreceptors comprised of organic charge generating materials or organic charge transport materials known in the art, photoreceptors in which a charge generating function as well as a charge transport function is exhibited, employing polymer complexes.

The organic photoreceptors employed in the present invention will now be described.

Electrically Conductive Support

Employed as electrically conductive supports may be those which are either in sheet or in cylindrical form. However, in order to make an image forming apparatuses small-sized, an electrically conductive cylindrical support is more preferred.

The electrically conductive cylindrical support as described in the present invention means a cylindrical support which is capable of endlessly forming images through its rotation, and the electrically conductive support is preferred which has a circularity of not more than 0.1 mm and a deviation of not more than 0.1 mm. When said circularity as well said deviation exceeds said limits, it becomes difficult to form consistently excellent images.

Employed as electrically conductive materials may be metal drums comprised of aluminum, nickel, and the like, plastic drums vacuum coated with aluminum, tin oxide, indium oxide, and the like, or paper-plastic drums coated with these kinds of electrically conductive materials. Said electrically conductive supports preferably exhibit a specific resistance of $10^3$ Ωcm or more.

The electrically conductive support employed in the present invention may have an anodized aluminum film on its surface, which is subjected to sealing. An anodized aluminum treatment is generally carried out in an acid bath such as, for example, chromic acid, sulfuric acid, oxalic acid, phosphoric acid, boric acid, sulfamic acid, and the like. Of these, anodic oxidation in sulfuric acid provides the most preferable results. The anodic oxidation in sulfuric acid is preferably carried out under conditions of a sulfuric acid concentration of 100 to 200 g/liter, an aluminum ion concentration of 1 to 10 g/liter, a solution temperature of about 20° C., and an applied voltage of 20 V. However, said conditions are not limited to these cited ones. Further, the average thickness of the resultant anodic oxidation film is generally not more than 20 μm, and is most preferably not more than 10 μm.

Interlayer

In the present invention, it is possible to provide an interlayer having a barrier function between the electrically conductive support and the photosensitive layer.

In the present invention, in order to improve adhesion between the electrically conductive support and said photosensitive layer, or to minimize charge injection from said support, it is possible to provide an interlayer (including a sublayer) between said support and said photosensitive layer. Listed as materials of said support are polyamide resins, vinyl chloride resins, vinyl acetate resins, and copolymer resins comprising at least two repeating units of these resins. Of these subbing resins, polyamide resins are preferable as the resins which are capable of minimizing an increase in residual potential accompanied under repeated use. Further, the thickness of the interlayer comprised of these resins is preferably between 0.01 and 2 μm.

Further, listed as an interlayer, which is most preferably employed, is that comprised of hardenable metal resins which are subjected to thermal hardening employing organic metal compounds such as silane coupling agents, titanium coupling agents, and the like. The thickness of the interlayer comprised of said hardenable metal resins is preferably between 0.1 and 2 μm.

Photosensitive Layer

The photosensitive layer configuration of the photoreceptor of the present invention may be one comprised of a single layer structure on said interlayer, which exhibits a charge generating function as well as a charge transport function. However, a more preferable configuration is that the photosensitive layer is comprised of a charge generating layer (CGL) and a charge transport layer (CTL). By employing said configuration in which the functions are separated, it is possible to control an increase in residual potential, accompanied under repeated use at a low level, and to readily control the other electrophotographic properties to desired values. A negatively charged photoreceptor is preferably composed in such a manner that applied onto the interlayer is the charge generating layer (CGL), onto which the charge transport layer is applied. On the other hand, a positively charge photoreceptor is composed so that the order of the layers employed in the negatively charged photoreceptor is reversed. The most preferable photosensitive layer configuration is the negatively charged photoreceptor configuration having said function separation structure.

The photosensitive layer configuration of a function separated negatively charged photoreceptor is now described.

Charge Generating Layer

The charge generating layer comprises charge generating materials (CGM) . As to other materials, if desired, binder resins and other additives may be incorporated.

Employed as charge generating materials may be those commonly known in the art. For example, employed may be phthalocyanine pigments, azo pigments, perylene pigments, azulenium pigments, and the like. Of these, CGMs, which are capable of minimizing the increase in residual potential, accompanied under repeated use, are those which comprise a three-dimensional electrical potential structure capable of taking stable agglomerated structure between a plurality of molecules. Specifically listed are CGMs of phthalocyanine pigments and perylene pigments having a specific crystal structure. For instance, titanyl phthalocyanine having a maximum peak at 27.2° of Bragg angle 2θ with respect to a Cu-Kα line, benzimidazole perylene having a maximum peak at 12.4° of said Bragg 2θ, and the like, result in minimum degradation under repeated use and can minimize the increase in residual potential.

When in the charge generating layer, binders are employed as the dispersion media of CGM, employed as binders may be any of the resins known in the art. Listed as the most preferable resins are formal resins, butyral resins, silicone resins, silicone modified butyral resins, phenoxy resins, and the like. The ratio of binder resins to charge generating materials is preferably between 20 and 600 weight parts per 100 weight parts of the binder resins. By employing these resins, it is possible to minimize the increase in residual potential under repeated use. The thickness of the charge generating layer is preferably between 0.01 and 2 μm.

Charge Transport Layer

The charge transport layer comprises charge transport materials (CTM) as well as binders which disperse CTM and form a film. As to other materials, if desired, also incorporated may be additives such as antioxidants and the like.

Employed as charge transfer materials (CTM) may be any of those known in the art. For example, it is possible to employ triphenylamine derivatives, hydrazone compounds, styryl compounds, benzidine compounds, butadiene compounds, and the like. These charge transport materials are commonly dissolved in appropriate binder resins and are then subjected to film formation. Of these, CTMs, which are capable of minimizing the increase in residual potential under repeated use, are those which exhibit properties such as high mobility as well as an ionization potential difference of not more than 0.5 eV, and preferably not more than 0.25 eV from a combined CGM.

The ionization potential of CGM and CTM is measured employing a Surface Analyzer AC-1 (manufactured by Riken Keiki Co.).

Cited as resins employed in the charge transport layer (CTL) are, for example, polystyrene, acrylic resins, methacrylic resins, vinyl chloride resins, vinyl acetate resins, polyvinyl butyral resins, epoxy resins, polyurethane resins, phenol resins, polyester resins, alkyd resins, polycarbonate resins, silicone resins, melamine resins, and copolymers comprising at least two repeating units of these resins, and other than these insulating resins, high molecular organic semiconductors, such as poly-N-vinylcarbazole.

The most preferable as CTL binders are polycarbonate resins. Polycarbonate resins are most preferred because the dispersibility of CTM as well as electrophotographic properties is improved. In the case of the photoreceptor in which the charge transport layer is employed as the surface layer, polycarbonates which exhibit high mechanical wear resistance are preferred and polycarbonates having an viscosic average molecular weight of 20,000 to 200,000 are also preferable. The ratio of binder resins to charge transport materials is preferably between 10 and 200 weight parts per 100 weight parts of the binder resins. Further, the thickness of the charge transport layer is preferably between 10 and 40 $\mu$m.

Protective Layer

Provided as protective layers of a photoreceptor may be various types of resinous layers. Specifically, it is possible to obtain the photoreceptor having high mechanical strength of the present invention by providing a cross linked resinous layer.

Listed as solvents or dispersion media which are employed to form layers such as photosensitive layers, protective layers, and the like, are n-butylamine, diethylamine, isopropanolamine, triethanolamine, triethylenediamine, N,N-dimethylformamide, acetone, methyl ethyl ketone, methyl isopropyl ketone, cyclohexanone, benzene, toluene, xylene, chloroform, dichloromethane, 1,2-dicholorethane, 1,2-dichloropropane, 1,1,2-trichloroethane, 1,1,1-trichloroethane, trichloroethylene, tetrachloroethane, tetrahydrofuran, dioxysolan, dioxane, methanol, ethanol, butanol, isopropanol, ethyl acetate, butyl acetate, dimethyl sulfoxide, methyl cellosolve, and the like. However, the present invention is not limited to these examples, and also preferably employed are dichloromethane, 1,2-dicholorethane, methyl ethyl ketone, and the like. Further, these solvents may be employed individually or in combination as a solvent mixture of two or more types.

Employed as coating methods to produce electrophotographic organic photoreceptors of the present invention are dip coating, spray coating, circular amount regulating type coating, and the like. When an upper layer is applied onto the photosensitive layer, preferably employed coating methods such as spray coating or circular amount-regulating type coating (including a circular slide hopper type as its representative example) and the like so that the dissolution of the lower layer is minimized and uniform coating is achieved. Incidentally, the protective layer of the present invention is most preferably applied employing said circular amount-regulating type coating method. Said circular amount-regulating type coating is detailed in, for example, Japanese Patent Publication Open to Public Inspection No. 58-189061.

Described next will be the toner which is employed in the present invention.

Preferred as the toner of the present invention is a polymerized toner in which the size distribution of individual toner particles as well as their shape is relatively uniform. The polymerized toner as described herein means a toner obtained in such a manner that binder resins for the toner as well the shape of toner particles are formed by polymerization of monomers as the raw materials of the binder resins followed by chemical treatment. More specifically, said polymerized toner means the toner which is obtained by polymerization such as suspension polymerization, emulsion polymerization and the like, if desired, followed by a fusing process among particles which is carried out after said polymerization.

Preferred as the polymerized toner which is employed in the cleaning unit employing the blade member of the present invention is one having a specific shape of toner particles. The polymerized toner, which may preferably be employed in the present invention, will be described below.

The polymerized toner, which is preferably employed in the present invention, has a number ratio of toner particles having a shape coefficient of 1.2 to 1.6 and is at least 65 percent, and further the variation coefficient of said shape coefficient is not more than 16 percent. In the present invention, it has been discovered that even though such a polymerized toner is employed, it is possible to stabilize the vibration of the first blade member, and excellent cleaning performance is exhibited.

Further, the stability of the vibration of the first blade member is dependent on the diameter of toner particles. As the diameter of particles decrease, adhesion of toner particles to the image bearing body increases. As a result, the resultant vibration tends to become excessive, and toner particles are more likely not to be removed by the first blade member. On the other hand, toner particles, having a larger diameter, are more readily removed by the first blade member. However, problems occur in which image quality such as resolution, and the like, is degraded.

Investigation was carried out based on the aforementioned viewpoints. As a result, it has been discovered that by employing a toner having a variation coefficient of the toner shape coefficient of not more than 16 percent, as well as having a number variation coefficient in the toner number size distribution of not more than 27 percent, high image quality, which is exhibited by excellent cleaning properties, as well as excellent fine line reproduction, can be obtained over an extended period of time.

Further, by employing a toner in which the number ratio of toner particles, having no corners, is set at 50 percent and the number variation coefficient in the number size distribution is adjusted to not more than 27 percent, it is possible to obtain high image quality over an extended time of period, which exhibits excellent cleaning properties, as well as excellent fine line reproduction.

The shape coefficient of the toner particles of the present invention is expressed by the formula described below and represents the roundness of toner particles.

$$\text{Shape coefficient}=[(\text{maximum diameter}/2)^2\times\pi]/\text{projection area}$$

wherein the maximum diameter means the maximum width of a toner particle obtained by forming two parallel lines between the projection image of said particle on a plane, while the projection area means the area of the projected image of said toner on a plane.

In the present invention, said shape coefficient was determined in such a manner that toner particles were photographed under a magnification factor of 2,000, employing a scanning type electron microscope, and the resultant photographs were analyzed employing "Scanning Image Analyzer", manufactured by Nihon Denshi Co. At that time, 100 toner particles were employed and the shape coefficient of the present invention was obtained employing the aforementioned calculation formula.

The polymerized toner of the present invention is that the number ratio of toner particles in the range of said shape coefficient of 1.2 to 1.6 is preferably at least 65 percent and is more preferably at least 70 percent by number.

By adjusting the number ratio of toner particles in the range of a shape coefficient of 1.2 to 1.6 to at least 65 percent, the triboelectrical properties become more uniform on the developer conveying member resulting in no accumulation of excessively charged toner particles, and said toner particles are more readily replaced from the surface of said developer conveying member to minimize the generation of problems such as development ghost and the like. Further, the toner particles tend not to be crushed, resulting in decreased staining on the charge providing member and chargeability of the toner is stabilized.

Methods to control said shape coefficient are not particularly limited. For example, a method may be employed wherein a toner, in which the shape coefficient has been adjusted to the range of 1.2 to 1.6, is prepared employing a method in which toner particles are sprayed into a heated air current, a method in which toner particles are subjected to application of repeated mechanical forces employing impact in a gas phase, or a method in which a toner is added to a solvent which does not dissolve said toner and is then subjected to application of a revolving current, and the resultant toner is blended with a toner to obtain suitable characteristics. Further, another preparation method may be employed in which, during the stage of preparing a so-called polymerization method toner, the entire shape is controlled and the toner, in which the shape coefficient has been adjusted to 1.0 to 1.6 or 1.2 to 1.6, is blended with a common toner.

Of methods to control the shape coefficient, the polymerized toner method is preferable since it is simple as well as convenient as a toner production method, the surface uniformity is excellent compared to pulverized toner, and the like.

It is possible to prepare the toner of the present invention in such a manner that fine polymerized particles are produced employing a suspension polymerizing method, and emulsion polymerization of monomers in a liquid added with an emulsion of necessary additives is carried out, and thereafter, association is carried out by adding organic solvents, coagulants, and the like. Methods are listed in which during association, preparation is carried out by associating upon mixing dispersions of releasing agents, colorants, and the like which are required for constituting a toner, a method in which emulsion polymerization is carried out upon dispersing toner constituting components such as releasing agents, colorants, and the like in monomers, and the like. Association as described herein means that a plurality of resinous particles and colorant particles are fused.

Incidentally, the water based medium as described in the present invention means one in which at least 50 percent, by weight of water, is incorporated.

Namely, added to the polymerizable monomers are colorants, and if desired, releasing agent, charge control agents, and further, various types of components such as polymerization initiators, and in addition, various components are dissolved in or dispersed into the polymerizable monomers employing a homogenizer, a sand mill, a sand grinder, an ultrasonic homogenizer, and the like. The polymerizable monomers in which various components have been dissolved or dispersed are dispersed into a water based medium to obtain oil droplets having the desired size of a toner, employing a homomixer, a homogenizer, and the like. Thereafter, the resultant dispersion is conveyed to a reaction apparatus which utilizes stirring blades described below as the stirring mechanism and undergoes polymerization reaction upon heating. After completing the reaction, the dispersion stabilizers are removed, filtered, washed, and subsequently dried. In this manner, the toner of the present invention is prepared.

Further, listed as a method for preparing said toner may be one in which resinous particles are associated, or fused, in a water based medium. Said method is not particularly limited but it is possible to list, for example, methods described in Japanese Patent Publication Open to Public Inspection Nos. 5-265252, 6-329947, and 9-15904. Namely, it is possible to form the toner of the present invention by employing a method in which at least two of the dispersion particles of components such as resinous particles, colorants, and the like, or fine particles, comprised of resins, colorants, and the like, are associated, specifically in such a manner that after dispersing these in water employing emulsifying agents, the resultant dispersion is salted out by adding coagulants having a concentration of at least the critical coagulating concentration, and simultaneously the formed polymer itself is heat-fused at a temperature higher than the glass transition temperature, and then while forming said fused particles, the particle diameter is allowed gradually to grow; when the particle diameter reaches the desired value, particle growth is stopped by adding a relatively large amount of water; the resultant particle surface is smoothed while being further heated and stirred, to control the shape and the resultant particles which incorporate water, is again heated and dried in a fluid state. Further, herein, organic solvents, which are infinitely soluble in water, may be simultaneously added together with said coagulants.

Those which are employed as polymerizable monomers to constitute resins include styrene and derivatives thereof such as styrene, o-methylstyrene, m-methylstyrene, p-methylstyrene, α-methylstyrene, p-chlorostyrene, 3,4-dichlorostyrene, p-phenylstyrene, p-ethylstryene, 2,4-dimethylstyrene, p-tert-butylstyrene, p-n-hexylstyrene, p-n-octylstyrene, p-n-nonylstyrene, p-n-decylstyrene, p-n-dodecylstyrene; methacrylic acid ester derivatives such as methyl methacrylate, ethyl methacrylate, n-butyl methacrylate, isopropyl methacrylate, isobutyl methacrylate, t-butyl methacrylate, n-octyl methacrylate, 2-ethyl methacrylate, stearyl methacrylate, lauryl methacrylate, phenyl methacrylate, diethylaminoethyl methacrylate, dimethylaminoethyl methacrylate; acrylic acid esters and derivatives thereof such as methyl acrylate, ethyl acrylate, isopropyl acrylate, n-butyl acrylate, t-butylacrylate, isobutyl acrylate, n-octyl acrylate, 2-ethylhexyl acrylate, stearyl acrylate, lauryl acrylate, phenyl acrylate, and the like; olefins such as ethylene, propylene, isobutylene, and the like; halogen based vinyls such as vinyl chloride, vinylidene chloride, vinyl bromide, vinyl fluoride, vinylidene fluoride, and the like; vinyl esters such as vinyl propionate, vinyl acetate, vinyl benzoate, and the like; vinyl ethers such as vinyl methyl ether, vinyl ethyl ether, and the like; vinyl ketones such as vinyl methyl ketone, vinyl ethyl ketone, vinyl hexyl ketone, and the like; N-vinyl compounds such as N-vinylcarbazole, N-vinylindole, N-vinylpyrrolidone, and the like; vinyl compounds such as vinylnaphthalene, vinylpyridine, and the like; as well as derivatives of acrylic acid or methacrylic acid such as acrylonitrile, methacrylonitrile, acryl amide, and the like. These vinyl based monomers may be employed individually or in combinations.

Further preferably employed as polymerizable monomers, which constitute said resins, are those having an ionic dissociating group in combination, and include, for instance, those having substituents such as a carboxyl group, a sulfonic acid group, a phosphoric acid group, and the like as the constituting group of the monomers. Specifically listed are acrylic acid, methacrylic acid, maleic acid, itaconic acid, cinnamic acid, fumaric acid, maleic acid monoalkyl ester, itaconic acid monoalkyl ester, styrenesulfonic acid, allylsulfosuccinic acid, 2-acrylamido-2-methylpropanesulfonic acid, acid phosphoxyethyl methacrylate, 3-chloro-2-acid phosphoxyethyl methacrylate, 3-chlor-2-acid phosphoxypropyl methacrylate, and the like.

Further, it is possible to prepare resins having a bridge structure, employing polyfunctional vinyls such as divinylbenzene, ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol methacrylate, neopentyl glycol diacrylate, and the like.

It is possible to polymerize these polymerizable monomers employing radical polymerization initiators. In such a case, it is possible to employ oil-soluble polymerization initiators when a suspension polymerization method is carried out. Listed as these oil-soluble polymerization initiators may be azo based or diazo based polymerization initiators such as 2,2'-azobis-(2,4-dimethylvaleronitrile), 2,2'-azobisisobutyronitrile, 1,1'-azobiscyclohexanone-1-carbonitrile), 2,2'-azobis-4-methoxy-2,4-dimethylvaleronitrile, azobisisobutyronitrile, and the like; peroxide based polymerization initiators such as benzoyl peroxide, methyl ethyl ketone peroxide, diisopropyl peroxycarbonate, cumene hydroperoxide, t-butyl hydroperoxide, di-t-butyl peroxide, dicumyl peroxide, 2,4-dichlorobenzoyl peroxide, lauroyl peroxide, 2,2-bis-(4,4-t-butylperoxycyclohexane) propane, tris-(t-butylperoxy) triazine, and the like; polymer initiators having a peroxide in the side chain; and the like.

Further, when such an emulsion polymerization method is employed, it is possible to use water-soluble radical polymerization initiators. Listed as such water-soluble polymerization initiators may be persulfate salts, such as potassium persulfate, ammonium persulfate, and the like, azobisaminodipropane acetate salts, azobiscyanovaleric acid and salts thereof, hydrogen peroxide, and the like.

Cited as dispersion stabilizers may be tricalcium phosphate, magnesium phosphate, zinc phosphate, aluminum phosphate, calcium carbonate, magnesium carbonate, calcium hydroxide, magnesium hydroxide, aluminum hydroxide, calcium metasilicate, calcium sulfate, barium sulfate, bentonite, silica, alumina, and the like. Further, as dispersion stabilizers, it is possible to use polyvinyl alcohol, gelatin, methyl cellulose, sodium dodecylbenzene sulfonate, ethylene oxide addition products, and compounds which are commonly employed as surface active agents such as sodium higher alcohol sulfate.

In the present invention, preferred as excellent resins are those having a glass transition point of 20 to 90° C. as well as a softening point of 80 to 220° C. Said glass transition point is measured employing a differential thermal analysis method, while said softening point can be measured employing an elevated type flow tester. Preferred as these resins are those having a number average molecular weight (Mn) of 1,000 to 100,000, and a weight average molecular weight (Mw) of 2,000 to 100,000, which can be measured employing gel permeation chromatography. Further preferred as resins are those having a molecular weight distribution of Mw/Mn of 1.5 to 100, and is most preferably between 1.8 and 70.

Employed coagulants are not particularly limited, but those selected from metal salts are more suitable. Specifically, listed as univalent metal salts are salts of alkaline metals such as, for example, sodium, potassium, lithium, and the like; listed as bivalent metal salts are salts of alkali earth metals such as, for example, calcium, magnesium, and salts of manganese, copper, and the like; and listed as trivalent metal salts are salts of iron, aluminum, and the like. Listed as specific salts may be sodium chloride, potassium chloride, lithium chloride, calcium chloride, zinc chloride, copper sulfate, magnesium sulfate, manganese sulfate, and the like. These may also be employed in combination.

These coagulants are preferably added in an amount higher than the critical coagulation concentration. The critical coagulation concentration as described herein means an index regarding the stability of water based dispersion and concentration at which coagulation occurs through the addition of coagulants. Said critical coagulation concentration markedly varies depending on emulsified components as well as the dispersing agents themselves. Said critical coagulation concentration is described in, for example, Seizo Okamura, et al., "Kobunshi Kagaku (Polymer Chemistry) 17", 601 (1960) edited by Kobunshi Gakkai, and others. Based on said publication, it is possible to obtain detailed critical coagulation concentration. Further, as another method, a specified salt is added to a targeted particle dispersion while varying the concentration of said salt; the $\zeta$ potential of the resultant dispersion is measured, and the critical coagulation concentration is also obtained as the concentration at which said $\zeta$ potential varies.

The acceptable amount of the coagulating agents of the present invention is an amount of more than the critical coagulation concentration. However, said added amount is preferably at least 1.2 times as much as the critical coagulation concentration, and is more preferably 1.5 times.

The solvents, which are infinitely soluble as described herein, mean those which are infinitely soluble in water, and in the present invention, such solvents are selected which do not dissolve the formed resins. Specifically, listed may be alcohols such as methanol, ethanol, propanol, isopropanol, t-butanol, methoxyethanol, butoxyethanol, and the like. Ethanol, propanol, and isopropanol are particularly preferred.

The added amount of infinitely soluble solvents is preferably between 1 and 100 percent by volume with respect to the polymer containing dispersion to which coagulants are added.

Incidentally, in order to make the shape of particles uniform, it is preferable that colored particles are prepared, and after filtration, the resultant slurry, containing water in an amount of 10 percent by weight with respect to said particles, is subjected to fluid drying. At that time, those having a polar group in the polymer are particularly preferable. For this reason, it is assumed that since existing water somewhat exhibits swelling effects, the uniform shape particularly tends to be made.

The toner of the present invention is comprised of at least resins and colorants. However, if desired, said toner may be comprised of releasing agents, which are fixability improving agents, charge control agents, and the like. Further, said toner may be one to which external additives, comprised of fine inorganic particles, fine organic particles, and the like, are added.

Optionally employed as colorants, which are used in the present invention, are carbon black, magnetic materials, dyes, pigments, and the like. Employed as carbon blacks are channel black, furnace black, acetylene black, thermal black, lamp black, and the like. Employed as ferromagnetic materials may be ferromagnetic metals such as iron, nickel, cobalt, and the like, alloys comprising these metals, compounds of ferromagnetic metals such as ferrite, magnetite, and the like, alloys which comprise no ferromagnetic metals but exhibit ferromagnetism upon being thermally treated such as, for example, Heusler's alloy such as manganese-copper-aluminum, manganese-copper-tin, and the like, and chromium dioxide, and the like.

Employed as dyes may be C.I. Solvent Red 1, the same 49, the same 52, the same 63, the same 111, the same 122, C.I. Solvent Yellow 19, the same 44, the same 77, the same 79, the same 81, the same 82, the same 93, the same 98, the same 103, the same 104, the same 112, the same 162, C.I. Solvent Blue 25, the same 36, the same 60, the same 70, the same 93, the same 95, and the like, and further mixtures thereof may also be employed. Employed as pigments may be C.I. Pigment Red 5, the same 48 : 1, the same 53 : 1, the same 57 : 1, the same 122, the same 139, the same 144, the same 149, the same 166, the same 177, the same 178, the same 222, C.I. Pigment Orange 31, the same 43, C.I. Pigment Yellow 14, the same 17, the same 93, the same 94, the same 138, C.I. Pigment Green 7, C.I. Pigment Blue 15 : 3, the same 60, and the like, and mixtures thereof may be employed. The number average primary particle diameter varies widely depending on their types, but is preferably between about 10 and about 200 nm.

Employed as methods for adding colorants may be those in which polymers are colored during the stage in which polymer particles prepared employing the emulsification method are coagulated by addition of coagulants, in which colored particles are prepared in such a manner that during the stage of polymerizing monomers, colorants are added and the resultant mixture undergoes polymerization, and the like. Further, when colorants are added during the polymer preparing stage, it is preferable that colorants of which surface has been subjected to treatment employing coupling agents, and the like, so that radical polymerization is not hindered.

Further, added as fixability improving agents may be low molecular weight polypropylene (having a number average molecular weight of 1,500 to 9,000), low molecular weight polyethylene, and the like.

Employed as charge control agents may also be various types of those which are known in the art and can be dispersed in water. Specifically listed are nigrosine based dyes, metal salts of naphthenic acid or higher fatty acids, alkoxylated amines, quaternary ammonium salts, azo based metal complexes, salicylic acid metal salts or metal complexes thereof.

Incidentally, it is preferable that the number average primary particle diameter of particles of said charge control agents as well as said fixability improving agents is adjusted to about 10 to about 500 nm in the dispersed state.

In toners prepared employing a suspension polymerization method in such a manner that toner components such as colorants, and the like, are dispersed into, or dissolved in, so-called polymerizable monomers, the resultant mixture is suspended into a water based medium; and when the resultant suspension undergoes polymerization, it is possible to control the shape of toner particles by controlling the flow of said medium in the reaction vessel. Namely, when toner particles, which have a shape coefficient of at least 1.2, are formed at a higher ratio, employed as the flow of the medium in the reaction vessel, is a turbulent flow. Subsequently, oil droplets in the water based medium in a suspension state gradually undergo polymerization. When the polymerized oil droplets become soft particles, the coagulation of particles is promoted through collision and particles having an undefined shape are obtained. On the other hand, when toner particles, which have a shape coefficient of not more than 1.2, are formed, employed as the flow of the medium in the reaction vessel is a laminar flow. Spherical particles are obtained by minimizing collisions among said particles. By employing said methods, it is possible to control the distribution of shaped toner particles within the range of the present invention. Reaction apparatuses, which are preferably employed in the present invention, will now be described.

Figure 5:
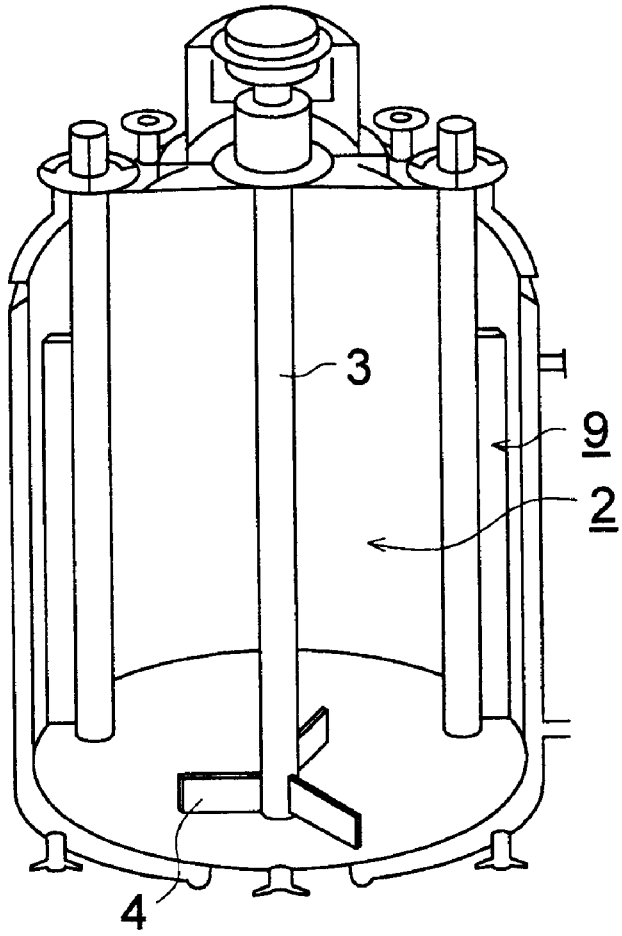
FIG. 5 is a view showing the reaction apparatus in which the stirring blades are constituted at only one level.

FIG. 5 is an explanatory view showing a commonly employed reaction apparatus (a stirring apparatus) in which stirring blades are installed at one level, wherein reference numeral 2 is a stirring tank, 3 is a rotation shaft, 4 are stirring blades, and 9 is a turbulent flow inducing member.

In the suspension polymerization method, it is possible to form a turbulent flow employing specified stirring blades and to readily control the resultant shape of particles. The reason for this phenomenon is not clearly understood. When the stirring blades 4 are positioned at one level, as shown in FIG. 5, the medium in stirring tank 2 flows only from the bottom part to the upper part along the wall. Due to that, a conventional turbulent flow is commonly formed and stirring efficiency is enhanced by installing turbulent flow forming member 9 on the wall surface of stirring tank 2. Though in said stirring apparatus, the turbulent flow is locally formed, the presence of the formed turbulent flow tends to retard the flow of the medium. As a result, shearing against particles decreases to make it almost impossible to control the shape of particles.

Reaction apparatuses provided with stirring blades, which are preferably employed in a suspension polymerization method, will be described with reference to the drawings.

Figure 6:
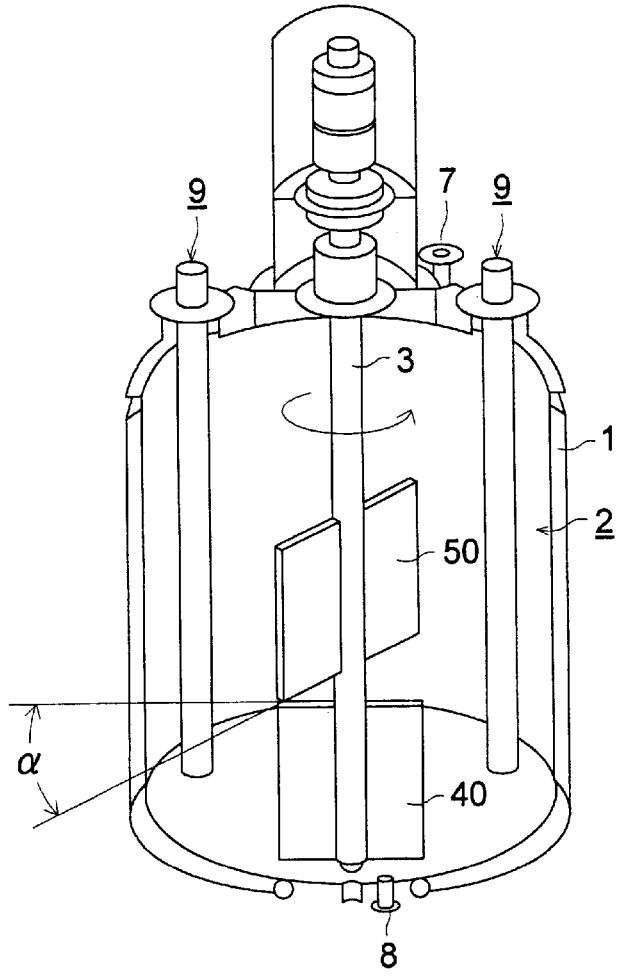
FIG. 6 is a perspective view showing one example of a reaction apparatus equipped with preferably utilized blades.
Figure 7:
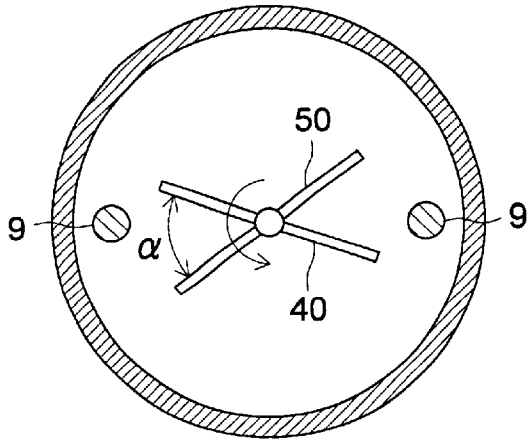
FIG. 7 is a cross-sectional view of the reaction apparatus shown in FIG. 6.

FIGS. 6 and 7 are a perspective view and a cross-sectional view, of the reaction apparatus described above, respectively. In the reaction apparatus illustrated in FIGS. 6 and 7, rotating shaft 3 is installed vertically at the center in vertical type cylindrical stirring tank 2 of which exterior circumference is equipped with a heat exchange jacket, and said rotating shaft 3 is provided with lower level stirring blades 40 installed near the bottom surface of said stirring tank 40 and upper level stirring blade 50. The upper level stirring blades 50 are arranged with respect to the lower level stirring blade so as to have a crossed axis angle $\alpha$ advanced in the rotation direction. When the toner of the presents invention is prepared, said crossed axis angle $\alpha$ is preferably less than 90 degrees. The lower limit of said crossed axis angle $\alpha$ is not particularly limited, but it is preferably at least about 5 degrees, and is more preferably at least 10 degrees. Incidentally, when stirring blades are constituted at three levels, the crossed axis angle between adjacent blades is preferably less than 90 degrees.

By employing the constitution as described above, it is assumed that, firstly, a medium is stirred employing stirring blades 50 provided at the upper level, and a downward flow is formed. It is also assumed that subsequently, the downward flow formed by upper level stirring blades 50 is accelerated by stirring blades 40 installed at a lower level, and another flow is simultaneously formed by said stirring blades 50 themselves, as a whole, accelerating the flow. As a result, it is further assumed that since a flow area is formed which has large shearing stress in the turbulent flow, it is possible to control the shape of the resultant toner.

Incidentally, in FIGS. 6 and 7, arrows show the rotation direction, reference numeral 7 is upper material charging inlet, 8 is a lower material charging inlet, and 9 is a turbulent flow forming member which makes stirring more effective.

Figure 14:
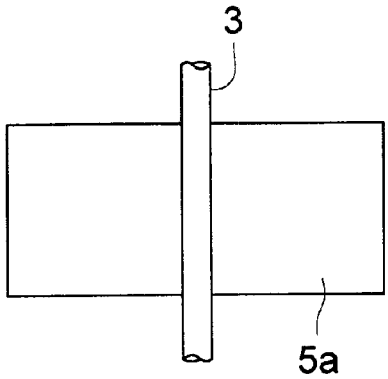
FIG. 14 is a schematic view showing the specific blade shape examples.
Figure 14:
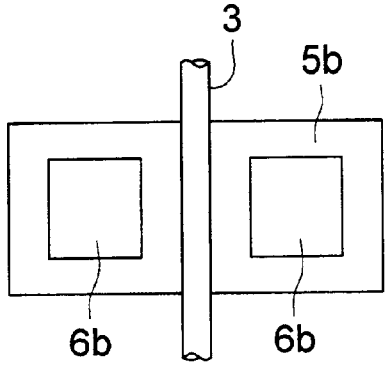
Figure 14:
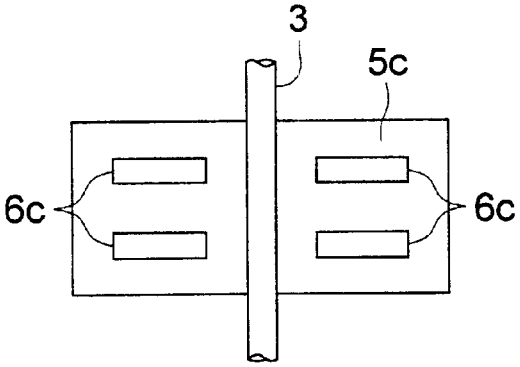
Figure 14:
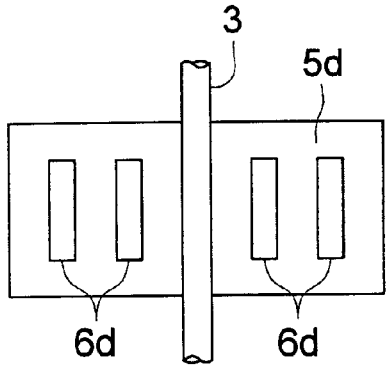

Herein, the shape of the stirring blades is not particularly limited, but employed may be those which are in square plate shape, blades in which a part of them is cut off, blades having at least one opening in the central area, having a so-called slit, and the like. FIGS. 14(*a*) to 14(*d*) describe specific examples of the shape of said blades. Stirring blade 5*a* shown in FIG. 14(*a*) has no central opening; stirring blade 5*b* shown in FIG. 14(*b*) has large central opening areas 6*b*; stirring blade 5*c* shown in FIG. 14(*c*) has rectangular openings 6*c* (slits); and stirring blade 5*d* shown in FIG. 14(*d*) has oblong openings 6*d* shown in FIG. 14(*d*). Further, when stirring blades of a three-level configuration are installed, openings which are formed at the upper level stirring blade and the openings which are installed in the lower level may be different or the same.

FIGS. 8 through 12 each show a perspective view of a specific example of a reaction apparatus equipped with stirring blades which may be preferably employed. In FIGS. 8 through 12, reference numeral 1 is a heat exchange jacket, 2 is a stirring tank, 3 is a rotation shaft, 7 is an upper material charging inlet, 8 is a lower material charging inlet, and 9 is a turbulent flow forming member.

Figure 8:
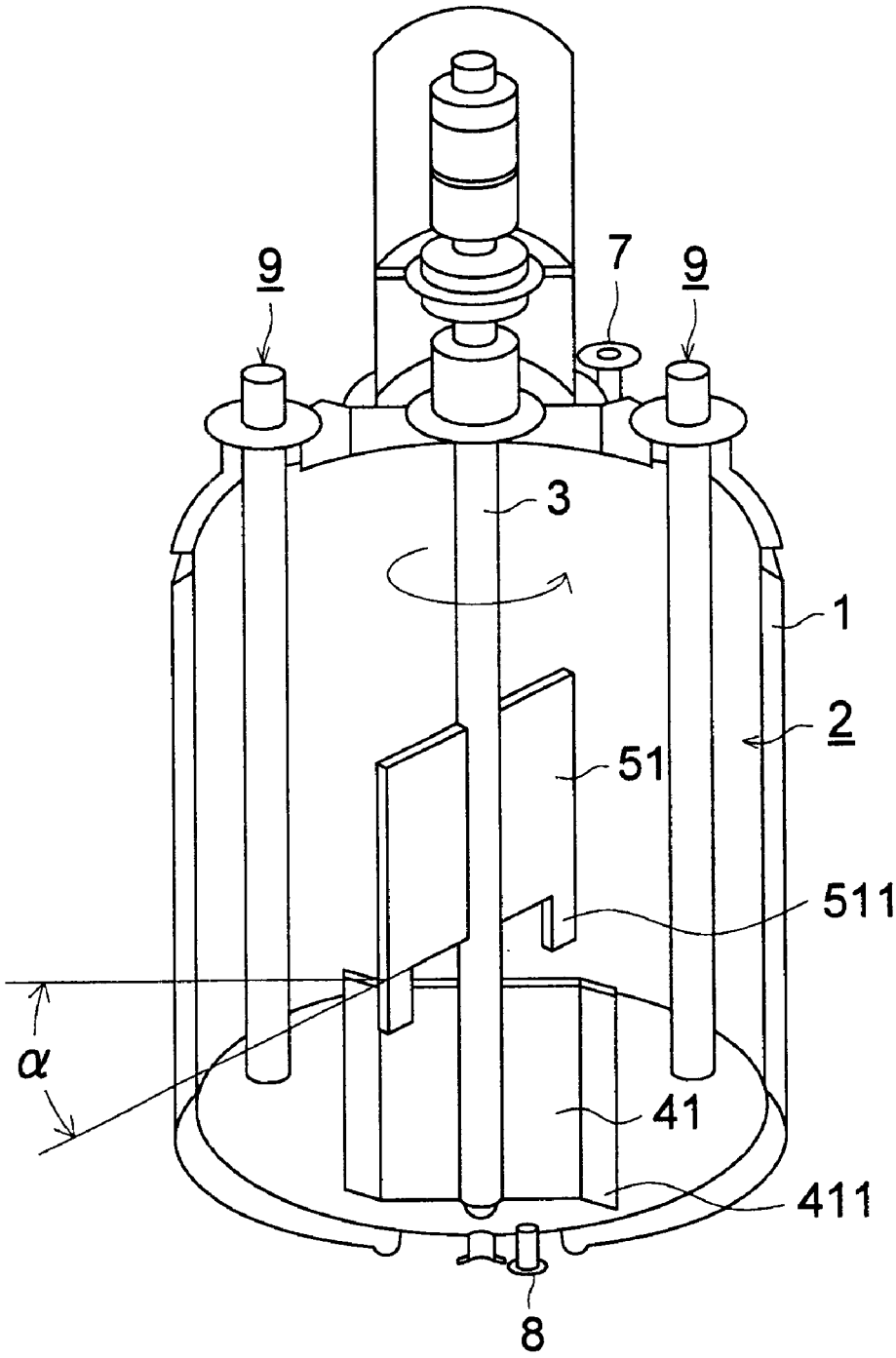
FIG. 8 is a perspective view showing the specific example of a reaction apparatus equipped with preferably utilized stirring blades.

In the reaction apparatus shown in FIG. 8, folded parts 411 are formed on stirring blade 42 and fins 511 (projections) are formed on stirring blade 51.

Further, when said folded sections are formed, the folded angle is preferably between 5 and 45 degrees.

Figure 9:
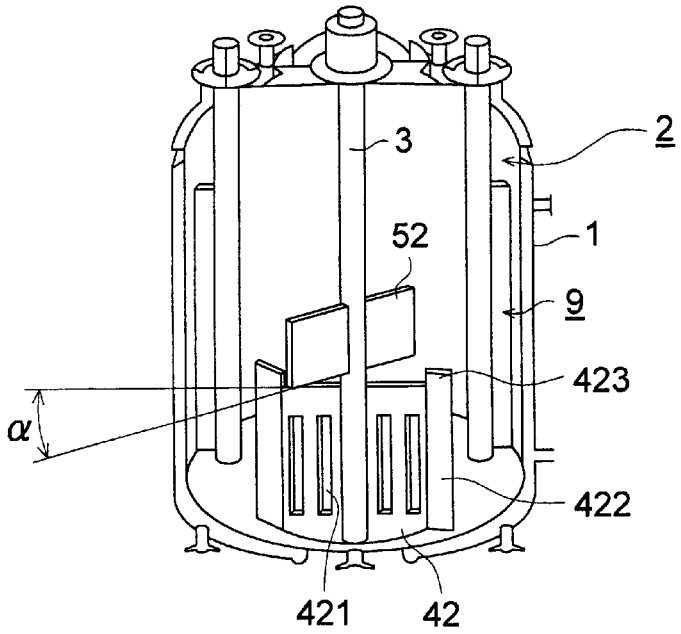
FIG. 9 is a perspective view showing the specific example of a reaction apparatus equipped with preferably utilized stirring blades.

In stirring blade 42 which constitutes the reaction apparatus shown in FIG. 9, slits 142, folded sections 422, and fins 423 are formed simultaneously.

Further, stirring blade 52, which constitute part of the reaction apparatus, has the same shape as stirring blade 50 which constitutes part of the reaction apparatus shown in FIG. 6.

Figure 10:
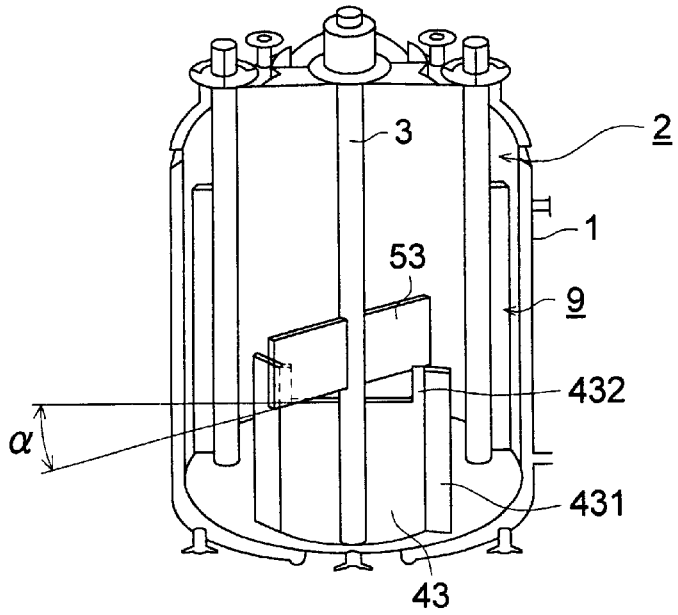
FIG. 10 is a perspective view showing the specific example of a reaction apparatus equipped with preferably utilized stirring blades.

In stirring blade 43 which constitutes part of the reaction apparatus shown in FIG. 10, folded section 431 as well as fin 432 is formed.

Further, stirring blade 53, which constitutes part of said reaction apparatus, has the same shape as stirring blade 50 which constitutes part of the reaction apparatus shown in FIG. 6.

Figure 11:
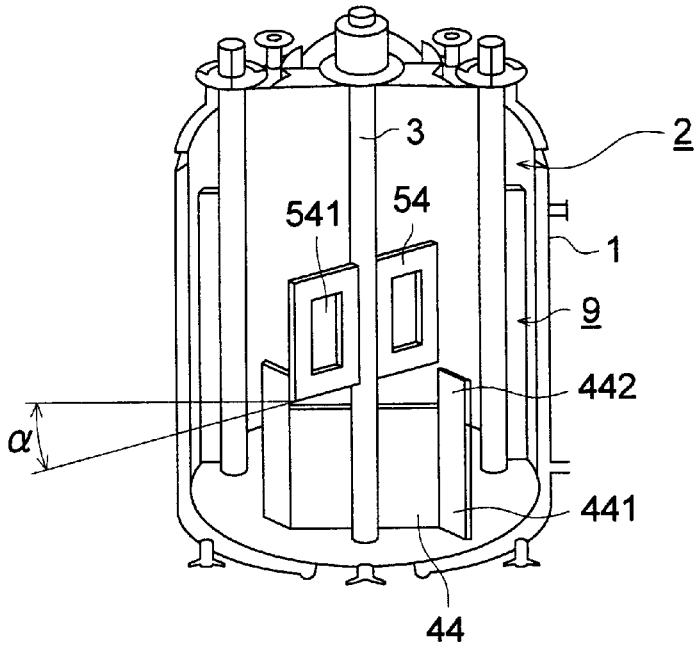
FIG. 11 is a perspective view showing the specific example of a reaction apparatus equipped with preferably utilized stirring blades.

In stirring blade 44 which constitutes part of the reaction apparatus shown in FIG. 11, folded section 441 as well as fin 442 is formed.

Further, in the stirring blade 54 which constitutes part of said reaction apparatus, openings 541 are formed in the center of the blade.

Figure 12:
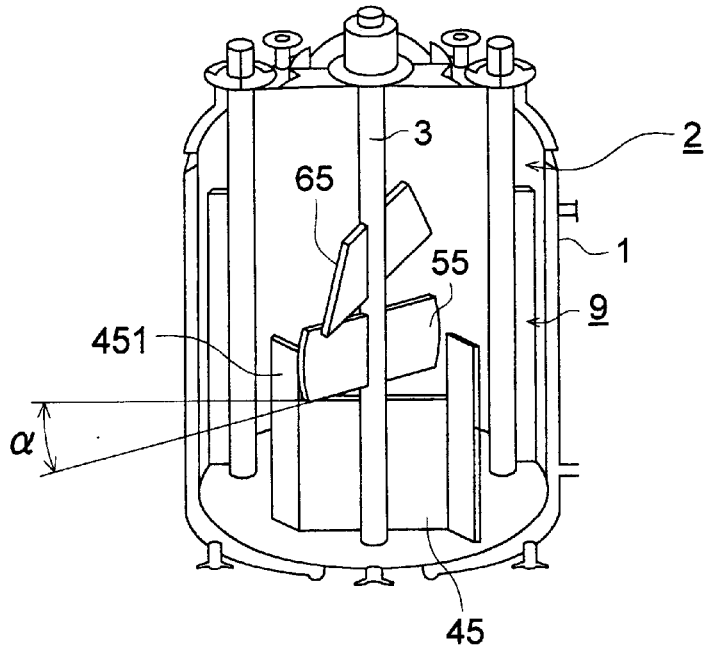
FIG. 12 is a perspective view showing the specific example of a reaction apparatus equipped with preferably utilized stirring blades.

In the reaction apparatus shown in FIG. 12, provided are stirring blades at three-level comprised of stirring blade 45 (at the lower level), stirring blade 55 (at the middle level), and stirring blades 65 at the top are provided.

Stirring blades having such folded sections, stirring blades which have upward and downward projections (fins), all generate an effective turbulent flow.

Still further, the space between the upper and the lower stirring blades is not particularly limited, but it is preferable that such a space is provided between stirring blades. The specific reason is not clearly understood. It is assumed that a flow of the medium is formed through said space, and the stirring efficiency is improved. However, the space is generally in the range of 0.5 to 50 percent with respect to the height of the liquid surface in a stationary state, and is preferably in the range of 1 to 30 percent.

Further, the size of the stirring blade is not particularly limited, but the sum height of all stirring blades is between 50 and 100 percent with respect to the liquid height in the stationary state, and is preferably between 60 and 95 percent.

Figure 13:
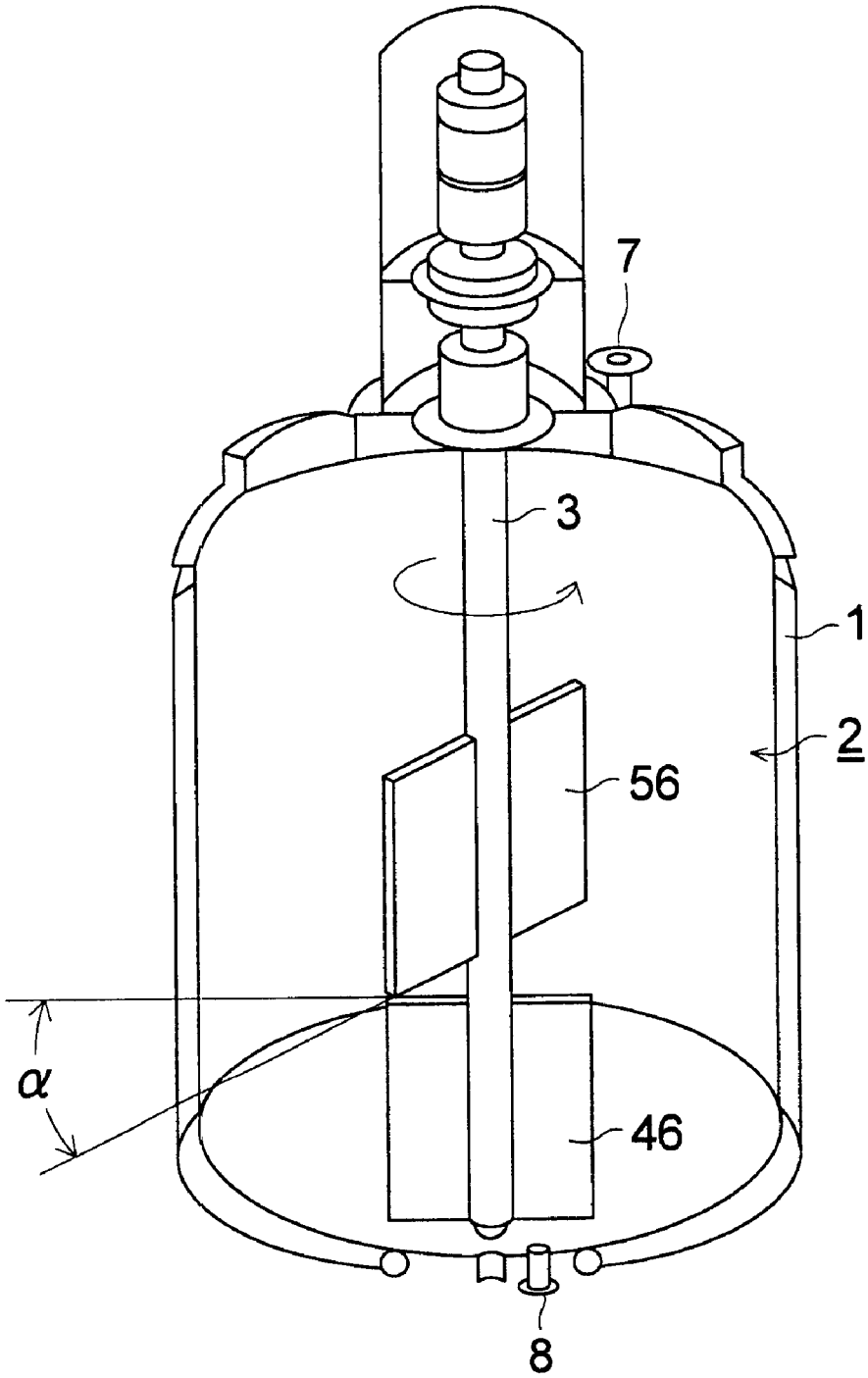
FIG. 13 is a perspective view showing one example of a reaction apparatus which is employed when a laminar flow is formed.

Still further, FIG. 13 shows one example of a reaction apparatus employed when a laminar flow is formed in the suspension polymerization method. Said reaction apparatus is characterized in that no turbulent flow forming member (obstacles such as a baffle plate and the like) is provided.

Stirring blade 46, as well as stirring blade 56, has the same shape as well as the crossed axis angle of stirring blade 40, as well as stirring blade 50 which constitutes part of the reaction apparatus shown in FIG. 6. In FIG. 13, reference numeral 1 is a heat exchange jacket, 2 is a stirring tank, 3 is a rotation shaft, 7 is an upper material charging inlet, and 8 is a lower material charging inlet.

Incidentally, apparatuses, which are employed to form a laminar flow, are not limited to ones shown in FIG. 13.

Further, the shape of stirring blades, which constitute part of said reaction apparatuses, is not particularly limited as long as they do not form a turbulent flow, but rectangular plates and the like which are formed with a continuous plane are preferable and may have a curved plane.

On the other hand, in toner which is prepared employing the polymerization method in which resinous particles are associated or fused in a water based medium, it is possible to optionally vary the shape distribution of all the toner particles as well as the shape of the toner particles by controlling the flow of the medium and the temperature distribution during the fusion process in the reaction vessel, and by further controlling the heating temperature, the frequency of rotation of stirring as well as the time during the shape controlling process after fusion.

Namely, in a toner which is prepared employing the polymerization method in which resinous particles are associated or fused, it is possible to form toner which has the specified shape coefficient and uniform distribution by controlling the temperature, the frequency of rotation, and the time during the fusion process, as well as the shape controlling process, employing the stirring blade and the stirring tank which are capable of forming a laminar flow in the reaction vessel as well as forming making the uniform interior temperature distribution. The reason is understood to be as follows: when fusion is carried out in a field in which a laminar flow is formed, no strong stress is applied to particles under coagulation and fusion (associated or coagulated particles) and in the laminar flow in which flow rate is accelerated, the temperature distribution in the stirring tank is uniform. As a result, the shape distribution of fused particles becomes uniform. Thereafter, further fused particles gradually become spherical upon heating and stirring during the shape controlling process. Thus it is possible to optionally control the shape of toner particles.

Employed as the stirring blades and the stirring tank, which are employed during the production of toner employing the polymerization method in which resinous particles are associated or fused, can be the same stirring blades and stirring tank which are employed in said suspension polymerization in which the laminar flow is formed, and for example, it is possible to employ the apparatus shown in FIG. 13. Said apparatus is characterized in that obstacles such as a baffle plate and the like, which forms a turbulent flow, is not provided. It is preferable that in the same manner as the stirring blades employed in the aforementioned suspension polymerization method, the stirring blades are constituted at multiple levels in which the upper stirring blade is arranged so as to have a crossed axis angle $\alpha$ in advance in the rotation direction with respect to the lower stirring blade.

Employed as said stirring blades may be the same blades which are used to form a laminar flow in the aforementioned suspension polymerization method. Stirring blades are not particularly limited as long as a turbulent flow is not formed, but those comprised of a rectangular plate as shown in FIG. 14(*a*), which are formed of a continuous plane are preferable, and those having a curved plane may also be employed.

The variation coefficient of the polymerized toner, which is preferably employed in the present invention, is calculated using the formula described below:

Variation coefficient=(S/K)×100 (in percent) wherein S represents the standard deviation of the shape coefficient of 100 toner particles and K represents the average of said shape coefficient.

Said variation coefficient of the shape coefficient is generally not more than 16 percent, and is preferably not more than 14 percent. By adjusting said variation coefficient of the shape coefficient to not more than 16 percent, voids in the transferred toner layer decrease to improve fixability and to minimize the formation of offsetting. Further, the resultant charge amount-distribution narrows to improve image quality.

In order to uniformly control said shape coefficient of toner as well as the variation coefficient of the shape coefficient with minimal fluctuation of production lots, the optimal finishing time of processes may be determined while monitoring the properties of forming toner particles (colored particles) during processes of polymerization, fusion, and shape control of resinous particles (polymer particles).

Monitoring as described herein means that measurement devices are installed in-line, and process conditions are controlled based on measurement results. Namely, a shape measurement device, and the like, is installed in-line. For example, in a polymerization method, toner, which is formed employing association or fusion of resinous particles in water-based media, during processes such as fusion, the shape as well as the particle diameters, is measured while sampling is successively carried out, and the reaction is terminated when the desired shape is obtained.

Monitoring methods are not particularly limited, but it is possible to use a flow system particle image analyzer FPIA-2000 (manufactured by Toa Iyodenshi Co.). Said analyzer is suitable because it is possible to monitor the shape upon carrying out image processing in real time, while passing through a sample composition. Namely, monitoring is always carried out while running said sample composition from the reaction location employing a pump and the like, and the shape and the like are measured. The reaction is terminated when the desired shape and the like is obtained.

The number particle distribution as well as the number variation coefficient of the toner of the present invention is measured employing a Coulter Counter TA-11 or a Coulter Multisizer (both manufactured by Coulter Co.). In the present invention, employed was the Coulter Multisizer which was connected to an interface which outputs the particle size distribution (manufactured by Nikkaki), as well as on a personal computer. Employed as used in said Multisizer was one of a 100 $\mu$m aperture. The volume and the number of particles having a diameter of at least 2 $\mu$m were measured and the size distribution as well as the average particle diameter was calculated. The number particle distribution, as described herein, represents the relative frequency of toner particles with respect to the particle diameter, and the number average particle diameter as described herein expresses the median diameter in the number particle size distribution.

The number variation coefficient in the number particle distribution of toner is calculated employing the formula described below:

$$\text{Number variation coefficient}=(S/D_n)\times 100 \text{ (in percent)}$$

wherein S represents the standard deviation in the number particle size distribution and Dn represents the number average particle diameter (in $\mu$m).

The number variation coefficient of the toner of the present invention is not more than 27 percent, and is preferably not more than 25 percent. By adjusting the number variation coefficient to not more than 27 percent, voids of the transferred toner layer decrease to improve fixability and to minimize the formation of offsetting. Further, the width of the charge amount distribution is narrowed and image quality is enhanced due to an increase in transfer efficiency.

Methods to control the number variation coefficient of the present invention are not particularly limited. For example, employed may be a method in which toner particles are classified employing forced air. However, in order to further decrease the number variation coefficient, classification in liquid is also effective. In said method, by which classification is carried out in a liquid, is one employing a centrifuge so that toner particles are classified in accordance with differences in sedimentation velocity due to differences in the diameter of toner particles, while controlling the frequency of rotation.

Specifically, when a toner is produced employing a suspension polymerization method, in order to adjust the number variation coefficient in the number particle size distribution to not more than 27 percent, a classifying operation may be employed. In the suspension polymerization method, it is preferred that prior to polymerization, polymerizable monomers be dispersed into a water based medium to form oil droplets having the desired size of the toner. Namely, large oil droplets of said polymerizable monomers are subjected to repeated mechanical shearing employing a homomixer, a homogenizer, and the like to decrease the size of oil droplets to approximately the same size of the toner. However, when employing such a mechanical shearing method, the resultant number particle size distribution is broadened. Accordingly, the particle size distribution of the toner, which is obtained by polymerizing the resultant oil droplets, is also broadened. Therefore classifying operation may be employed.

Figure 15:
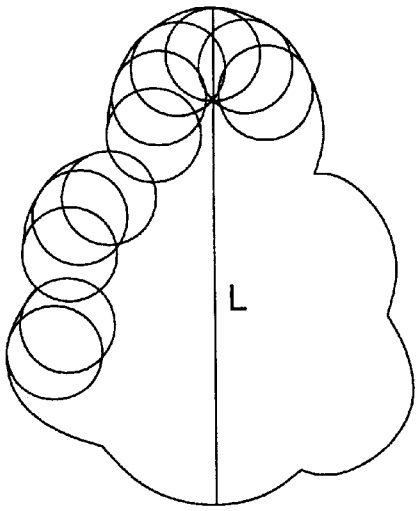
FIG. 15(*a*) is a view explaining the projection image of a toner particle without corners, and FIGS. 15(*b*) and 15(*c*) are views explaining projection images of a toner particle with corners.
Figure 15:
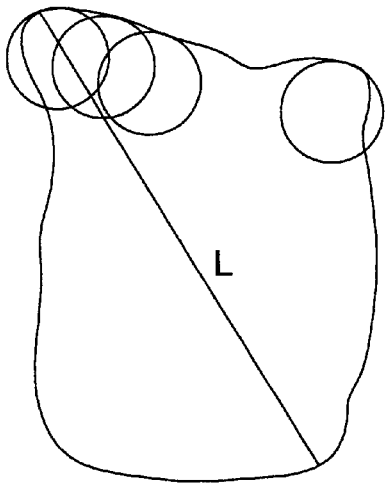
Figure 15:
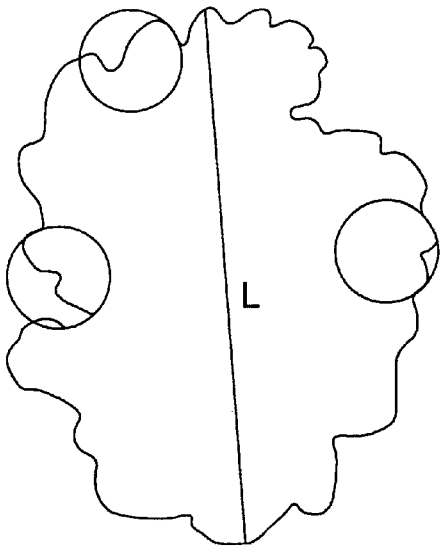

The toner particles of the present invention, which substantially have no corners, as described herein, mean those having no projection to which charges are concentrated or which tend to be worn down by stress. Namely, as shown in FIG. 15(*a*), the main axis of toner particle T is designated as L. Circle C having a radius of L/10, which is positioned in toner T, is rolled along the periphery of toner T, while remaining in contact with the circumference at any point. When it is possible to roll any part of said circle without substantially crossing over the circumference of toner T, a toner is designated as "a toner having no corners". "Without substantially crossing over the circumference" as described herein means that there is at most one projection at which any part of the rolled circle crosses over the circumference. Further, "the main axis of a toner particle" as described herein means the maximum width of said toner particle when the projection image of said toner particle onto a flat plane is placed between two parallel lines. Incidentally, FIGS. 15(*b*) and 15(*c*) show the projection images of a toner particle having corners.

Toner having no corners was measured as follows. First, an image of a magnified toner particle was made employing a scanning type electron microscope. The resultant picture of the toner particle was further magnified to obtain a photographic image at a magnification factor of 15,000. Subsequently, employing the resultant photographic image, the presence and absence of said corners was determined. Said measurement was carried out for 100 toner particles.

In the toner of the present invention, the ratio of the number of toner particles having no corners is generally at least 50 percent, and is preferably at least 70 percent. By adjusting the ratio of the number of toner particles having no corners to at least 50 percent, the formation of fine toner particles and the like due to stress with a developer conveying member and the like tends not to occur. Thus it is possible to minimize the formation of a so-called toner which excessively adheres to the developer conveying member, and simultaneously minimizes staining onto said developer conveying member, as well as to narrow the charge amount distribution. Further, decreased are toner particles which are readily worn and broken, as well as those which have a portion at which charges are concentrated. Thus, since the charge amount distribution is narrowed, it is possible to stabilize chargeability, resulting in excellent image quality over an extended period of time.

Methods to obtain toner having no corners are not particularly limited. For example, as previously described as the method to control the shape coefficient, it is possible to obtain toner having no corners by employing a method in which toner particles are sprayed into a heated air current, a method in which toner particles are subjected to application of repeated mechanical force, employing impact force in a gas phase, or a method in which a toner is added to a solvent which does not dissolve said toner and which is then subjected to application of revolving current.

Further, in a polymerized toner which is formed by associating or fusing resinous particles, during the fusion terminating stage, the fused particle surface is markedly uneven and has not been smoothed. However, by optimizing conditions such as temperature, rotation frequency of impeller, the stirring time, and the like, during the shape controlling process, toner particles having no corners can be obtained. These conditions vary depending on the physical properties of the resinous particles. For example, by setting the temperature higher than the glass transition point of said resinous particles, as well as employing a higher rotation frequency, the surface is smoothed. Thus it is possible to form toner particles having no corners.

The diameter of the toner particles of the present invention is preferably between 3 and 8 $\mu$m in terms of the number average particle diameter. When toner particles are formed employing a polymerization method, it is possible to control said particle diameter utilizing the concentration of coagulants, the added amount of organic solvents, the fusion time, or further the composition of the polymer itself.

By adjusting the number average particle diameter from 3 to 8 $\mu$m, it is possible to decrease the presence of toner and the like which is adhered excessively to the developer conveying member or exhibits low adhesion, and thus stabilize developability over an extended period of time. At the same time, improved is the halftone image quality as well as general image quality of fine lines, dots, and the like.

The polymerized toner, which is preferably employed in the present invention, is as follows. The diameter of toner particles is designated as D (in $\mu$m). In a number based histogram, in which natural logarithm lnD is taken as the abscissa and said abscissa is divided into a plurality of classes at an interval of 0.23, a toner is preferred, which exhibits at least 70 percent of the sum (M) of the relative frequency ($m_1$) of toner particles included in the highest frequency class, and the relative frequency ($m_2$) of toner particles included in the second highest frequency class.

By adjusting the sum (M) of the relative frequency ($m_1$) and the relative frequency ($m_2$) to at least 70 percent, the dispersion of the resultant toner particle size distribution narrows. Thus, by employing said toner in an image forming process, it is possible to securely minimize the generation of selective development.

In the present invention, the histogram, which shows said number based particle size distribution, is one in which natural logarithm lnD (wherein D represents the diameter of each toner particle) is divided into a plurality of classes at an interval of 0.23 (0 to 0.23, 0.23 to 0.46, 0.46 to 0.69, 0.69 to 0.92, 0.92 to 1.15, 1.15 to 1.38, 1.38 to 1.61, 1.61 to 1.84, 1.84 to 2.07, 2.07 to 2.30, 2.30 to 2.53, 2.53 to 2.76 . . . ). Said histogram is drawn by a particle size distribution analyzing program in a computer through transferring to said computer via the I/O unit particle diameter data of a sample which are measured employing a Coulter Multisizer under the conditions described below.

(Measurement Conditions)

(1) Aperture: 100 $\mu$m (2) Method for preparing samples: an appropriate amount of a surface active agent (a neutral detergent) is added while stirring in 50 to 100 ml of an electrolyte, Isoton R-11 (manufactured by Coulter Scientific Japan Co.) and 10 to 20 ml of a sample to be measured is added to the resultant mixture. Preparation is then carried out by dispersing the resultant mixture for one minute employing an ultrasonic homogenizer.

Further, the toner of the present invention exhibits more desired effects when employed after having added fine particles such as fine inorganic particles, fine organic particles, and the like, as external additives. The reason is understood as follows: since it is possible to control burying and releasing of external additives, the effects are markedly pronounced.

Preferably employed as such fine inorganic particles are inorganic oxide particles such as silica, titania, alumina, and the like. Further, these fine inorganic particles are preferably subjected to hydrophobic treatment employing silane coupling agents, titanium coupling agents, and the like. The degree of said hydrophobic treatment is not particularly limited, but said degree is preferably between 40 and 95 in terms of the methanol wettability. The methanol wettability as described herein means wettability for methanol. The methanol wettability is measured as follows. 0.2 g of fine inorganic particles to be measured is weighed and added to 50 ml of distilled water, in a beaker having an inner capacity of 200 ml. Methanol is then gradually dripped, while stirring, from a burette whose outlet is immersed in the liquid, until the entire fine inorganic particles are wetted. When the volume of methanol, which is necessary for completely wetting said fine inorganic particles, is represented by "a" ml, the degree of hydrophobicity is calculated based on the formula described below:

$$\text{Degree of hydrophobicity}=[a/(a+50)]\times 100$$

The added amount of said external additives is generally between 0.1 and 5.0 percent by weight with respect to the toner, and is preferably between 0.5 and 4.0 percent. Further, external additives may be employed in combinations of various types.

Employed as external additives which are used in the present invention may be fatty acid metal salts. Cited as fatty acids and salts thereof are long chain fatty acids such as undecylic acid, lauric acid, tridecyl acid, dodecyl acid, myristic acid, palmitic acid, pentadecylic acid, stearic acid, heptadecylic acid, arachic acid, montanic acid, oleic acid, linoleic acid, arachidonic acid, as well as their salts of metals such as zinc, iron, magnesium, aluminum, calcium, sodium, lithium and the like. In the present invention, zinc stearate is particularly preferable.

External Abrasive Additives

External abrasive additives, as described herein, refer to metal oxides having a number average particle diameter of from 0.5 to 5.0 μm, fine inorganic particles, or fine inorganic/organic composite particles.

The toner of the present invention preferably comprises external abrasive additives in an amount of from 0.02 to 2.0 parts by weight, and more preferably from 0.04 to 1.0 part by weight. When said amount is at least 2.0 parts by weight, the abrasive wear amount of the blade increases and cleaning properties degrade. On the other hand, when said amount is no more than 0.02 part by weight, effects to minimize toner filming on the photoreceptor decrease.

Further, the circularity coefficient of external abrasive additives of the present invention is preferably from 0.950 to 0.998, and is more preferably from 0.980 to 0.990.

By adjusting said circularity coefficient to said range, the sub-dynamic properties of the blade as well as of the photoreceptor are enhanced so that it is possible to minimize insufficient toner removal due to a decrease in fine vibration of the blade. When said circularity coefficient exceeds 0.998, external abrasive additives are not accumulated in the cleaning section but are occasionally not removed, while when said circularity is less than 0.950, the abrasive wear amount of the photoreceptor increases. Said circularity coefficient can be measured employing a Flow Type Particle Image Analyzing Apparatus FPIA-2000 (manufactured by Toa Iyodenshi Co.)

Fine Inorganic/Organic Composite Particles

In the present invention, preferably employed are fine inorganic/organic composite particles. Said fine inorganic/organic composite particles are spherical in shape, and the surface of said particles is comprised of fine inorganic powder, having a high hardness, while in the nucleus portion, fine organic particles, which are relatively elastic, are employed. As a result, abrasive wear of the photoreceptor is not promoted, and flaws are not formed on the photoreceptor and the cleaning blade. Thus stable cleaning properties are exhibited.

From the viewpoint of the enhancement of cleaning properties, abrasive properties, and filming resistance, the average primary particle diameter of fine inorganic particles, which constitute said fine inorganic/organic composite particles, is preferably from 5 to 100 nm. Incidentally, said average primary particle diameter of fine inorganic particles refers to a number average particle diameter determined through the analysis of images upon observing said particles, employing a scanning type electron microscope.

Employed as components of said fine inorganic particles may be silicon oxide, titanium oxide, aluminum oxide, zinc oxide, zirconium oxide, cerium oxide, tungsten oxide, antimony oxide, copper oxide, tellurium oxide, manganese oxide, barium titanate, strontium titanate, magnesium titanate, silicon nitride, carbon nitride, and the like.

Fine organic particles, which constitute fine inorganic/organic composite particles, are preferably resinous particles comprised of acryl based polymers, styrene based polymers, styrene-acryl copolymers, and the like.

Acryl based polymers which constitute fine organic particles include homopolymers and copolymers obtained by polymerizing monomers selected from acrylic acid or acrylic acid esters and methacrylic acid or methacrylic acid esters. Listed as acryl based monomers employed to obtain such acryl based polymers, may be acrylic acid, methyl acrylate, ethyl acrylate, n-butyl acrylate, isobutyl acrylate, propyl acrylate, n-octyl acrylate, dodecyl acrylate, lauryl acrylate, 2-ethylhexyl acrylate, stearyl acrylate, 2-chloroethyl acrylate, phenyl acrylate, methyl α-chloroacrylate, methacrylic acid, methyl methacrylate, ethyl methacrylate, propyl methacrylate, n-butyl methacrylate, isobutyl methacrylate, n-octyl methacrylate, dodecyl methacrylate, lauryl methacrylate, 2-ethylhexyl methacrylate, stearyl methacrylate, phenyl methacrylate, dimethyl aminoethyl methacrylate, diethyl aminoethyl methacrylate, and the like.

Listed as styrene based monomers may be styrene, o-methylstyrene, m-methylstyrene, p-methylstyrene, α-methylstyrene, p-ethylstyrene, 2,4-dimethylstyrene, p-n-butylstyrene, p-tert-butylstyrene, p-n-hexylstyrene, p-n-octylstyrne, p-n-nonylstyrene, p-n-decylstyrene, p-n-dodecylstyrene, p-methoxystyrene, p-phenylstyrene, p-chlorostyrene, 3,4-dichlorostyrne and the like. Styrene based polymers are obtained employing one or more types of styrene based monomers. However, in the present invention, if desired, copolymers may be employed which are obtained by copolymerizing said monomer with one or more types of other monomers. In this case, in monomer compositions, the styrene based monomers are preferably employed at a ratio of at least 50 percent by weight.

Styrene-acryl based copolymers which constitute fine organic particles are obtained utilizing one or more types of said acryl based monomers and one or more types of said styrene based monomers. If desired, said copolymers may be obtained utilizing one or more types of monomers other than those previously described. In this case, in monomer compositions, the total of said acryl based monomers and said styrene based monomers is preferably employed in an amount of 50 percent by weight. Listed as said other monomers are derivatives of acrylic acid or methacrylic acid such as acrylonitrile, methacrylonitrile, acrylamide, and the like; vinyl esters such as vinyl acetate, vinyl benzoate, and the like; vinyl ethers such as vinyl methyl ether, vinyl ethyl ether, and the like; vinyl ketones such as vinyl methyl ketone and the like; diens such as butadiene, isoprene, and the like; unsaturated carboxylic acids such as maleic acid, fumaric acid, and the like; and the like.

From the viewpoint of the enhancement of cleaning properties as well as the stability of triboelectrical charging, the average particle diameter of fine organic particles constituting said fine inorganic/organic composite particles is preferably from 0.1 to 4.5 μm, and is more preferably from 0.2 to 3.0 μm. Incidentally, the average particle diameter of fine organic particle refers to a volume based average particle diameter which is determined employing a laser diffraction type size distribution measurement apparatus "HELOS" (manufactured by Sympatec Co.), equipped with a wet system homogenizer. However, prior to said measurement, pretreatment was carried out in such a manner that 10 mg of fine organic particles were dispersed into 50 ml of water along with surface active agents, and afterward, the resultant dispersion was further dispersed employing an ultrasonic homogenizer (having an output of 150 W) for 1 to 10 minutes, while taking care that dispersed particles did not re-aggregate due to generated heat.

Fine inorganic/organic composite particles are constituted in such a manner those fine inorganic particles, which have been treated with said specified treatment compounds, are adhered onto the surface of fine organic particles. Said adhesion, as described herein, does not refer to adhesion in which fine inorganic particles are simply adhered onto fine organic particles through an electrostatic force, but to the state in which the ratio of length of fine inorganic particles, which are buried into fine organic particles, is from 5 to 95 percent. It is possible to confirm such a state through the observation of the surface of fine inorganic/organic composite particles, employing a transmission electron microscope, or a common electron microscope. When fine inorganic particles are adhered onto the surface of fine organic particles, it is preferable that first, fine organic particles are modified to sphere, and subsequently, fine inorganic particles are adhered onto the surface of said fine organic particles. This is due to the fact that when fine organic particles are spherical, fine inorganic particles are uniformly adhered so that the release of said fine inorganic particles is minimized. Listed as methods which modify fine organic particles to a spherical shape are a method in which fine organic particles are thermally fused temporarily and subsequently are subjected to spray granulation, another method in which thermally fused fine organic particles are jet-discharged into water to form sphere, and yet another method in which fine organic particles are synthesized employing a suspension polymerization method or an emulsion polymerization method, and the like.

Methods to allow fine inorganic particles to adhere onto the surface of fine organic particles include a method in which fine organic particles and fine inorganic particles are mixed, and subsequently heat is applied to the resultant mixture, and also a so-called mechanochemical method in which fine inorganic particles are allowed to adhere onto the surface of fine organic particles, and the like. Specific methods include a method in which fine organic particles and fine inorganic particles are blended; the resulting blend is mixed while stirring, employing a Henschel mixer, a V type mixer, a Turbuler mixer, or the like, so that fine inorganic particles are allowed to adhere onto fine organic particles utilizing an electrostatic force; and subsequently, fine organic particles onto which surface is adhered to fine inorganic particles are then introduced into a heat treatment apparatus such as a Niro Atomizer, a spray drier, and the like, and heat is applied to the resulting mixture so that the surface of said fine organic particles is softened and fine inorganic particles are allowed to adhere onto the softened surface, another method in which after allowing fine inorganic particles to adhere to the surface of fine organic particles employing an electrostatic force, said fine inorganic particles are allowed to adhere onto said fine organic particles, employing devices, such as, for example, an Ong Mill, a free mill, a hybridizer, and the like, which are prepared by modifying an impact type pulverizer which can provide mechanical energy, and the like.

When said fine inorganic/organic composite particles are prepared, the blended amount of fine inorganic particles with respect to fine organic particles may be such an amount that can uniformly cover the surface of fine organic particles. Specifically, even though varied, depending on the specific gravity of fine inorganic particles, said fine inorganic particles are commonly employed in an amount of from 5 to 100 percent by weight with respect to said fine organic particles, and preferably in an amount of from 5 to 80 percent by weight. When the ratio of said fine inorganic particles is excessively small, cleaning properties tend to degrade, while when the ratio of said fine inorganic particles is excessively large, said fine inorganic particles tend to release.

The adhesion ratio of fine inorganic/organic composite particles is obtained as described below. (BET specific surface area of fine inorganic/organic particles)/{(BET specific surface area of employed fine inorganic particles)+(BET specific surface area of employed fine organic particles)}×100

Herein, said BET specific surface area was determined employing an automatic specific area measurement apparatus, GEMINI 2375 (manufactured by Shimadzu Seisakusho) based on a BET one point method.

Abrasive External Additives Other Than Fine Inorganic/Organic Composite Particles In the present invention, external abrasive additives other than said fine inorganic/organic composite particles include, for example, calcium titanate powder, barium titanate powder, magnesium titanate powder, strontium titanate powder, cerium oxide powder, zirconium oxide powder, titanium oxide powder, aluminum oxide powder, boron carbide powder, silicon carbide powder, silicon oxide, diamond powder, and the like. These may be employed individually or in combination. Of these, strontium titanate is most preferably employed.

The mixing process of external additives, as described herein, refers to a process in which external additives are added to toner particles which have been subjected to drying treatment.

Listed as devices which are employed to add external additives are various mixing devices, known in the art, such as a Turbuler mixer, a Henschel mixer, a Nauter mixer, a V-type mixer, and the like.

External Additives Other Than Abrasive External Additives

It is preferable that external additives placed on the surface of toner particles include silica or titanium oxide other than said abrasive external additives. If desired, alumina, tin oxide, iron oxide, and the like may also be employed in combination.

Lubricants

It is preferable that fatty acid metallic salts be added as lubricants. Fatty acid calcium salts as well as fatty acid lithium salts are particularly preferred. The volume average particle diameter of lubricants is most preferably no more than 4 $\mu$m.

"Fatty Acid Metallic Salts"

The number average particle diameter of fatty acid metallic salts according to the present invention is from 0.5 to 4.0 $\mu$m. When said diameter is less than 0.5 $\mu$m, said fatty acid metallic salts tend to cause filming on the surface of toner particles, while when said diameter exceeds 4.0 mm, the abrasive wear of cleaning blades, as well as of photoreceptors tends to occur.

Fatty acid metallic salts according to the present invention preferably contain particles having a particle diameter of at least 10 $\mu$m at a content ratio of no more than 4 percent by weight, and more preferably contain no such particles. Particles, having a diameter of at least 10 $\mu$m, damage the surface of a photoreceptor, and thus shorten the productive life of said photoreceptor.

The toner of the present invention comprises fatty acid metallic salts in an amount of from 0.02 to 2.0 parts by weight with respect to 100 parts by weight of toner particles to which no fatty acid metallic salts have been added, and more preferably from 0.04 to 1.0 part by weight. When said amount exceeds 2.0 parts by weight, the wear and abrasion of the cleaning blade increase to result in the degradation of cleaning properties, while when said amount is no more than 0.02 part by weight, effects to minimize toner filming on the photoreceptor decrease.

Further, the coefficient of circularity of fatty acid metallic salts according to the present invention is preferably from 0.750 to 0.960, and is more preferably from 0.820 to 0.950.

When said coefficient of circularity is in said range, the sub-dynamic properties of the cleaning blade and the photoreceptor are enhanced and insufficient toner removal is minimized due to a decrease in fine vibration. When said coefficient exceeds 0.960, the amount of fatty acid metallic salts applied onto the photoreceptor surface becomes exceedingly small, and the function to minimize the abrasive wear of the photoreceptor degrades. On the other hand, when said amount is less than 0.750, the amount of fatty acid metallic salts applied onto the photoreceptor becomes excessively large, and image smearing tend to occur. It is possible to determine the coefficient of circularity employing a flow type particle image analyzing apparatus "FPIA-2000" (manufactured by Toa Iyodenshi Co.).

Listed as fatty acid metallic salts employed in the present invention may be higher fatty acid metallic salts. Specific examples of said higher fatty acid metallic salts include stearic acid metallic salts such as zinc stearate, aluminum stearate, copper stearate, magnesium stearate, and the like; oleic acid metallic salts such as zinc oleate, manganese oleate, copper oleate, magnesium oleate, and the like; palmitic acid metallic salts such as zinc palmitate, copper palmitate, magnesium palmitate, and the like; linoleic acid metallic salts such as lead linoleate, zinc linoleate, and the like; and recinolic acid metallic salts such as zinc recinoleate, lithium recinoleate, and the like.

From the viewpoint of minimizing the decrease of the cleaning blade as well as the decrease of the photoreceptor, fatty acid calcium salts are particularly preferred.

The preferred production method of fatty acid metallic salt particles will now be described.

Employed as raw materials for said production are an aqueous fatty acid salt solution (hereinafter referred also to as Component (a)) and an aqueous solution or a dispersion of inorganic metallic salts (hereinafter referred also to as Component (b)).

Listed as fatty acid salts employed to prepare said aqueous fatty acid salt solution are fatty acid alkali metallic salts or ammonium salts having from 4 to 30 carbon atoms. Said fatty acid may be saturated or unsaturated and straight-chained or branched. Listed as examples of such fatty acid salts are alkali metals such as sodium salts, potassium salts, and the like, or ammonium salts of each of fatty acids such as caprylic acid, capric acid, lauric acid, myristic acid, myristoleic acid, palmitic acid, isopalmitic acid, palmitoleic acid, stearic acid, behenic acid, lignoceric acid, cerotic acid, montanic acid, isostearic acid, oleic acid, arachic acid, ricinoleic acid, linoleic acid, behenic acid, erucic acid, and the like; or salts of alkali metals such as sodium, potassium, and the like; or ammonium salts of fatty acids such as beef fatty acids, soybean oil fatty acids, coconut oil fatty acids, palm oil fatty acids, and the like, originating from animal fat and oil and vegetable oil.

Of these, preferred are alkali metallic salts such as sodium salts, potassium salts, and the like or ammonium salts of fatty acids having from 10 to 25 carbon atoms, particularly from 12 to 22 carbon atoms. These fatty acids may be employed individually or in combinations or two or more types.

When alkali metallic salts or ammonium salts of fatty acids having fewer than 4 carbon atoms are employed, resulting fatty acid salts exhibit high solubility to water, whereby the yield decreases. On the other hand, when alkali metallic salts or ammonium salts of fatty acids, having at least 30 carbon atoms, are employed, resulting fatty acid salts exhibit low solubility to water, whereby production efficiency decreases due to a decrease in the concentration of the aqueous solution.

The content of said fatty acid metallic salts or ammonium salts in said aqueous fatty acid solution is selected so as to be in the range of from 0.001 to 2 percent by weight. When said content is less than 0.001 percent by weight, the amount of obtained fatty acid metallic salts becomes markedly low with respect to the amount of the reaction composition. As a result, such content is not practical due to the decrease in production efficiency. On the other hand, when said content exceeds 2 percent by weight, the average particle diameter of the resulting fatty acid metallic salt particles tends to be undesirably large. From the viewpoint of the amount of obtained fatty acid metallic salts and their particle diameter, the content of said alkali metallic salts or ammonium salts in an aqueous solution is preferably in the range of from 0.5 to 1.5 percent by weight.

Listed as examples of inorganic metallic salts, which are employed to prepare an aqueous solution or dispersion of inorganic metallic salts used in the present invention, may be chlorides, sulfates, carbonates, nitrates, phosphates, and the like of alkali earth metals such as calcium, barium, magnesium, and the like, or chlorides, sulfates, carbonates, nitrates, phosphates, and the like of metals such as titanium, zinc, copper, manganese, cadmium, mercury, zirconium, lead, iron, aluminum, cobalt, nickel, lithium, silver, and the like. These compounds may be employed individually or in combination of two types or more.

The content of said inorganic metallic salts in an aqueous solution or dispersion is selected to be in the range of from 0.001 to 2 percent by weight. When said content is less than 0.001 percent by weight, the amount of obtained fatty acid metallic salts becomes markedly low with respect to the amount of the reaction composition. As a result, such content is not practical due to the subsequent decrease in production efficiency. On the other hand, when said content exceeds 2 percent by weight, the average particle diameter of the resulting fatty acid metallic salt particles tends to be undesirably large. From the viewpoint of the amount of obtained fatty acid metallic salts and their particle diameter, the content of said inorganic metallic salts in an aqueous solution is preferably in the range of from 0.5 to 1.5 percent by weight.

Water, which is employed to prepare said Component (a) as well as Component (b), is not particularly limited and commonly used water may be employed. However water such as deionized water, purified water, distilled water, which comprises minimal impurities such as metal ions and the like, is preferred. In the present invention, the mixing ratio of said Component (a) and said Component (b) is not particularly limited, and may be determined based on the situation. However, the equivalent ratio of the fatty acid salts in said Component (a) with respect to the inorganic metallic salts in said Component (b) is preferably selected to be in the range of from 0.9 to 11.1. When said equivalent ratio is beyond said range, a large mount of unreacted raw materials may remain and a process for removing them is occasionally needed. In order to decrease residual impurities, said equivalent ratio is more preferably in the range of from 0.95 to 1.05.

Preferred as the production apparatus of fatty acid metallic salts is one in which said Component (a) and said Component (b) can be separately supplied into a mixing device and mixed. Specifically, it is preferable that said Component (a) and Component (b) can be separately supplied into said mixing device at a speed as high as possible. For example, it is advantageous that each raw material solution (or a dispersion) is placed into a mixing device from a different direction, and mixed, and at the same time, the resulting mixture is discharged from said mixing device. Preferably employed as these devices are a flow jet mixer, a line homogenizer, a sand mill, and the like. Further, after allowing said Component (a) to react with said Component (b), when unreacted fatty acid alkali metallic salts or ammonium salts remain, an aqueous solution or a dispersion comprising inorganic metallic salts in an amount of from 0.001 to 1.5 percent by weight is blended after said Component (a) and Component (b) are removed from said mixing device. By so doing, it is possible to allow unreacted fatty acid alkali metallic salts or ammonium salts to completely react with fatty acid metallic salts.

Said Component (a) and Component (b) are preferably mixed at a temperature which is lower than the crystal transition initiating temperature of the resulting fatty acid metallic salts, and preferably at temperature at least 5° C. lower then said crystal transition temperature.

Fatty acid metallic salt slurry prepared as above is separated into a fatty acid metallic salt cake and a filtrate, employing any of commonly used filtration devices. The resulting fatty acid metallic salt cake is well washed with heated water, and the like, to remove impurities, and subsequently, is subjected to a drying treatment, whereby fine particles of the fatty acid metallic salt are obtained. The drying treatment of the resulting fatty acid metallic salt cake is preferably carried out at temperature which is lower than the crystal transition initiating temperature of the resulting fatty acid metallic salts, and preferably at a temperature at least 5° C. lower than said crystal transition initiating temperature. The specific drying temperature varies depending on the type of obtained fatty acid metallic salts, and for example, is to be no more than 100° C. in the case of zinc stearate. When drying treatment is carried out at a temperature higher than the crystal transition initiating temperature of said fatty acid metallic salts, fine particles aggregate with each other and the average particle diameter tends to increase undesirably. Drying of said fatty acid metallic salt cake may be carried out at a normal pressure. However, in order to efficiently dry said cake, reduced pressure drying as well as vacuum drying may be carried out, or after said fatty acid metallic salt cake is subjected to washing treatment employing low boiling point solvents and the like, the resulting fatty acid metallic salt cake may then be dried. Preferred as low boiling point solvents, employed in such a case, are those which can efficiently remove water from said fatty acid metallic salts, and listed, for example, are methanol, ethanol, acetone, methylene chloride and the like.

From the viewpoint of minimizing the humidity dependence of charging, the moisture content in fatty acid metallic salts is preferably from 0.1 to 2.5 percent by weight, and is more preferably from 0.3 to 1.2 percent by weight. When the moisture content exceeds 2.5 percent by weight, image blurring tends to occur at high temperature and high humidity.

The amount of free fatty acid in fatty acid metallic salts is preferably from 0.01 to 0.7 percent by weight, and is more preferably from 0.05 to 0.5 percent by weight. When said amount exceeds 0.7 percent by weight, carriers and charging members such as development rolls, and the like tend to be stained. When said amount is less than 0.01 percent by weight, the abrasive wear of the cleaning blade tends to increase, whereby the life of said cleaning blade is occasionally shortened.

A double component developer is prepared by mixing a toner with a carrier. The concentration of the toner in the developer is to be between 2 and 10 percent by weight, and the resultant developer is employed.

Development methods according to the present invention are not particularly limited. A contact development method may be employed in which development is carried out in such a manner that the photoreceptor surface comes into contact with the developer layer, and a non-contact development method may also by employed in which the photoreceptor surface and the developer layer are maintained in a non-contact state, and development is carried out by allowing the toner jump in the space between the photoreceptor surface and the developer layer, employing means such as an alternating electrical field and the like.

EXAMPLES

The present invention will now be detailed with reference to examples. In the following description, "parts" is "parts by weight".

The Photoreceptors described below were prepared as image holding bodies of the present invention.

Production of Photoreceptor P1

Charged into a solvent mixture consisting of 900 ml of methanol and 100 ml of butanol were 30 g of polyamide resin Amilan CM-8000 (manufactured by Toray Co.), which were dissolved at 50° C. The resulting composition was applied onto an electrically conductive cylindrical aluminum support having an outer diameter of 80 mm and a length of 360 mm to form a 0.5 μm thick interlayer.

Subsequently, 10 g of silicone resin KR-5240 (manufactured by Shin-Etsu Kagaku Kogyo Co.) were dissolved in 1,000 ml of t-butyl acetate, and 10 g of Y-TiOPc (described in FIG. 1 of Japanese Patent Publication Open to Public Inspection No. 64-17066) were then added to the resulting solution. Subsequently, the resulting mixture was dispersed for 20 hours employing a sand mill whereby a charge generating layer coating composition was obtained. Said coating composition was applied onto said interlayer to form a 0.3 μm thick charge generating layer.

Subsequently, 150 g of CTM (T-1: N-(4-methylphenyl)-N-{4-(β-phenylstyryl)phenyl}-p-toluidine) and 200 g of polycarbonate resin Upiron Z-200 (manufactured by Mitsubishi Gas Kagaku Co.), having a viscosity average molecular weight of 20,000, were dissolved in 1,000 ml of 1,2-dichloroethane, whereby a charge transport coating composition was obtained. Said coating composition was applied onto said charge generating layer employing a circular slide hopper, and subsequently dried at 100° C. for one hour to form a 22 μm thick charge transport layer. As previously described, Photoreceptor P1 was obtained which was comprised of said interlayer, said charge generating layer, and said charge transport layer.

Production of Photoreceptor 2

Applied onto said charge transport layer of Photoreceptor P1 obtained in Photoreceptor P1 Production Example, was a coating composition prepared by dissolving 30 g of CTM T-1 and 50 g of polycarbonate resin Upiron Z-800 (manufactured by Mitsubishi Gas Kagaku Co.), having a viscosity average molecular weight of 80,000, in 1,000 ml of 1,2-dichloroethane, employing a circular slide hopper, and subsequently, dried at 100° C. for one hour, whereby a 5 mm thick overcoat layer was formed, to obtain Photoreceptor P-2.

Production of Photoreceptor P3

A charge transport layer coating composition was obtained by dissolving 150 g of CMT T-1 and 200 g of polycarbonate resin Upiron Z-800 (manufactured by Mitsubishi Gas Kagaku Co.) having a viscosity average molecular weight of 80,000, in 1,000 ml of 1,2-dichloroethane. The resulting coating composition was applied onto said charge generating layer of Photoreceptor P1 Production Example, and subsequently dried at 100° C. for one hour to form a 22 μm thick charge transport layer. As previously described, Photoreceptor P3 was obtained which was comprised of said sublayer, said charge generating layer, and said charge transport layer.

Toners described below were prepared as toners which were employed in the present invention.

Production of Toners T1, T2, and T3 (Example of Emulsion Polymerization Method)

Added to 10.0 liters of pure water was 0.90 kg of sodium n-dodecylsulfate, and was subsequently dissolved. Gradually added to the resulting solution were 1.20 kg of Regal 330R (carbon black manufactured by Cabot Corp.). The resulting mixture was suitably stirred for one hour, and thereafter, was continuously dispersed for 20 hours employing a sand grinder (a medium type homogenizer). The resulting dispersion was designated as "Colorant Dispersion 1". A solution comprised of 0.055 kg of sodium dodecylbenzenesulfonate and 4.0 liters of deionized eater was designated as "Anionic Surface Active Agent Solution A".

A solution comprised of 0.014 g of a nonylphenolpolyethylene oxide 10 mole addition product and 4.0 liters of deionized water was designated as "Nonionic Surface Active Agent Solution B". A solution prepared by dissolving 223.8 g of potassium persulfate in 12.0 liters of deionized water was designated as "Initiator Solution C".

Charged into a 100 liter GL (glass lined) reaction vessel fitted with a thermal sensor were 3.41 kg of WAX emulsion (polypropylene emulsion having a number average molecular weight of 3,000, a number average primary particle diameter of 120 nm, and a solid concentration of 29.9 percent), the total amount of "Anionic Surface Active Agent A", and the total amount of "Nonionic Surface Active Agent Solution B", and the resulting mixture was stirred. Subsequently, 44.0 liters of deionized water were added.

When the resulting mixture reached 75° C., the total amount of "Initiator Solution C" was added. Thereafter, while maintaining the resulting mixture at 75±1° C., a mixture consisting of 12.1 kg of styrene, 2.88 kg of n-butyl acrylate, 1.04 kg of methacrylic acid, and 548 g of t-dodecylmercaptan was added dropwise. After said dropwise addition, the resulting mixture was heated to 80+1° C. and stirred for 6 hours while maintaining said temperature. Subsequently, the temperature was lowered to no more than 40° C. and stirring was stopped. The resulting products were filtered employing a pole filter and the resulting filtrate was designated as "Latex (1)-A".

Incidentally, the resinous particles in said Latex (1)-A exhibited a glass transition temperature of 57° C. and a softening point of 121° C., a weight average molecular weight of 12,700 regarding the molecular weight distribution, and a weight average particle diameter of 120 nm.

Further, a solution prepared by dissolving 0.055 kg of sodium dodecylbenzenesulfonate in 4.0 liters of deionized water was designated as "Anionic Surface Active Agent Solution D". Further, a solution prepared by dissolving 0.014 kg of a nonylphenolpolyethylene oxide 10 mole addition product in 4.0 liters of deionized water was designated as "Nonionic Surface Active Agent Solution E".

A solution prepared by dissolving 200.7 g of potassium persulfate (manufactured by Kanto Kagaku Co.) in 12.0 liters of deionized water was designated as "Initiator Solution F".

Charged into a 100 liter GL reaction vessel fitted with a thermal sensor, a cooling pipe, a nitrogen gas inlet, and a comb shaped baffle, were 3.41 kg of WAX emulsion (polypropylene emulsion having a number average molecular weight of 3,000, a number average primary particle diameter of 120 nm, and a solid concentration of 29.9 percent), the total amount of "Anionic Surface Active Agent D", and the total amount of "Nonionic Surface Active Agent Solution E", and the resulting mixture was stirred. Subsequently, 44.0 liters of deionized water were added. When the heated resulting mixture reached 70° C., "Initiator Solution F"was added. Subsequently, a solution previously prepared by mixing 11.0 kg of styrene, 4.00 kg of n-butyl acrylate, 1.04 kg of methacrylic acid, and 9.02 g of t-dodecylmercaptan was added dropwise. After said dropwise addition, the resulting mixture was maintained at 72+2° C. and stirred for 6 hours while maintaining said temperature. Subsequently, the temperature was raised to 80+2° C., and stirring was carried out for 12 more hours while controlling the temperature within said range. The temperature was then lowered to no more than 40° C., and stirring was stopped. The resulting products were filtered employing a pole filter and the resulting filtrate was designated as "Latex (1)-B".

Incidentally, the resinous particles in said Latex (1)-B exhibited a glass transition temperature of 58° C. and a softening point of 132° C., a weight average molecular weight of 245,000 regarding the molecular weight distribution, and a weight average particle diameter of 110 nm.

A solution prepared by dissolving 5.36 g of sodium chloride as the salting-out agent in 20.0 liters of deionized water was designated as "Sodium Chloride Solution G".

A solution prepared by dissolving 1.00 g of a fluorine based nonionic surface active agent in 1.00 liter of deionized water was designated as "Nonionic Surface Active Agent Solution H".

Charged into a 100 liter SUS reaction vessel (the reaction apparatus constituted as shown in FIG. 13, having a crossed axes angle α of 20 degrees), fitted with a thermal sensor, a cooling pipe, a nitrogen gas inlet, a particle diameter and shape monitoring device, were 20.0 kg of Latex (1)-A and 5.2 kg of Latex (1)-B as prepared above, 0.4 kg of Colorant Dispersion, and 20.0 kg of deionized water, and the resulting mixture was stirred. Subsequently, the mixture was heated to 40° C., and said Sodium Chloride Solution G and 6.00 kg of isopropanol, and said Nonionic Surface Active Agent Solution G were added in said order. Thereafter, the resulting mixture was put aside for 10 minutes, and then heated to 85° C. over a period of 60 minutes. While being heated at 85+2° C. for the period of from 0.5 to 3 hours while stirring, the mixture was subjected to salting-out/fusion so that the particle diameter increased. Subsequently, the increase in the particle diameter was terminated by the addition of 2.1 liters of pure water.

Charged into a 5 liter reaction vessel (the reaction apparatus constituted as shown in FIG. 13, having a crossed axes angle α of 20 degrees), fitted with a thermal sensor, a cooling pipe, and a particle diameter and shape monitoring device, were 5.0 kg of the coalesced particle dispersion as prepared above, and said dispersion was heated at 85±2° C. for a period of from 0.5 to 15 hours so as to control the particle shape. Thereafter, the resulting dispersion was cooled to no more than 40° C. and stirring was terminated. Subsequently, while employing a centrifuge, classification was carried out in the liquid medium utilizing a centrifugal sedimentation method, and filtration was carried out employing a 45 μm sieve. The resulting filtrate was designated as Coalesced Liquid Medium (1). Subsequently, wet cake-like non-spherical particles were collected from said Coalesced Liquid Medium (1) through filtration employing a glass filter, and then washed with deionized water.

The resulting non-spherical particles were dried at an air intake temperature of 60° C., employing a flash jet dryer, and subsequently dried at 60° C. employing a fluidized layer dryer. Externally added to 100 parts by weight of the obtained colored particles were 1 part by weight of fine silica particles and 0.1 part by weight of zinc stearate, and the resulting mixture was blended employing a Henschel mixer, whereby toners shown in the table below were obtained which were prepared employing the emulsion polymerization coalescence method. Toners T1, T2, and T3 shown in Table 1 were obtained by controlling the shape as well as the variation coefficient of the shape coefficient through controlling the rotation frequency of the stirrer as well as the heating time during said salting-out/fusion stage and the monitoring of the shape controlling process, and further regulating the particle diameter and the variation coefficient of the size distribution.

Production of Toner T4 (Example of Suspension Polymerization Method)

A mixture consisting of 165 g of styrene, 35 g of n-butyl butyl acrylate, 10 g of carbon black, 2 g of di-t-butylsalicylic acid metal compound, 8 g of a styrene-methacrylic acid copolymer, and 20 g of paraffin wax (having an mp of 70° C.) was heated to 60° C., and uniformly dissolve-dispersed at 12,000 rpm employing a TK Homomixer (Tokushuki Kako Kogyo Co.). Added to the resulting dispersion were 10 g of 2,2'-azobis(2,4-valeronitile) as the polymerization initiator and dissolved to prepare a polymerizable monomer composition. Subsequently, 450 g of 0.1 M sodium phosphate were added to 710 g of deionized water, and 68 g of 1.0 M calcium chloride were gradually added while stirring at 13,000 rpm, employing a TK Homomixer, whereby a dispersion in which tricalcium phosphate was prepared. Said polymerizable monomer composition was added to said dispersion and stirred at 10,000 rpm for 20 minutes employing a TK Homomixer, whereby said polymerizable monomer composition was granulated. Thereafter, the resulting composition underwent reaction at a temperature of from 75 to 95° C. for a period of from 5 to 15 hours, employing a reaction apparatus (having a crossed axes angle α of 45 degrees) in which stirring blades were constituted as shown in FIG. 6. Tricalcium phosphate was dissolved employing hydrochloric acid and then removed. Subsequently, while employing a centrifuge, classification was carried out in a liquid medium utilizing a centrifugal sedimentation method. Thereafter, filtration, washing and drying were carried out. Externally added to 100 parts by weight of the obtained colored particles were 1.0 part by weight of fine silica particles and 0.1 part by weight of zinc stearate, and the resulting mixture was blended employing a Henschel mixer, whereby a toner was obtained which was prepared employing the suspension polymerization method.

Toner T4 shown in Table 1 below was obtained by controlling the shape as well as the variation coefficient of the shape coefficient through controlling the temperature of the liquid medium, the rotation frequency of the stirrer, and the heating duration while carrying out monitoring during said polymerization and further regulating the particle diameter as well as the variation coefficient of the size distribution.

TABLE 1

| Toner No. | Shape Coefficient Ratio of 1.0 to 1.6 (in %) | Shape Coefficient Ratio of 1.2 to 1.6 (in %) | Variation Coefficient of Shape Coefficient (in %) | Ratio of Toner Particles Without Corners (in %) | Number Average Particle Diameter (in μm) | Variation Coefficient of Particle Number Distribution (in %) | Sum M of $m_1$ and $m_2$ (in %) | Preparation Method |
|---|---|---|---|---|---|---|---|---|
| Toner T1 | 76.6 | 72.0 | 14.9 | 53 | 6.4 | 26.2 | 77.0 | Emulsion Polymerization |
| Toner T2 | 75.7 | 70.6 | 15.3 | 58 | 6.3 | 25.8 | 78.1 | Emulsion Polymerization |
| Toner T3 | 49.1 | 46.2 | 28.1 | 40 | 6.1 | 31.3 | 61.0 | Emulsion Polymerization |
| Toner T4 | 89.5 | 76.9 | 14.8 | 61 | 8.9 | 26.6 | 77.8 | Suspension Polymerization |

Preparation of Developers

Preparation of Developer 1

Added to 100 parts of said Toner T1 were 0.4 part of hydrophobic silica particles (R805, manufactured by Nippon Aerosil Co.) having an average particle diameter of 12 nm as well as 0.6 part of Titania particles (T805, manufactured by Nippon Aerosil Co.) as the external additives, and the resulting composition was stirred at normal temperature for 10 minutes at a circumferential speed of the stirring blade of 40 m/second, employing a Henschel mixer, whereby a negatively chargeable toner was obtained. The adhesion ratio of said toner was 45 percent.

Said toner was blended with a silicone resin coated ferrite carrier having a volume average particle diameter of 60 $\mu$m, and Developer 1 having a toner concentration of 5 percent was prepared.

Preparation of Developers 2, 3, and 4

Developer 2 was prepared in the same manner as Developer 1, except that Toner T1 was replaced with Toner T2. Developer 3 was prepared in the same manner as Developer 1, except that Toner Tl was replaced with Toner T3. Developers 4 was prepared in the same manner as Developer 1, except that Toner T1 was replaced with Toner T4.

Prepared as a cleaning blade employed in the cleaning unit of the present invention, one described below was prepared.

Production of Cleaning Blade

Mixed with a thermally melted urethane prepolymer were 1,4-butanediol and trimethylolpropane in the compounding ratio described below. The resulting mixture was molded employing a previously heated molding die and thermally hardened. After said molding, the width, thickness and length were adjusted, and subsequently cut and machined, whereby a cleaning blade was prepared.

Cleaning Blade 1

Urethane: ethylene adipate based prepolymer (having an Mn of 2,000 and an NCO of 6.5%) 100 weight parts

| | |
|---|---|
| Urethane: ethylene adipate based prepolymer (having an Mn of 2,000 and an NCO of 6.5%) | 100 weight parts |
| 1,4-Butanediol | 4.3 weight parts |
| Trimethylolpropane | 2.2 weight parts |

The obtained cleaning blade, having hardness of 70°, and an impact resilience of 75 at temperature of 25° C., is called "B1".

Cleaning Blade 2

Urethane: ethylene adipate based prepolymer (having an Mn of 2,000 and an NCO of 6.5%) 100 weight parts

| | |
|---|---|
| Urethane: ethylene adipate based prepolymer (having an Mn of 2,000 and an NCO of 6.5%) | 100 weight parts |
| 1,4-Butanediol | 4.3 weight parts |
| Trimethylolpropane | 2.2 weight parts |

The obtained cleaning blade, having hardness of 65°, and an impact resilience of 54 at temperature of 25° C., is called "B2".

Cleaning Blade 3

Urethane: ethylene adipate based prepolymer (having an Mn of 2,000 and an NCO of 6.5%) 100 weight parts

| | |
|---|---|
| Urethane: ethylene adipate based prepolymer (having an Mn of 2,000 and an NCO of 6.5%) | 100 weight parts |
| 1,4-Butanediol | 4.3 weight parts |
| Trimethylolpropane | 2.2 weight parts |

The obtained cleaning blade, having hardness of 75 °, and an impact resilience of 75 at temperature of 25° C., is called "B3".

Evaluation-1 of Dynamic Torque and Cleaning Properties

TABLE 2

| | | Developer | | | Contact | Blade | |
|---|---|---|---|---|---|---|---|
| No. | Photoreceptor | (Toner) No. | Blade Member | Contact Angle (°) | load (N/m) | Thickness (mm) | Free length (mm) |
| 1 | P1 | 1 (T1) | B1 | 15 | 0.2 | 2 | 9 |
| 2 | P2 | 2 (T2) | B2 | 20 | 0.3 | 2 | 9 |
| 3 | P3 | 4 (T4) | B3 | 25 | 0.1 | 2 | 9 |
| 4 | P1 | 4 (T4) | B3 | 25 | 0.3 | 2 | 9 |
| 5 | P2 | 2 (T2) | B2 | 15 | 0.1 | 2 | 9 |
| 6 | P3 | 1 (T1) | B1 | 20 | 0.2 | 2 | 9 |
| 7 | P2 | 4 (T4) | B3 | 15 | 0.1 | 2 | 9 |
| 8 | P3 | 2 (T2) | B1 | 25 | 0.3 | 2 | 9 |

Evaluation of toner lost through the blade, blade turn over, blade noise was carried out employing a digital copier, Konica 7050, manufactured by Konica Corp., basically comprising the image forming process (including processes of corona charging, laser exposure, reversal development, electrostatic transfer, claw separation, and cleaning utilizing a cleaning blade) described in FIG. 1, under combinations of the photoreceptor, the developer, the member of the cleaning blade, and the contact condition as described in Table 2. During said evaluation, an original document, having equal quarters of a text image of a pixel ratio of 7 percent, a gray scale image, a solid white image, and a solid black image, was continuously copied onto A4 paper sheets for 90 minutes continuously at normal temperature and normal humidity (24° C. and 60 percent relative humidity). However, prior to the beginning of said evaluation, in order that said cleaning blade became accustomed to the photoreceptor, cleaning powder was scattered onto the photoreceptor and the cleaning blade, and said photoreceptor was rotated for 1 minute. Further, the measuring dynamic torque and calculating formulas 2 to 6 and other evaluation conditions are described below. Table 3 shows the evaluation results.

Evaluation condition

Test is conducted by employing Konica 7050, mentioned above, and the other condition is set as follows.

Charging condition

Charging unit: scorotron charging unit; the initial charge potential was set at −750 V.

Exposure condition

The exposure amount was set so as to obtain an exposure section potential of −50 V.

TABLE 3

| No. | S (Formula 2) | K (Formula 3) | G (Formula 4) | H (Formula 5) | J (Formula 6) | Toner lost through | Blade turn over | Blade noize |
|---|---|---|---|---|---|---|---|---|
| 1 | 15 | 0.78 | 0.1 | 0.2 | 0.7 | Not observed | Not observed | Not observed |
| 2 | 16 | 0.61 | 0.05 | 0.8 | 0.6 | Not observed | Not observed | Not observed |
| 3 | 26 | 0.67 | 0.02 | 0.05 | 0.7 | Not observed | Not observed | Not observed |
| 4 | 40 | 0.75 | 0.005 | 0.02 | 0.8 | Not observed | Not observed | Not observed |
| 5 | 50 | 0.82 | 0.002 | 0.01 | 0.8 | Not observed | Not observed | Not observed |
| 6 | 57 | 0.86 | 0.001 | 0.001 | 0.8 | Not observed | Not observed | Not observed |
| 7 | 12 | 0.90 | 0.2 | 0.3 | 0.9 | observed | Not observed | Not observed |
| 8 | 5 | 0.95 | 0.5 | 0.5 | 1.0 | Observed | Observed 10 minutes operation | Observed |

As can clearly be seen from Table 3, in the samples 1 to 6, values of S of Formula 2, K of Formula 3, G of Formula 4, H of Formula 5, and J of Formula 6, are within values specified by the present invention, the toner lost through, the blade turn over and the blade noise result in no problem for commercial viability. By contrast, in the samples of 7 and 8,values of S, K, G, H, and J, are fallen outside values specified by the present invention, the toner lost through, the blade turn over and the blade noise result in certain problems for commercial viability. Measurement of dynamic torque at the frequency of 10 to 10kHz, and calculation by formulas 2 to 6

Dynamic torque varying within the frequency range of 10 to 10kHz was measured by a torque detector (MD 204R, product by ONO SOKKI Co. Ltd.) provided between a motor driving the photoreceptor and a shaft driving the photoreceptor. FIG. 16 shows a schematic view of the torque detector. The torque detector is composed of the shaft driving the photoreceptor of Konica 7050, which is employed in the image evaluation mentioned above, the driving motor, and a cleaning apparatus. The cleaning blade is provided onto the torque detector in the same condition as that the image evaluation is conducted, and dynamic torque is measured for each predetermined condition. The dynamic torque of the cleaning blade is detected by the torque detector, detected signal is forwarded to operating display (TS 3600, product by ONO SOKKI Co. Ltd.), and it is processed by a personal computer according to the Formulas 2 to 6. The dynamic torque is measured for a photoreceptor having no toner thereon in such condition that radius of the photoreceptor is 80 mm, and circumferential speed is 280 mm/sec, sampling is 1 data/msec. Before the torque detecting, in order that said cleaning blade became accustomed to the photoreceptor, cleaning powder was scattered onto the photoreceptor and the cleaning blade, and said photoreceptor was rotated for 1 minute.

Development conditions

DC bias: −550 V

Dsd: 550 $\mu$m

Developer layer regulation: edge-cut system

Developer layer thickness: 700 $\mu$m

Development sleeve diameter: 40 mm

Transfer condition

Transfer electrode: corona charging system, electric current of a transfer dummy; 45 $\mu$A Cleaning conditions Types of cleaning blades as well as set conditions were described in Table 2.

Evaluation Items and Evaluation Criteria

Toner lost through the blade

Toner on the photoreceptor for solid black (0.7 mg/cm$^2$) is entered to the cleaning blade, and residual toner lost through the blade is measured. Percentage of the lost though toner is evaluated.

A: Not observed. Practically acceptable.

B: 0 to not more than 20 % toner is lost through.

Practically acceptable.

C: 20 to not more than 50 % toner is lost through.

D: 50 % or more toner is lost through. Practically not acceptable.

Blade turn over

Time to take starting blade turn over.

Blade Noise

Blade noise due to the abnormal friction of the blade with the photoreceptor is observed.

Measurement of Dynamic Torque and Cleaning Characteristics 2

Value of S is made varied as shown in Tables 4 and 5, by selecting the cleaning condition, and the toner lost through and blade turn over is evaluated in each condition. The result is summarized also in Tables 4 and 5. The test is carried out copying for 90 minutes continuously employing a digital copier, Konica 7050, manufactured by Konica Corp., similarly to the evaluation 1. The evaluation is carried out by two ways, a combination of Photoreceptor P1 with Developer 1 (Toner T1) and a combination of Photoreceptor P1 with Developer 3 (Toner T3).

Cleaning Condition

Contact angle of blade: 15°, 20°, 25°

Load of the blade: 0.1, 0.2, 0.3 (N/m)

Blade member: B1, B2, B3

Free length of the blade: 5, 7, 9 mm

Thickness of the blade 1, 1.5, 2 mm the evaluation 1. The evaluation is carried out by a combination of Photoreceptor P1 with Developer 1 (Toner T1).

Scratch on the photoreceptor

After 500,000 copying, the scratch on surface of the photoreceptor was observed by eyes watching.

A: No defect is observed.

B: Fine scratch is observed but no substantive damage on image.

C: Scratch and image defect thereby are observed.

Toner filming on the photoreceptor

After 500,000 copying, the toner filming on surface of the photoreceptor was observed by eyes watching.

TABLE 4

| | Photoreceptor: P1, Toner: T1 | | | | | | | | | |
|---|---|---|---|---|---|---|---|---|---|---|
| S | 11.5 | 12 | 12.5 | 13 | 13.5 | 14 | 16 | 20 | 25 | 30 |
| Blade turn out | Not observed | Not observed | Not observed | Not observed | Not observed | Not observed | Not observed | Not observed | Not observed | Not observed |
| Toner lost through | D | C | B | A | A | A | A | A | A | A |

TABLE 5

| | Photoreceptor: P1, Toner: T3 | | | | | | | | | |
|---|---|---|---|---|---|---|---|---|---|---|
| S | 11.5 | 12 | 12.5 | 13 | 13.5 | 14 | 16 | 20 | 25 | 30 |
| Blade turn out | Not observed | Not observed | Not observed | Not observed | Not observed | Not observed | Not observed | Not observed | Not observed | Not observed |
| Toner lost through | D | C | C | A | A | A | A | A | A | A |

TABLE 6

| | Photoreceptor: P1, Toner: T1, S: 13 | | | | | | | |
|---|---|---|---|---|---|---|---|---|
| K | 0.95 | 0.86 | 0.74 | 0.61 | 0.55 | 0.47 | 0.73 | 0.01 |
| Drum scratch | C | A | A | A | A | A | A | A |
| Toner filming | Not observed | Not observed | Not observed | Not observed | Not observed | Not observed | Not observed | Not observed |

Toner having S value of not less than 13 shows good cleaning characteristics without occurring toner lost through.

Measurement of Dynamic Torque and Cleaning Characteristics 3

Value of K is made varied as shown in Table 6, by selecting the cleaning condition, and the drum scratch and toner filming are evaluated in each condition. The result is summarized also in Table 6. The test is carried out copying for 90 minutes continuously employing a digital copier, Konica 7050, manufactured by Konica Corp., similarly to Measurement of Dynamic Torque and Cleaning Characteristics 4

Value of G is made varied as shown in Table 7, by selecting the cleaning condition, and the toner scattering is evaluated in each condition. The result is summarized also in Table 7. The test is carried out for 500,000 copying continuously employing a digital copier, Konica 7050, manufactured by Konica Corp., similarly to the evaluation 1. The evaluation is carried out by a combination of Photoreceptor P1 with Developer 1 (Toner T1). Among 500,000 copies the number of stained image due to toner scattering was evaluated.

TABLE 7

| | Photoreceptor: P1, Toner: T1, S: 13 | | | | | | | |
|---|---|---|---|---|---|---|---|---|
| G | 0.001 | 0.002 | 0.005 | 0.02 | 0.05 | 0.08 | 0.1 | 0.2 |
| Toner scattering | Not observed | Not observed | Not observed | Not observed | Not observed | Not observed | Not observed | Observed in 50,000 copies |

Measurement of Dynamic Torque and Cleaning Characteristics 5

Value of H is made varied as shown in Table 8, by selecting the cleaning condition, and the uneven image is evaluated in each condition. The result is summarized also in Table 8. The test is carried out for 500,000 copying for continuously employing a digital copier, Konica 7050, manufactured by Konica Corp., similarly to the evaluation 1. The evaluation is carried out by a combination of Photoreceptor P1 with Developer 1 (Toner T1). Copying test of 500,000 sheets was carried out. The first defective copy having stream like uneven image at density of 0.3 to 0.5 was observed.

Photoreceptor P1 with Developer 3 (Toner T3). Copying test of 500,000 sheets was carried out. During 500,000 copies, surface of the toner is observed by a field mission scanning microscope. When the outer additives are released from the toner resin particles or the outer additives are embedded into toner resin particles after large amount of copying, surface of the toner particles becomes smooth. Number of copying at which ratio of the toner resin particles having smooth surface exceeds 50 % is observed. When the ratio exceeds 50 %, the toner is not available for use in the toner recycle unit in the developer since charge defects or transfer defects occur.

TABLE 8

| | Photoreceptor: P1, Toner: T3, S: 13 | | | | | | | | |
|---|---|---|---|---|---|---|---|---|---|
| H | 0 | 0.001 | 0.01 | 0.02 | 0.05 | 0.08 | 0.1 | 0.2 | 0.3 |
| Uneven image | Observed at 100,000th copy | Not observed | Not observed | Not observed | Not observed | Not observed | Not observed | Not observed | Observed at 80,000th copy |

TABLE 9

| | Photoreceptor: P1, Toner: T1, S: 13 | | | | | | | | |
|---|---|---|---|---|---|---|---|---|---|
| J | 0.001 | 0.05 | 0.1 | 0.2 | 0.3 | 0.5 | 0.7 | 0.8 | 0.9 |
| Additive deffect | Not bserved until 70,000 copies | Not observed | Not observed | Not observed | Not observed | Not observed | Not observed | Not observed | Not bserved until 80,000 copies |

Measurement of Dynamic Torque and Cleaning Characteristics 6

Value of J is made varied as shown in Table 9, by selecting the cleaning condition, and the defect of outer additive to the toner is evaluated in each condition. The result is summarized also in Table 8. The test is carried out for 500,000 copying for continuously employing a digital copier, Konica 7050, manufactured by Konica Corp., similarly to the evaluation 1. The evaluation is carried out by a combination of Example 11

Production of Photoreceptor P11

Charged into a solvent mixture consisting of 900 ml of methanol and 100 ml of butanol were 30 g of polyamide resin Amilan CM-8000 (manufactured by Toray Co.), which were dissolved at 50° C. The resulting composition was applied onto an electrically conductive cylindrical aluminum support having an outer diameter of 80 mm and a length of 360 mm to form a 0.5 $\mu$m thick interlayer.

Subsequently, 10 g of silicone resin KR-5240 (manufactured by Shin-Etsu Kagaku Kogyo Co.) were dissolved in 1,000 ml of t-butyl acetate, and 10 g of Y-TiOPc (described in FIG. 1 of Japanese Patent Publication Open to Public Inspection No. 64-17066) were then added to the resulting solution. Subsequently, the resulting mixture was dispersed for 20 hours employing a sand mill whereby a charge generating layer coating composition was obtained. Said coating composition was applied onto said interlayer to form a 0.3 μm thick charge generating layer.

Subsequently, 150 g of CTM (T-1: N-(4-methylphenyl)-N-{4-(β-phenylstyryl)phenyl}-p-toluidine) and 200 g of polycarbonate resin Upiron Z-200 (manufactured by Mitsubishi Gas Kagaku Co.), having a viscosity average molecular weight of 20,000, were dissolved in 1,000 ml of 1,2-dichloroethane, whereby a charge transport coating composition was obtained. Said coating composition was applied onto said charge generating layer employing a circular slide hopper, and subsequently dried at 100° C. for one hour to form a 22 μm thick charge transport layer. As previously described, Photoreceptor P1 was obtained which was comprised of said interlayer, said charge generating layer, and said charge transport layer.

Production of Photoreceptor 12

Applied onto said charge transport layer of Photoreceptor P11 obtained in Photoreceptor P11 Production Example, was a coating composition prepared by dissolving 30 g of CTM T-1 and 50 g of polycarbonate resin Upiron Z-800 (manufactured by Mitsubishi Gas Kagaku Co.), having a viscosity average molecular weight of 80,000, in 1,000 ml of 1,2-dichloroethane, employing a circular slide hopper, and subsequently, dried at 100° C. for one hour, whereby a 5 mm thick overcoat layer was formed, to obtain Photoreceptor P-12.

Production of Photoreceptor P13

A charge transport layer coating composition was obtained by dissolving 150 g of CMT T-1 and 200 g of polycarbonate resin Upiron Z-800 (manufactured by Mitsubishi Gas Kagaku Co.) having a viscosity average molecular weight of 80,000, in 1,000 ml of 1,2-dichloroethane. The resulting coating composition was applied onto said charge generating layer of Photoreceptor P11 Production Example, and subsequently dried at 100° C. for one hour to form a 22 μm thick charge transport layer. As previously described, Photoreceptor P13 was obtained which was comprised of said sublayer, said charge generating layer, and said charge transport layer.

Toners described below were prepared as toners which were employed in the present invention.

Production of Toners T11, T12, T14, and T15
(Example of Emulsion Polymerization Method)

Added to 10.0 liters of pure water was 0.90 kg of sodium n-dodecylsulfate, and was subsequently dissolved. Gradually added to the resulting solution were 1.20 kg of Regal 330R (carbon black manufactured by Cabot Corp.). The resulting mixture was suitably stirred for one hour, and thereafter, was continuously dispersed for 20 hours employing a sand grinder (a medium type homogenizer). The resulting dispersion was designated as "Colorant Dispersion 1". A solution comprised of 0.055 kg of sodium dodecylbenzenesulfonate and 4.0 liters of deionized eater was designated as "Anionic Surface Active Agent Solution A".

A solution comprised of 0.014 g of a nonylphenolpolyethylene oxide 10 mole addition product and 4.0 liters of deionized water was designated as "Nonionic Surface Active Agent Solution B". A solution prepared by dissolving 223.8 g of potassium persulfate in 12.0 liters of deionized water was designated as "Initiator Solution C".

Charged into a 100 liter GL (glass lined) reaction vessel fitted with a thermal sensor were 3.41 kg of WAX emulsion (polypropylene emulsion having a number average molecular weight of 3,000, a number average primary particle diameter of 120 nm, and a solid concentration of 29.9 percent), the total amount of "Anionic Surface Active Agent A", and the total amount of "Nonionic Surface Active Agent Solution B", and the resulting mixture was stirred. Subsequently, 44.0 liters of deionized water were added.

When the resulting mixture reached 75° C., the total amount of "Initiator Solution C" was added. Thereafter, while maintaining the resulting mixture at 75±1° C., a mixture consisting of 12.1 kg of styrene, 2.88 kg of n-butyl acrylate, 1.04 kg of methacrylic acid, and 548 g of t-dodecylmercaptan was added dropwise. After said dropwise addition, the resulting mixture was heated to 80±1° C. and stirred for 6 hours while maintaining said temperature. Subsequently, the temperature was lowered to no more than 40° C. and stirring was stopped. The resulting products were filtered employing a pole filter and the resulting filtrate was designated as "Latex (1)-A".

Incidentally, the resinous particles in said Latex (1)-A exhibited a glass transition temperature of 57° C. and a softening point of 121° C., a weight average molecular weight of 12,700 regarding the molecular weight distribution, and a weight average particle diameter of 120 nm.

Further, a solution prepared by dissolving 0.055 kg of sodium dodecylbenzenesulfonate in 4.0 liters of deionized water was designated as "Anionic Surface Active Agent Solution D". Further, a solution prepared by dissolving 0.014 kg of a nonylphenolpolyethylene oxide 10 mole addition product in 4.0 liters of deionized water was designated as "Nonionic Surface Active Agent Solution E".

A solution prepared by dissolving 200.7 g of potassium persulfate (manufactured by Kanto Kagaku Co.) in 12.0 liters of deionized water was designated as "Initiator Solution F".

Charged into a 100 liter GL reaction vessel fitted with a thermal sensor, a cooling pipe, a nitrogen gas inlet, and a comb shaped baffle, were 3.41 kg of WAX emulsion (polypropylene emulsion having a number average molecular weight of 3,000, a number average primary particle diameter of 120 nm, and a solid concentration of 29.9 percent), the total amount of "Anionic Surface Active Agent D", and the total amount of "Nonionic Surface Active Agent Solution E", and the resulting mixture was stirred. Subsequently, 44.0 liters of deionized water were added. When the heated resulting mixture reached 70° C., "Initiator Solution F" was added. Subsequently, a solution previously prepared by mixing 11.0 kg of styrene, 4.00 kg of n-butyl acrylate, 1.04 kg of methacrylic acid, and 9.02 g of t-dodecylmercaptan was added dropwise. After said dropwise addition, the resulting mixture was maintained at 72+2° C. and stirred for 6 hours while maintaining said temperature. Subsequently, the temperature was raised to 80+2° C., and stirring was carried out for 12 more hours while controlling the temperature within said range. The temperature was then lowered to no more than 40° C., and stirring was stopped. The resulting products were filtered employing a pole filter and the resulting filtrate was designated as "Latex (1)-B".

Incidentally, the resinous particles in said Latex (1)-B exhibited a glass transition temperature of 58° C. and a softening point of 132° C., a weight average molecular weight of 245,000 regarding the molecular weight distribution, and a weight average particle diameter of 110 nm.

A solution prepared by dissolving 5.36 g of sodium chloride as the salting-out agent in 20.0 liters of deionized water was designated as "Sodium Chloride Solution G".

A solution prepared by dissolving 1.00 g of a fluorine based nonionic surface active agent in 1.00 liter of deionized water was designated as "Nonionic Surface Active Agent Solution H".

Charged into a 100 liter SUS reaction vessel (the reaction apparatus constituted as shown in FIG. 13, having a crossed axes angle α of 20 degrees), fitted with a thermal sensor, a cooling pipe, a nitrogen gas inlet, a particle diameter and shape monitoring device, were 20.0 kg of Latex (1)-A and 5.2 kg of Latex (1)-B as prepared above, 0.4 kg of Colorant Dispersion, and 20.0 kg of deionized water, and the resulting mixture was stirred. Subsequently, the mixture was heated to 40° C., and said Sodium Chloride Solution G and 6.00 kg of isopropanol, and said Nonionic Surface Active Agent Solution G were added in said order. Thereafter, the resulting mixture was put aside for 10 minutes, and then heated to 85° C. over a period of 60 minutes. While being heated at 85+2° C. for the period of from 0.5 to 3 hours while stirring, the mixture was subjected to salting-out/fusion so that the particle diameter increased. Subsequently, the increase in the particle diameter was terminated by the addition of 2.1 liters of pure water.

Charged into a 5 liter reaction vessel (the reaction apparatus constituted as shown in FIG. 13, having a crossed axes angle α of 20 degrees), fitted with a thermal sensor, a cooling pipe, and a particle diameter and shape monitoring device, were 5.0 kg of the coalesced particle dispersion as prepared above, and said dispersion was heated at 85+2° C. for a period of from 0.5 to 15 hours so as to control the particle shape. Thereafter, the resulting dispersion was cooled to no more than 40° C. and stirring was terminated. Subsequently, while employing a centrifuge, classification was carried out in the liquid medium utilizing a centrifugal sedimentation method, and filtration was carried out employing a 45 μm sieve. The resulting filtrate was designated as Coalesced Liquid Medium (1). Subsequently, wet cake-like non-spherical particles were collected from said Coalesced Liquid Medium (1) through filtration employing a glass filter, and then washed with deionized water.

The resulting non-spherical particles were dried at an air intake temperature of 60° C., employing a flash jet dryer, and subsequently dried at 60° C. employing a fluidized layer dryer. Externally added to 100 parts by weight of the obtained colored particles were 1 part by weight of fine silica particles and 0.1 part by weight of zinc stearate, and the resulting mixture was blended employing a Henschel mixer, whereby toners shown in the table below were obtained which were prepared employing the emulsion polymerization coalescence method. Toners T11, T12, T14 and T15 shown in Table 10 were obtained by controlling the shape as well as the variation coefficient of the shape coefficient through controlling the rotation frequency of the stirrer as well as the heating time during said salting-out/fusion stage and the monitoring of the shape controlling process, and further regulating the particle diameter and the variation coefficient of the size distribution.

Production of Toner T13 (Example of Suspension Polymerization Method)

A mixture consisting of 165 g of styrene, 35 g of n-butyl acrylate, 10 g of carbon black, 2 g of di-t-butylsalicylic acid metal compound, 8 g of a styrene-methacrylic acid copolymer, and 20 g of paraffin wax (having an mp of 70° C.) was heated to 60° C., and uniformly dissolve-dispersed at 12,000 rpm employing a TK Homomixer (Tokushuki Kako Kogyo Co.). Added to the resulting dispersion were 10 g of 2,2'-azobis(2,4-valeronitile) as the polymerization initiator and dissolved to prepare a polymerizable monomer composition. Subsequently, 450 g of 0.1 M sodium phosphate were added to 710 g of deionized water, and 68 g of 1.0 M calcium chloride were gradually added while stirring at 13,000 rpm, employing a TK Homomixer, whereby a dispersion in which tricalcium phosphate was prepared. Said polymerizable monomer composition was added to said dispersion and stirred at 10,000 rpm for 20 minutes employing a TK Homomixer, whereby said polymerizable monomer composition was granulated. Thereafter, the resulting composition underwent reaction at a temperature of from 75 to 95° C. for a period of from 5 to 15 hours, employing a reaction apparatus (having a crossed axes angle α of 45 degrees) in which stirring blades were constituted as shown in FIG. 6. Tricalcium phosphate was dissolved employing hydrochloric acid and then removed. Subsequently, while employing a centrifuge, classification was carried out in a liquid medium utilizing a centrifugal sedimentation method. Thereafter, filtration, washing and drying were carried out. Externally added to 100 parts by weight of the obtained colored particles were 1.0 part by weight of fine silica particles and 0.1 part by weight of zinc stearate, and the resulting mixture was blended employing a Henschel mixer, whereby a toner was obtained which was prepared employing the suspension polymerization method.

Toner T13 shown in Table 10 below was obtained by controlling the shape as well as the variation coefficient of the shape coefficient through controlling the temperature of the liquid medium, the rotation frequency of the stirrer, and the heating duration while carrying out monitoring during said polymerization and further regulating the particle diameter as well as the variation coefficient of the size distribution.

TABLE 10

| Toner No. | Shape Coefficient Ratio of 1.0 to 1.6 (in %) | Shape Coefficient Ratio of 1.2 to 1.6 (in %) | Variation Coefficient of Shape Coefficient (in %) | Ratio of Toner Particles Without Corners (in %) | Number Average Particle Diameter (in μm) | Variation Coefficient of Particle Number Distribution (in %) | Sum M of $m_1$ and $m_2$ (in %) |
|---|---|---|---|---|---|---|---|
| Toner T11 | 69.1 | 65.8 | 14.9 | 53 | 7.4 | 26.2 | 74.0 |
| Toner T12 | 67.7 | 66.7 | 15.3 | 58 | 6.7 | 25.8 | 72.1 |

TABLE 10-continued

| Toner No. | Shape Coefficient Ratio of 1.0 to 1.6 (in %) | Shape Coefficient Ratio of 1.2 to 1.6 (in %) | Variation Coefficient of Shape Coefficient (in %) | Ratio of Toner Particles Without Corners (in %) | Number Average Particle Diameter (in $\mu$m) | Variation Coefficient of Particle Number Distribution (in %) | Sum M of $m_1$ and $m_2$ (in %) |
|---|---|---|---|---|---|---|---|
| Toner T13 | 89.5 | 66.9 | 14.8 | 51 | 7.9 | 26.6 | 77.8 |
| Toner T14 | 64.4 | 60.6 | 16.5 | 47 | 9.3 | 27.5 | 68.3 |
| Toner T15 | 64.3 | 62.3 | 16.8 | 48 | 2.8 | 28.3 | 67.4 |

Preparation of Developers

Preparation of Developer 11

Added to 100 parts of said Toner T1 were 0.4 part of hydrophobic silica particles (R805, manufactured by Nippon Aerosil Co.) having an average particle diameter of 12 nm as well as 0.6 part of Titania particles (T805, manufactured by Nippon Aerosil Co.) as the external additives, and the resulting composition was stirred at normal temperature for 10 minutes at a circumferential speed of the stirring blade of 40 m/second, employing a Henschel mixer, whereby a negatively chargeable toner was obtained. The adhesion ratio of said toner was 45 percent.

Said toner was blended with a silicone resin coated ferrite carrier having a volume average particle diameter of 60 $\mu$m, and Developer 1 having a toner concentration of 5 percent was prepared.

Preparation of Developers 12, 13, 14, and 15

Developer 12 was prepared in the same manner as Developer 11, except that Toner Tl was replaced with Toner T12. Developer 13 was prepared in the same manner as Developer 11, except that Toner T11 was replaced with Toner T13. Developers 14 and 15 were prepared in the same manner as Developer 11, except that Toner T11 was replaced with Toner T14 and Toner T15, respectively.

Prepared as a cleaning blade employed in the cleaning unit of the present invention, one described below was prepared.

Production of Cleaning Blade

Mixed with a thermally melted urethane prepolymer were 1,4-butanediol and trimethylolpropane in the compounding ratio described below. The resulting mixture was molded employing a previously heated molding die and thermally hardened. After said molding, the width, thickness and length were adjusted, and subsequently cut and machined, whereby a cleaning blade was prepared. The resulting cleaning blade was adhered to a supporting plate employing a hot-melt adhesive to obtain a cleaning blade. The free length was determined to be 9.5 mm. Subsequently, if desired, the edge section of said cleaning blade was subjected to spray coating employing a fluorine lubricant. Further, onto all edge sections in the width direction of the resulting coating, the fluorine based polymer described below and a dispersion prepared by dispersing a fluorine based resinous powder into a fluorine based solvent, were spray-coated, whereby three types of cleaning blades were obtained.

Cleaning Blade 11

Urethane: ethylene adipate based prepolymer (having an Mn of 2,000 and an NCO of 6.5%) 100 weight parts

| | |
|---|---|
| Urethane: ethylene adipate based prepolymer (having an Mn of 2,000 and an NCO of 6.5%) | 100 weight parts |
| 1,4-Dutanediol | 4.3 weight parts |
| Trimethylolpropane | 2.2 weight parts |

Fluorine based lubricant

Polyfuron Spray Wax (manufactured by Daikin Co., Ltd.)

Fluorine based polymer and fluorine based resinous powder

PVDF Fluorine based solvent

Hexylene hexafluoride

Cleaning blades prepared by employing materials above were designated as Cleaning Blade B11 .

Cleaning Blade 12

Urethane: ethylene adipate based prepolymers (having an Mn of 2,000 and an NCO of 6.5%) 100 weight parts

| | |
|---|---|
| Urethane: ethylene adipate based prepolymer (having an Mn of 2,000 and an NCO of 6.5%) | 100 weight parts |
| 1,4-Butanediol | 4.3 weight parts |
| Trimethylolpropane | 2.2 weight parts |

Fluorine based lubricant

Ruburon Spray Wax (manufactured by Daikin Co., Ltd.)

Fluorine based polymer and fluorine based resinous powder

PTFE, and PVDF Fluorine based solvent

Hexylene hexafluoride

Cleaning blades prepared by employing materials above were designated as Cleaning Blade B12.

Cleaning Blade 13

Urethane: ethylene adipate based prepolymer (having an Mn of 2,000 and an NCO of 6.5%) 100 weight parts

| | |
|---|---|
| Urethane: ethylene adipate based prepolymer (having an Mn of 2,000 and an NCO of 6.5 %) | 100 weight parts |
| 1,4-Butanediol | 4.3 weight parts |
| Trimethylolpropane | 2.2 weight parts |

Fluorine based lubricant not used Fluorine based polymer and fluorine based resinous powder PTFE Fluorine based solvent Hexylene hexafluoride Cleaning blades prepared by employing materials above were designated as Cleaning Blade B13.

Evaluation-11 of Dynamic Torque and Cleaning Properties

TABLE 11

| Example No. | Photo-receptor No. | Toner No. | Blade Member | Contact Angle | Contact Load (in N/m) |
|---|---|---|---|---|---|
| Example 1 | P12 | T11 | B11 | 20 degrees | 17.6 |
| Example 2 | P12 | T12 | B12 | 22 degrees | 16.7 |
| Example 3 | P13 | T13 | B11 | 19 degrees | 15.7 |
| Example 4 | P13 | T12 | B13 | 18 degrees | 18.6 |
| Example 5 | P13 | T13 | B13 | 21 degrees | 19.6 |
| Example 6 | P12 | T12 | B12 | 23 degrees | 15.6 |
| Comparative Example 1 | P11 | T11 | B11 | 15 degrees | 14.7 |
| Comparative Example 2 | P11 | T12 | B12 | 13 degrees | 16.7 |
| Comparative Example 3 | P11 | T13 | P13 | 25 degrees | 21.6 |
| Comparative Example 4 | P11 | T12 | B11 | 24 degrees | 13.7 |
| Comparative Example 5 | P12 | T12 | B12 | 22 degrees | 15.7 |
| Comparative Example 6 | P12 | T13 | B13 | 12 degrees | 21.6 |
| Comparative Example 7 | P12 | T14 | B11 | 20 degrees | 17.7 |
| Comparative Example 8 | P12 | T15 | B11 | 20 degrees | 17.6 |

Evaluation was carried out employing a digital copier, Konica 7050, manufactured by Konica Corp., basically comprising the inage forming process (including processes of corona charging, laser exposure, reversal development, electrostatic transfer, claw separation, and cleaning utilizing a cleaning blade) described in FIG. 1, under combinations of the photoreceptor, the developer, the member of the cleaning blade, and the contact condition as described in Table 2. During said evaluation, an original document, having equal quarters of a text image of a pixel ratio of 7 percent, a gray scale image, a solid white image, and a solid black image, was continuously copied onto 1,000,000 A4 paper sheets at normal temperature and normal humidity (24° C. and 60 percent relative humidity). However, prior to the beginning of said evaluation, in order that said cleaning blade became accustomed to the photoreceptor, cleaning powder was scattered onto the photoreceptor and the cleaning blade, and said photoreceptor was rotated for 1 minute. Further, the average of dynamic torque as well as $\tau$ was determined employing the aforementioned torque measurement device. Other evaluation conditions are described below. Table 12 shows the evaluation results.

Other Evaluation Conditions

Other evaluation conditions employed in said Konica 7050 were set as those described below.

Charging condition Charging unit: scorotron charging unit; the initial charge potential was set at −750 V.

Exposure condition The exposure amount was set so as to obtain an exposure section potential of −50 V. Development conditions DC bias: −550 V Dsd: 550 $\mu$m Developer layer regulation: edge-cut system Developer layer thickness: 700 $\mu$m Development sleeve diameter: 40 mm Transfer condition Transfer electrode: corona charging system, electric current of a transfer dummy; 45 $\mu$A Cleaning conditions Types of cleaning blades as well as set conditions were described in Table 11.

Evaluation Items and Evaluation Criteria Halftone unevenness

Figure 17:
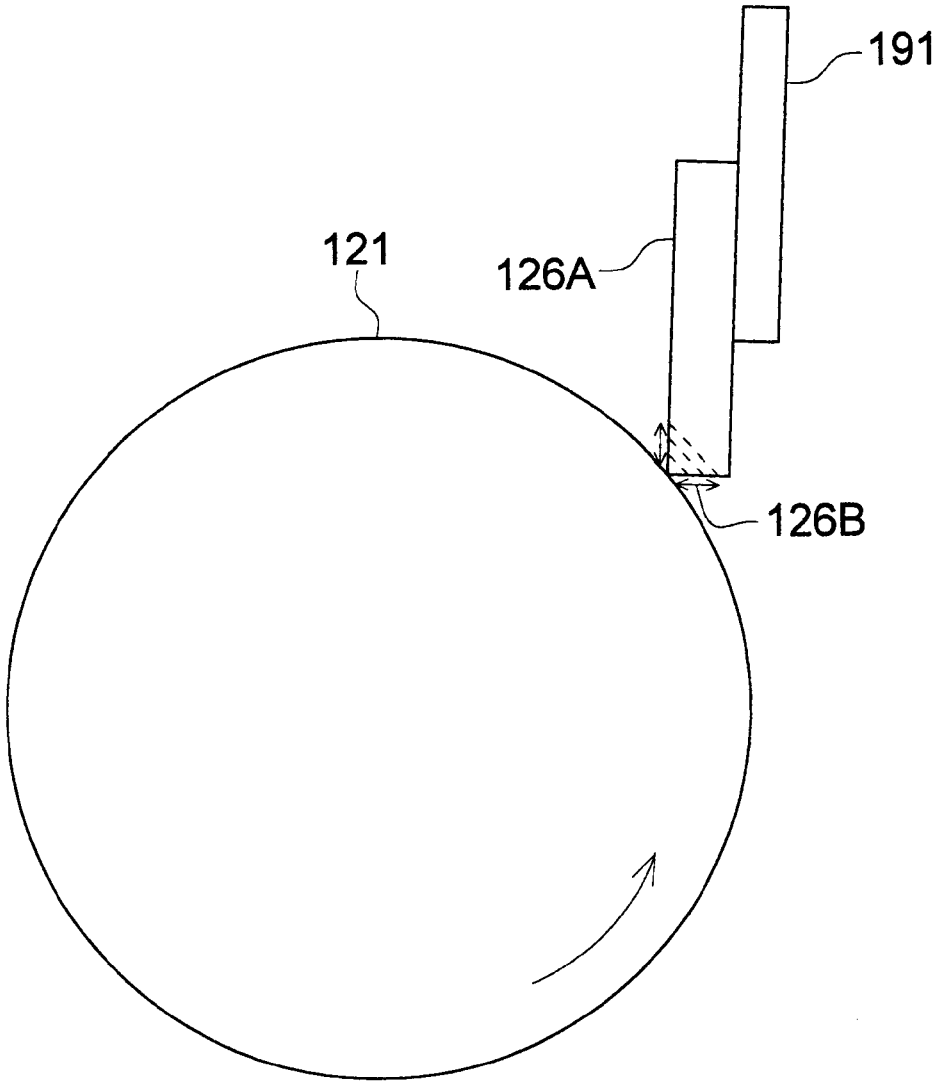
FIG. 17 is a schematic view showing the measurement method of the amount of wear of a cleaning blade edge.

Gray scale images having an image density of 0.4 were prepared and the presence and absence of any unevenness in the photoreceptor circumferential direction were visually inspected. White streaks due to a partially broken blade The presence and absence of white streak image problems in solid black images were visually inspected. Blade wear amount FIG. 17 is a schematic view explaining a method for determining the amount of wear of the edge of a cleaning blade. As shown in FIG. 17, the wear amount of the edge of a cleaning blade is obtained as follows. The edge section is magnified employing an optical or laser microscope and the amount of wear was obtained by measuring the resulting image.

In FIG. 17, numeral 121 is a photoreceptor drum, 126A is a cleaning blade, 191 is a blade holding member, and 126B is the amount of wear of the cleaning blade. Decrease amount of photoreceptor layer thickness Ten areas of the photosensitive layer having a uniform thickens were randomly selected and the thickness of each area was measured. The average was then designated as the thickness of said photosensitive layer. The layer thickness was determined employing an eddy current system layer thickness measurement device, Eddy 560C (manufactured by Helmut Fischer GMBTE Co.). The difference in the thickness of the photosensitive layer before and after the actual imaging test was designated as the decrease amount of the layer thickness.

General Evaluation

A: the wear of the photoreceptor, as well as of the blade, was extremely small and cleaning properties were excellent through the entire 1,000,000 copies B: the wear of the photoreceptor as well as of the blade was minimal, and cleaning properties were excellent until 500,000 copies C: cleaning properties were unsatisfactory or the photoreceptor as well s th blade was subjected to great wear, and no commercial viability resulted in copiers and the like in which high durability was needed.

The result is summarized in Table 12.

TABLE 12

(S = 13)

| Example No. | $Y_0$ (in N · m) | $Y_{100}$ (in N · m) | $Y_{100} - Y_0$ | $Y_{100}/Y_0$ | τ (in sec.) | Halftone Unevenness |
|---|---|---|---|---|---|---|
| Example 11 | 0.049 | 0.108 | 0.059 | 2.204 | 0.086 | none during 1,000,000 copies |
| Example 12 | 0.245 | 0.353 | 0.108 | 1.441 | 0.182 | none during 1,000,000 copies |
| Example 13 | 0.304 | 0.49 | 0.186 | 1.612 | 0.012 | none until 500,000 copies |
| Example 14 | 0.069 | 0.169 | 0.127 | 2.841 | 0.490 | none until 500,000 copies |
| Example 15 | 0.020 | 0.030 | 0.010 | 1.5 | 0.018 | none until 500,000 copies |
| Example 16 | 0.108 | 0.304 | 0.196 | 2.815 | 0.398 | none until 500,000 copies |
| Comparative Example 11 | 0.020 | 0.204 | 0.004 | 1.2 | 0.008 | none until 80,000 copies |
| Comparative Example 12 | 0.147 | 0.353 | 0.206 | 2.401 | 0.522 | none until 500,000 copies |
| Comparative Example 13 | 0.372 | 0.421 | 0.049 | 1.132 | 0.544 | none until 500,000 copies |
| Comparative Example 14 | 0.020 | 0.06 | 0.040 | 3 | 0.680 | none until 500,000 copies |
| Comparative Example 15 | 0.108 | 0.118 | 0.010 | 1.093 | 0.007 | formed until 70,000 copies |
| Comparative Example 16 | 0.137 | 0.118 | (0.019) | 0.861 | 1.120 | formed until 10,000 copies |
| Comparative Example 17 | 0.050 | 0.258 | 0.208 | 5.160 | 0.618 | none during 1,000,000 copies |
| Comparative Example 8 | 0.048 | 0.260 | 0.212 | 5.417 | 0.650 | none during 1,000,000 copies |

| Example No. | White Streaks due to a Partially Broken Blade | Blade Abrasive Wear Amount | Decrease in Thickness of Photoreceptor | General Evaluation |
|---|---|---|---|---|
| Example 11 | none during 1,000,000 copies | 3 μm | 4 μm | A |
| Example 12 | none during 1,000,000 copies | 2 μm | 3 μm | A |
| Example 13 | none until 500,000 copies | 5 μm | 7 μm | B |
| Example 14 | none until 500,000 copies | 6 μm | 6 μm | B |
| Example 15 | none until 500,000 copies | 5 μm | 7 μm | B |
| Example 16 | none until 500,000 copies | 4 μm | 6 μm | B |
| Comparative Example 11 | none until 500,000 copies | 4 μm | 6 μm | C |
| Comparative Example 12 | formed until 30,000 copies | 17 μm | 11 μm | C |
| Comparative Example 13 | formed until 20,000 copies | 18 μm | 17 μm | C |
| Comparative Example 14 | formed wit 40,000 copies | 16 μm | 16 μm | C |
| Comparative Example 15 | none until 500,000 copies | 6 μm | 7 μm | C |
| Comparative Example 16 | none until 500,000 copies | 6 μm | 7 μm | C |
| Comparative Example 17 | formed until 40,000 copies | 16 μm | 12 μm | C |
| Comparative Example 18 | formed until 30,000 copies | 18 μm | 14 μm | C |

As can clearly be seen from the Examples, when the cleaning device of the present invention is constituted so as to result in the following average of the dynamic torque generated between the organic photoreceptor and the cleaning blade, it is possible to provide an image forming apparatus which results in high image quality as well as in high durability by minimizing image problems and also by minimizing the wear of the blade and the photoreceptor. Namely, said cleaning device is constituted so that the aforementioned Formula 21 and the aforementioned Formula 22 are satisfied between $Y_0$, which represents the average of dynamic torque when toner images are not formed, and $Y_{100}$, which represents the dynamic torque average when toner images are formed under a 100 percent blackening ratio, and further, the shortest time (τ), which is required to change said dynamic toque from $Y_0$ to $Y_{100}$, is from 0.010 to 0.500 second.

What is claimed is:

1. A cleaning unit having a cleaning blade which removes residual toner from an organic photoreceptor, wherein said cleaning unit is constituted so as to satisfy relational expression, Formula 2, when the variation of dynamic torque values of from 10 Hz to 10 kHz, generated between said organic photoreceptor and said cleaning blade, is expressed by Formula 1.

$$T=\Sigma\{(X_{2n-1})^2+(X_{2n})^2\},\ n=1 \text{ to } 12 \qquad \text{Formula 1}$$

$$M=\{\Sigma(X_{2n-1}+X_{2n}))^2/24,\ n=1 \text{ to } 12$$

$$N=\{(\Sigma X_{2n-1})^2+(\Sigma X_{2n})^2\}/12 - M,\ n=1 \text{ to } 12$$

$$E=(T - M - N)/22$$

wherein $X_{2n-1}$: Maximum value of dynamic torque from (n-1) to n minutes in N-m, wherein n is 1 to 12, $X_{2n}$: Minimum value of dynamic torque from (n-1) to n minutes in N-m, $$S \geqq 13 \qquad \text{Formula 2}$$

wherein $$S=10\log\{(M - E)/24E\}.$$

2. The cleaning unit of claim 1, wherein the cleaning unit is constituted so as to satisfy relational expression, Formula 3;

$$0.001<K<0.9 \qquad \text{Formula 3}$$

wherein $$K=\sqrt{\{(M - E)/24\}}.$$

3. The cleaning unit of claim 1, wherein said cleaning unit is constituted so as to satisfy relational expression, Formula 4;

$$0<G \leqq 0.1 \qquad \text{Formula 4;}$$

wherein $$G=\sqrt{E}.$$

4. The cleaning unit of claim 1, wherein said cleaning unit is constituted so as to satisfy relational expression, Formula 5;

$$0<H \leqq 0.2 \qquad \text{Formula 5}$$

wherein $$H=\Sigma(X_{2n-1})/12-\Sigma(X_{2n})/12,\ n=1 \text{ to } 12$$

5. The cleaning unit of claim 1, wherein the cleaning unit is constituted so as to satisfy relational expression, Formula 6;

$$0.1<J \leqq 0.8 \qquad \text{Formula 6}$$

wherein $$J=\Sigma\{(X_{2n-1})+(X_{2n})\}/24,\ n=1 \text{ to } 12$$

6. The cleaning unit of claim 1, wherein the cleaning unit is constituted so that an average of dynamic torque generated between said organic photoreceptor and said cleaning blade satisfies Formulas 11 and 12 described below, when $Y_0$ represents the average of dynamic torque when toner images are not formed on said organic photoconductor, and $Y_{100}$ represents the average of dynamic torque when toner images are formed under a blackening ratio of 100 percent.:

$$0.2 \geqq Y_{100}-Y_0 \geqq 0.01 \qquad \text{Formula 21}$$

$$2.95 \geqq Y_{100}/Y_0 \geqq 1.15 \qquad \text{Formula 22}$$

(unit of $Y_{100}$ and $Y_0$: N.m).

7. The cleaning unit of claim 1, wherein when $Y_0$ represents an average of dynamic torque, when toner images are not formed on said organic photoconductor, and $Y_{100}$ represents the average of dynamic torque, when toner images are formed under a blackening ratio of 100 percent, the shortest time $\tau$ to change said dynamic torque from $Y_0$ to $Y_{100}$ is from 0.010 to 0.500 second.

* * * * *